US006398489B1

(12) United States Patent
Burdgick et al.

(10) Patent No.: US 6,398,489 B1
(45) Date of Patent: Jun. 4, 2002

(54) AIRFOIL SHAPE FOR A TURBINE NOZZLE

(75) Inventors: Steven Sebastian Burdgick, Schenectady; Joseph Francis Patik, Cohoes, both of NY (US); Gary Michael Itzel, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/779,226

(22) Filed: Feb. 8, 2001

(51) Int. Cl.[7] ..... F01D 9/04
(52) U.S. Cl. ..... 415/115; 415/191; 415/208.2
(58) Field of Search ..... 415/191, 208.2, 415/115; 416/243, DIG. 2, DIG. 5

(56) References Cited

U.S. PATENT DOCUMENTS 4,585,395 A * 4/1986 Nourse et al. ..... 416/223 A
5,174,715 A * 12/1992 Martin ..... 415/209.4
5,267,834 A 12/1993 Dinh et al.
5,299,915 A 4/1994 Dinh et al.
5,980,209 A 11/1999 Barry et al.
6,077,036 A 6/2000 Heffron et al.

* cited by examiner

*Primary Examiner*—Edward K. Look
*Assistant Examiner*—Ninh Nguyen
(74) *Attorney, Agent, or Firm*—Nixon & Vanderhye

(57) ABSTRACT

A first-stage nozzle vane includes an airfoil having a profile according to Table I. The annulus profile of the hot gas path is defined in conjunction with the airfoil profile and the profile of the inner and outer walls by the Cartesian coordinate values given in Tables I and II, respectively. The airfoil is a three-dimensional bowed design, both in the airfoil body and in the trailing edge. The airfoil is steam and air-cooled by flowing cooling mediums through cavities extending in the vane between inner and outer walls.

8 Claims, 4 Drawing Sheets

FIG. 2
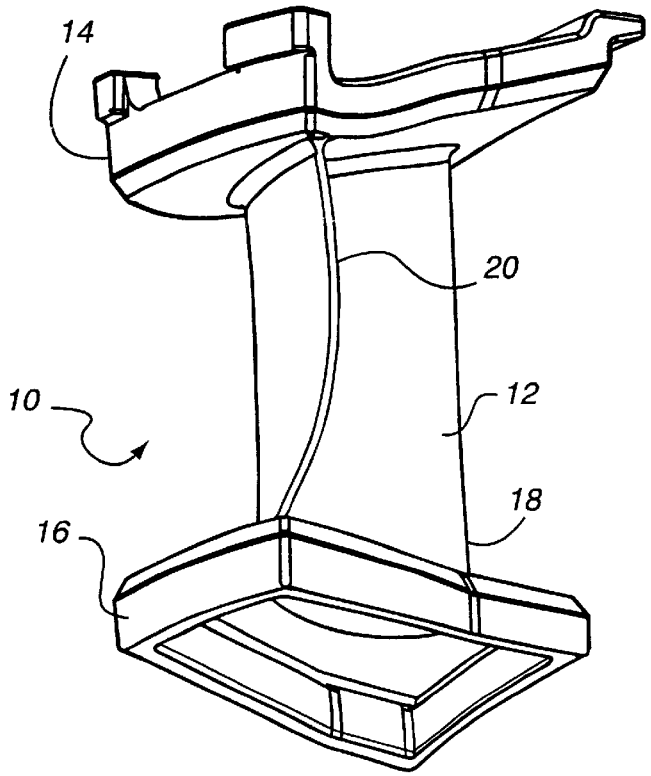
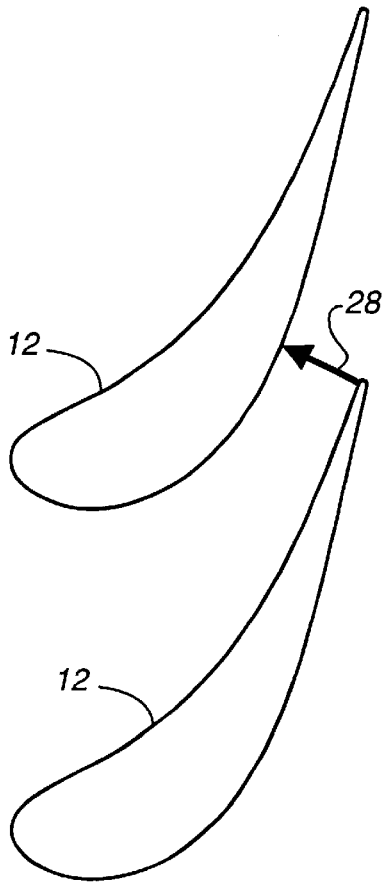
FIG. 3

AIRFOIL SHAPE FOR A TURBINE NOZZLE

This invention was made with Government support under Contract No. DE-FC21-95MC31176 awarded by the Department of Energy. The Government has certain rights in this invention.

BACKGROUND OF THE INVENTION

The present invention relates to an airfoil for a nozzle stage of a gas turbine and particularly relates to a novel and improved airfoil and annulus profile for the first-stage nozzle of a combined air and steam-cooled gas turbine.

In the development of an advanced combined air and steam-cooled gas turbine, many specific requirements must be met for each stage of the hot gas path section of the turbine in order to meet the design goal, in this instance, a 60% combined-cycle efficiency goal. Particularly, the first stage of the turbine section must meet efficiency, heat load, life, throat area and vectoring requirements to meet that goal. Conventional nozzle designs do not allow for the added benefit of advanced three-dimensional aerodynamics that improve the use of the combustion gases to improve blade loading sufficiently to meet that goal.

BRIEF SUMMARY OF THE INVENTION

In accordance with a preferred embodiment of the present invention, there has been developed an airfoil shape, as well as a configuration of the inner and outer bands for a nozzle stage of a gas turbine, preferably the first stage nozzle, that enhance the performance of the gas turbine. The nozzle airfoil hereof is characterized by a high degree of bow in the trailing edge, as well as in the body of the airfoil. It is this bow that causes improved total pressure and momentum in the stage 1 bucket which increases the efficiency of the turbine section of the engine. The nozzle stage hereof improves the interaction between various stages in the turbine, affords improved aerodynamic efficiency through the first stage and improves the first stage blade loading. Thus, it is the profile of the airfoil and the surface configuration of the inner and outer bands which define the hot gas path annulus about the nozzle stage which meet the requirements for stage efficiency as well as parts life and manufacturing.

In a preferred embodiment according to the present invention, there is provided an airfoil for a gas turbine nozzle stage having a profile at ambient temperature substantially in accordance with Cartesian coordinate values of X, Y and Z set forth in Table I wherein Z is a height from a plane through a horizontal centerline of the turbine and X and Y are coordinate values defining the profile at each distance Z from the plane through the horizontal centerline of the turbine, the values being in inches and having a tolerance of +0.165 to −0.135.

In a further preferred embodiment according to the present invention, there is provided a nozzle stage for a gas turbine comprising forty-two airfoils spaced equally one from the other about a horizontal centerline of the gas turbine, each airfoil having a profile at ambient temperature substantially in accordance with Cartesian coordinate values of X, Y and Z set forth in Table I wherein Z is a height from a plane through a horizontal centerline of the turbine and X and Y are coordinate values defining the profile at each distance Z from the plane through the horizontal centerline of the turbine, the values being in inches and having a tolerance of +0.165 to −0.135.

BRIEF DESCRIPTION OF THE DRAWINGS

FIG. 2 is a rear trailing edge perspective view of the nozzle segment of FIG. 1;

FIG. 3 is a schematic illustration along a radius of the gas turbine illustrating the throat between adjacent airfoils;

DETAILED DESCRIPTION OF THE INVENTION

Figure 1:
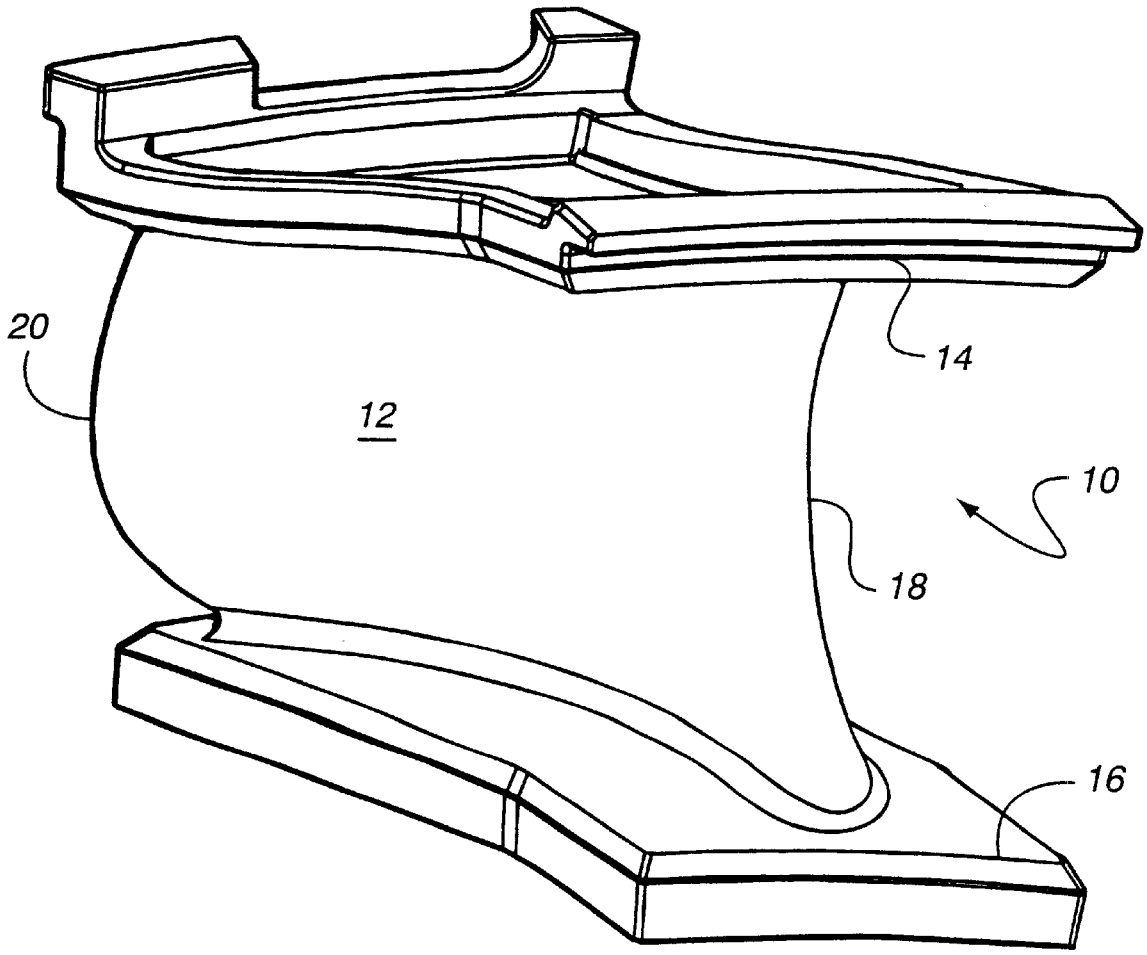
FIG. 1 is a front leading edge perspective view of a nozzle stage segment illustrating the outer and inner bands and a nozzle airfoil therebetween constructed in accordance with a preferred embodiment of the present invention.

Referring now to the drawing figures, particularly to FIGS. 1 and 2, there is illustrated a nozzle stage segment, generally designated 10, comprised, in the illustrated figures, of an airfoil or vane 12 extending between an outer wall 14 and an inner wall 16. It will be appreciated that a plurality of segments 10 are disposed in a circumferential array thereof in a gas turbine to form a nozzle stage defining an annular gas path through the nozzle stage. It will also be appreciated that each nozzle segment may include one, two or more nozzle vanes 12 extending between the inner and outer walls 14 and 16, the walls 14 and 16 forming portions of the inner and outer bands in the annular array of segments. In this particular nozzle stage, the vane has a plurality of cavities passing lengthwise therethrough between the inner and outer walls. A cooling medium such as steam is passed through the cavities to cool the walls of the vane. The cooling medium also cools the outer and inner walls 14 and 16, respectively. The cooling is effected preferably by impingement-cooling, which is generally described and illustrated in U.S. Pat. No. 5,743,708, the disclosure of which is incorporated herein by reference. Additionally, as illustrated in that patent, portions of the vane may also be cooled by flowing cooling air to the vane, for example, adjacent the trailing edge of the vane. Consequently, a combined steam/air cooling system is provided for the vanes of the nozzle stage.

The nozzle segment hereof is particularly useful as part of the first stage of an advanced steam/air-cooled gas turbine. In such turbine, forty-two equally spaced nozzles or vanes 12 are arranged about the centerline of the gas turbine, which form with the outer and inner walls 14 and 16, respectively, a well-defined hot gas path annulus. Further, it can be seen from FIGS. 1, 2 and 5 that the airfoil shape is of a three-dimensional design. That is, there is a three-dimensional bow in the body of the airfoil between its leading and trailing edges 18 and 20, respectively, as well as along the trailing edge 20. It is this bow that improves total pressure and momentum into the stage 1 buckets to increase the efficiency of the turbine section of the engine.

Figure 4:
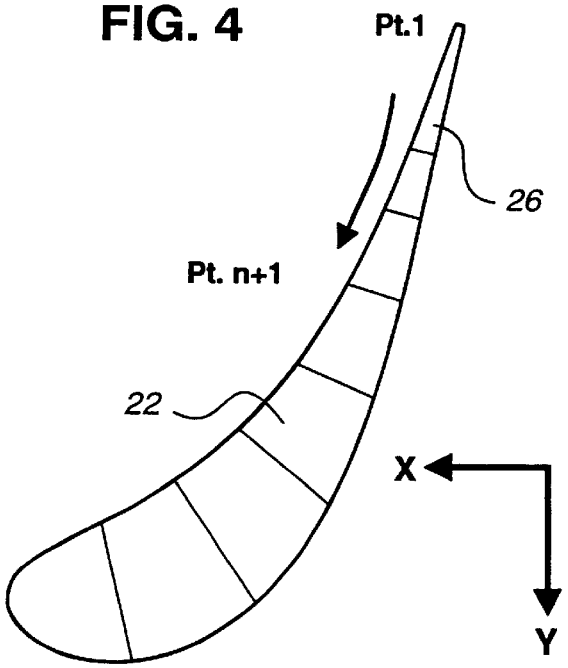
FIG. 4 is a schematic illustration of the airfoil at a particular radius illustrating also the Cartesian coordinate system for defining the airfoil.
Figure 5:
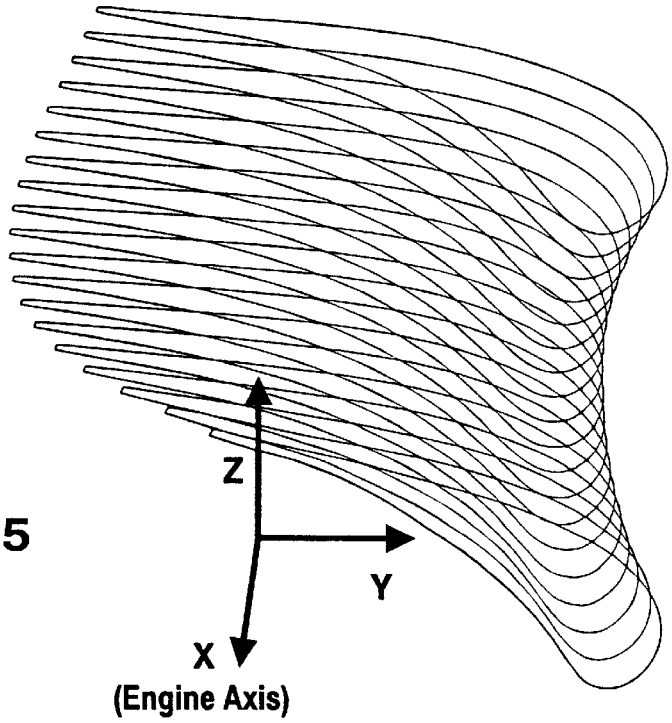
FIG. 5 is a schematic front leading edge perspective view of the airfoil sections at a radial height from the horizontal engine centerline as identified in the below specification.

Referring to FIGS. 4 and 5, there is shown a Cartesian coordinate system for X, Y and Z values set forth in Tables I and II, which follow. The Cartesian coordinate system has orthogonally-related X, Y and Z axes. The Z value is not a true radial height. Rather, the dimension is a height from a plane through the horizontal engine centerline. The Y axis lies parallel to the machine centerline, i.e., the rotary axis. By defining X and Y coordinate values at selected locations in a Z direction, the profile of the airfoil 12 can be ascertained. By connecting the X and Y values with smooth continuing arcs, each profile section at each radial distance Z is fixed. The surface profiles at various surface locations between the radial distance Z are ascertained by connecting adjacent profiles. See, for example, the profiles of FIG. 5, which define the airfoil at various heights in the Z direction. These tabular values are given in inches, represent actual airfoil profiles at ambient, non-operating or non-hot conditions and are for an uncoated airfoil. Additionally, the sign convention assigns a positive value to the value Z and positive and negative values for the coordinates X and Y, as typically used in Cartesian coordinate systems. It will be appreciated that during engine operation, the nozzle heats up and the mechanical and thermal loading cause predicted thermal growth and deformation of the X, Y and Z values as defined. Consequently, the nozzle changes shape slightly during operation. However, the cold or ambient temperature profile is set forth in Table I because it is the nozzle casting or fabrication that is required to obtain the desired hot gas path profiles. Further, it will be appreciated that forty-two equally spaced nozzles are arranged in a circumferential array thereof about the engine centerline. Consequently, the coordinate values of X, Y and Z for the airfoils and the inner and outer bands define the hot gas path annulus through the nozzle stage.

It will also be appreciated that the coordinate values listed in Table I below are ideal values at ambient temperature. The actual surface profile, even in the ambient temperature state, may be different from the ideal values as a result of manufacturing and applied coating tolerances. Typical manufacturing tolerances involved in the fabrication of the nozzle include, for example, a casting profile of about ±0.060 inches in given areas of the airfoil. Additionally, the thermal barrier coating (ceramic coating) on the blade has a current manufacturing tolerance of up to ±0.015 inches. There is also variation due to welding deformation, machining tolerances and nozzle throat placement (twist). Thus, using the maximum predicted deviation that may occur from the nominal ambient temperature coordinate values given below, the claimed profile tolerance for the nozzle gas path surface is +0.165 to −0.135 inches.

TABLE I

Stage 1 Nozzle Airfoil Points (Cold)

| | Y (transv) | X (axial) | Z (ht) |
|---|---|---|---|
| Section 1 | | | |
| Point 1 | 0.929 | 0.153 | 42.845 |
| 2 | 1.235 | 0.368 | 42.845 |
| 3 | 1.551 | 0.571 | 42.845 |
| 4 | 1.876 | 0.762 | 42.845 |
| 5 | 2.199 | 0.955 | 42.845 |
| 6 | 2.507 | 1.167 | 42.845 |
| 7 | 2.805 | 1.393 | 42.845 |
| 8 | 3.086 | 1.643 | 42.845 |
| 9 | 3.444 | 2.023 | 42.845 |
| 10 | 3.784 | 2.423 | 42.845 |
| 11 | 4.108 | 2.835 | 42.845 |
| 12 | 4.420 | 3.256 | 42.845 |
| 13 | 4.758 | 3.747 | 42.845 |
| 14 | 5.072 | 4.253 | 42.845 |
| 15 | 5.350 | 4.774 | 42.845 |
| 16 | 5.588 | 5.313 | 42.845 |
| 17 | 5.785 | 5.871 | 42.845 |

TABLE I-continued

Stage 1 Nozzle Airfoil Points (Cold)

| | Y (transv) | X (axial) | Z (ht) |
|---|---|---|---|
| 18 | 5.949 | 6.443 | 42.845 |
| 19 | 6.003 | 6.634 | 42.845 |
| 20 | 6.063 | 6.824 | 42.845 |
| 21 | 6.139 | 7.008 | 42.845 |
| 22 | 6.189 | 7.095 | 42.845 |
| 23 | 6.250 | 7.174 | 42.845 |
| 24 | 6.326 | 7.239 | 42.845 |
| 25 | 6.417 | 7.283 | 42.845 |
| 26 | 6.515 | 7.303 | 42.845 |
| 27 | 6.616 | 7.304 | 42.845 |
| 28 | 6.711 | 7.282 | 42.845 |
| 29 | 6.799 | 7.240 | 42.845 |
| 30 | 6.881 | 7.188 | 42.845 |
| 31 | 6.958 | 7.128 | 42.845 |
| 32 | 7.068 | 7.022 | 42.845 |
| 33 | 7.167 | 6.906 | 42.845 |
| 34 | 7.297 | 6.715 | 42.845 |
| 35 | 7.403 | 6.509 | 42.845 |
| 36 | 7.485 | 6.293 | 42.845 |
| 37 | 7.551 | 6.023 | 42.845 |
| 38 | 7.584 | 5.747 | 42.845 |
| 39 | 7.583 | 5.469 | 42.845 |
| 40 | 7.550 | 5.192 | 42.845 |
| 41 | 7.488 | 4.921 | 42.845 |
| 42 | 7.380 | 4.612 | 42.845 |
| 43 | 7.240 | 4.316 | 42.845 |
| 44 | 7.072 | 4.035 | 42.845 |
| 45 | 6.881 | 3.770 | 42.845 |
| 46 | 6.671 | 3.520 | 42.845 |
| 47 | 6.445 | 3.284 | 42.845 |
| 48 | 6.206 | 3.062 | 42.845 |
| 49 | 5.957 | 2.851 | 42.845 |
| 50 | 5.549 | 2.541 | 42.845 |
| 51 | 5.125 | 2.252 | 42.845 |
| 52 | 4.691 | 1.981 | 42.845 |
| 53 | 4.248 | 1.723 | 42.845 |
| 54 | 3.715 | 1.426 | 42.845 |
| 55 | 3.178 | 1.137 | 42.845 |
| 56 | 2.639 | 0.853 | 42.845 |
| 57 | 2.098 | 0.572 | 42.845 |
| 58 | 1.556 | 0.291 | 42.845 |
| 59 | 1.012 | 0.016 | 42.845 |
| Section 2 | | | |
| Point 1 | 0.191 | 0.145 | 43.341 |
| 2 | 0.578 | 0.391 | 43.341 |
| 3 | 0.972 | 0.625 | 43.341 |
| 4 | 1.370 | 0.851 | 43.341 |
| 5 | 1.765 | 1.082 | 43.341 |
| 6 | 2.148 | 1.327 | 43.341 |
| 7 | 2.515 | 1.593 | 43.341 |
| 8 | 2.929 | 1.930 | 43.341 |
| 9 | 3.326 | 2.288 | 43.341 |
| 10 | 3.710 | 2.663 | 43.341 |
| 11 | 4.077 | 3.058 | 43.341 |
| 12 | 4.393 | 3.432 | 43.341 |
| 13 | 4.686 | 3.820 | 43.341 |
| 14 | 4.952 | 4.224 | 43.341 |
| 15 | 5.189 | 4.646 | 43.341 |
| 16 | 5.394 | 5.087 | 43.341 |
| 17 | 5.542 | 5.469 | 43.341 |
| 18 | 5.672 | 5.860 | 43.341 |
| 19 | 5.792 | 6.254 | 43.341 |
| 20 | 5.854 | 6.451 | 43.341 |
| 21 | 5.922 | 6.646 | 43.341 |
| 22 | 6.005 | 6.835 | 43.341 |
| 23 | 6.058 | 6.925 | 43.341 |
| 24 | 6.120 | 7.010 | 43.341 |
| 25 | 6.196 | 7.083 | 43.341 |
| 26 | 6.284 | 7.139 | 43.341 |
| 27 | 6.383 | 7.172 | 43.341 |
| 28 | 6.488 | 7.179 | 43.341 |
| 29 | 6.587 | 7.159 | 43.341 |
| 30 | 6.680 | 7.116 | 43.341 |
| 31 | 6.765 | 7.061 | 43.341 |

TABLE I-continued

Stage 1 Nozzle Airfoil Points (Cold)

| | Y (transv) | X (axial) | Z (ht) |
|---|---|---|---|
| 32 | 6.844 | 6.998 | 43.341 |
| 33 | 6.957 | 6.885 | 43.341 |
| 34 | 7.056 | 6.761 | 43.341 |
| 35 | 7.184 | 6.556 | 43.341 |
| 36 | 7.284 | 6.336 | 43.341 |
| 37 | 7.358 | 6.106 | 43.341 |
| 38 | 7.413 | 5.821 | 43.341 |
| 39 | 7.431 | 5.532 | 43.341 |
| 40 | 7.414 | 5.242 | 43.341 |
| 41 | 7.365 | 4.956 | 43.341 |
| 42 | 7.286 | 4.677 | 43.341 |
| 43 | 7.159 | 4.360 | 43.341 |
| 44 | 6.999 | 4.058 | 43.341 |
| 45 | 6.811 | 3.773 | 43.341 |
| 46 | 6.599 | 3.506 | 43.341 |
| 47 | 6.367 | 3.257 | 43.341 |
| 48 | 6.119 | 3.024 | 43.341 |
| 49 | 5.857 | 2.807 | 43.341 |
| 50 | 5.583 | 2.604 | 43.341 |
| 51 | 5.135 | 2.309 | 43.341 |
| 52 | 4.673 | 2.040 | 43.341 |
| 53 | 4.210 | 1.795 | 43.341 |
| 54 | 3.743 | 1.565 | 43.341 |
| 55 | 2.884 | 1.165 | 43.341 |
| 56 | 2.010 | 0.773 | 43.341 |
| 57 | 1.137 | 0.391 | 43.341 |
| 58 | 0.258 | 0.018 | 43.341 |
| Section 3 | | | |
| Point 1 | −0.544 | 0.140 | 43.836 |
| 2 | −0.048 | 0.419 | 43.836 |
| 3 | 0.453 | 0.688 | 43.836 |
| 4 | 0.960 | 0.947 | 43.836 |
| 5 | 1.462 | 1.215 | 43.836 |
| 6 | 1.950 | 1.508 | 43.836 |
| 7 | 2.416 | 1.817 | 43.836 |
| 8 | 2.866 | 2.147 | 43.836 |
| 9 | 3.296 | 2.498 | 43.836 |
| 10 | 3.703 | 2.871 | 43.836 |
| 11 | 4.051 | 3.234 | 43.836 |
| 12 | 4.376 | 3.620 | 43.836 |
| 13 | 4.676 | 4.033 | 43.836 |
| 14 | 4.943 | 4.470 | 43.836 |
| 15 | 5.172 | 4.926 | 43.836 |
| 16 | 5.337 | 5.319 | 43.836 |
| 17 | 5.481 | 5.722 | 43.836 |
| 18 | 5.610 | 6.130 | 43.836 |
| 19 | 5.676 | 6.333 | 43.836 |
| 20 | 5.748 | 6.535 | 43.836 |
| 21 | 5.835 | 6.730 | 43.836 |
| 22 | 5.890 | 6.822 | 43.836 |
| 23 | 5.957 | 6.906 | 43.836 |
| 24 | 6.038 | 6.977 | 43.836 |
| 25 | 6.132 | 7.029 | 43.836 |
| 26 | 6.235 | 7.058 | 43.836 |
| 27 | 6.342 | 7.067 | 43.836 |
| 28 | 6.445 | 7.044 | 43.836 |
| 29 | 6.539 | 6.996 | 43.836 |
| 30 | 6.625 | 6.936 | 43.836 |
| 31 | 6.704 | 6.868 | 43.836 |
| 32 | 6.816 | 6.747 | 43.836 |
| 33 | 6.915 | 6.615 | 43.836 |
| 34 | 7.039 | 6.399 | 43.836 |
| 35 | 7.133 | 6.168 | 43.836 |
| 36 | 7.198 | 5.927 | 43.836 |
| 37 | 7.238 | 5.630 | 43.836 |
| 38 | 7.238 | 5.330 | 43.836 |
| 39 | 7.201 | 5.033 | 43.836 |
| 40 | 7.131 | 4.741 | 43.836 |
| 41 | 7.031 | 4.459 | 43.836 |
| 42 | 6.880 | 4.140 | 43.836 |
| 43 | 6.698 | 3.837 | 43.836 |
| 44 | 6.490 | 3.553 | 43.836 |
| 45 | 6.259 | 3.287 | 43.836 |
| 46 | 6.010 | 3.038 | 43.836 |

TABLE I-continued

Stage 1 Nozzle Airfoil Points (Cold)

| | Y (transv) | X (axial) | Z (ht) |
|---|---|---|---|
| 47 | 5.746 | 2.806 | 43.836 |
| 48 | 5.467 | 2.591 | 43.836 |
| 49 | 5.178 | 2.391 | 43.836 |
| 50 | 4.705 | 2.106 | 43.836 |
| 51 | 4.215 | 1.850 | 43.836 |
| 52 | 3.714 | 1.617 | 43.836 |
| 53 | 3.206 | 1.401 | 43.836 |
| 54 | 2.289 | 1.037 | 43.836 |
| 55 | 1.367 | 0.688 | 43.836 |
| 56 | 0.442 | 0.347 | 43.836 |
| 57 | −0.487 | 0.015 | 43.836 |
| Section 4 | | | |
| Point 1 | −1.158 | 0.139 | 44.332 |
| 2 | −0.627 | 0.397 | 44.332 |
| 3 | −0.089 | 0.641 | 44.332 |
| 4 | 0.453 | 0.877 | 44.332 |
| 5 | 0.987 | 1.131 | 44.332 |
| 6 | 1.507 | 1.412 | 44.332 |
| 7 | 2.002 | 1.711 | 44.332 |
| 8 | 2.478 | 2.033 | 44.332 |
| 9 | 2.934 | 2.381 | 44.332 |
| 10 | 3.369 | 2.757 | 44.332 |
| 11 | 3.744 | 3.124 | 44.332 |
| 12 | 4.096 | 3.519 | 44.332 |
| 13 | 4.417 | 3.935 | 44.332 |
| 14 | 4.704 | 4.370 | 44.332 |
| 15 | 4.954 | 4.824 | 44.332 |
| 16 | 5.137 | 5.216 | 44.332 |
| 17 | 5.298 | 5.619 | 44.332 |
| 18 | 5.444 | 6.031 | 44.332 |
| 19 | 5.517 | 6.237 | 44.332 |
| 20 | 5.595 | 6.440 | 44.332 |
| 21 | 5.691 | 6.636 | 44.332 |
| 22 | 5.750 | 6.727 | 44.332 |
| 23 | 5.821 | 6.809 | 44.332 |
| 24 | 5.906 | 6.878 | 44.332 |
| 25 | 6.003 | 6.927 | 44.332 |
| 26 | 6.108 | 6.956 | 44.332 |
| 27 | 6.216 | 6.965 | 44.332 |
| 28 | 6.322 | 6.941 | 44.332 |
| 29 | 6.418 | 6.892 | 44.332 |
| 30 | 6.506 | 6.829 | 44.332 |
| 31 | 6.587 | 6.757 | 44.332 |
| 32 | 6.702 | 6.632 | 44.332 |
| 33 | 6.801 | 6.494 | 44.332 |
| 34 | 6.924 | 6.267 | 44.332 |
| 35 | 7.015 | 6.025 | 44.332 |
| 36 | 7.074 | 5.774 | 44.332 |
| 37 | 7.105 | 5.466 | 44.332 |
| 38 | 7.094 | 5.156 | 44.332 |
| 39 | 7.044 | 4.849 | 44.332 |
| 40 | 6.961 | 4.550 | 44.332 |
| 41 | 6.846 | 4.262 | 44.332 |
| 42 | 6.677 | 3.939 | 44.332 |
| 43 | 6.477 | 3.635 | 44.332 |
| 44 | 6.250 | 3.351 | 44.332 |
| 45 | 6.000 | 3.086 | 44.332 |
| 46 | 5.732 | 2.841 | 44.332 |
| 47 | 5.448 | 2.614 | 44.332 |
| 48 | 5.151 | 2.404 | 44.332 |
| 49 | 4.844 | 2.211 | 44.332 |
| 50 | 4.343 | 1.936 | 44.332 |
| 51 | 3.827 | 1.693 | 44.332 |
| 52 | 3.300 | 1.474 | 44.332 |
| 53 | 2.766 | 1.273 | 44.332 |
| 54 | 1.803 | 0.939 | 44.332 |
| 55 | 0.835 | 0.622 | 44.332 |
| 56 | −0.137 | 0.315 | 44.332 |
| 57 | −1.111 | 0.019 | 44.332 |
| Section 5 | | | |
| Point 1 | −1.621 | 0.137 | 44.828 |
| 2 | −1.159 | 0.335 | 44.828 |
| 3 | −0.695 | 0.528 | 44.828 |

TABLE I-continued

Stage 1 Nozzle Airfoil Points (Cold)

| | Y (transv) | X (axial) | Z (ht) |
|---|---|---|---|
| 4 | −0.231 | 0.720 | 44.828 |
| 5 | 0.230 | 0.920 | 44.828 |
| 6 | 0.685 | 1.132 | 44.828 |
| 7 | 1.130 | 1.357 | 44.828 |
| 8 | 1.642 | 1.643 | 44.828 |
| 9 | 2.137 | 1.953 | 44.828 |
| 10 | 2.615 | 2.289 | 44.828 |
| 11 | 3.073 | 2.656 | 44.828 |
| 12 | 3.469 | 3.019 | 44.828 |
| 13 | 3.842 | 3.411 | 44.828 |
| 14 | 4.184 | 3.824 | 44.828 |
| 15 | 4.491 | 4.257 | 44.828 |
| 16 | 4.763 | 4.710 | 44.828 |
| 17 | 4.965 | 5.103 | 44.828 |
| 18 | 5.147 | 5.507 | 44.828 |
| 19 | 5.313 | 5.921 | 44.828 |
| 20 | 5.396 | 6.127 | 44.828 |
| 21 | 5.484 | 6.332 | 44.828 |
| 22 | 5.585 | 6.528 | 44.828 |
| 23 | 5.646 | 6.620 | 44.828 |
| 24 | 5.716 | 6.704 | 44.828 |
| 25 | 5.800 | 6.776 | 44.828 |
| 26 | 5.896 | 6.830 | 44.828 |
| 27 | 6.002 | 6.864 | 44.828 |
| 28 | 6.113 | 6.873 | 44.828 |
| 29 | 6.221 | 6.849 | 44.828 |
| 30 | 6.320 | 6.800 | 44.828 |
| 31 | 6.410 | 6.735 | 44.828 |
| 32 | 6.493 | 6.661 | 44.828 |
| 33 | 6.608 | 6.531 | 44.828 |
| 34 | 6.707 | 6.387 | 44.828 |
| 35 | 6.828 | 6.153 | 44.828 |
| 36 | 6.916 | 5.903 | 44.828 |
| 37 | 6.970 | 5.645 | 44.828 |
| 38 | 6.993 | 5.328 | 44.828 |
| 39 | 6.974 | 5.011 | 44.828 |
| 40 | 6.916 | 4.698 | 44.828 |
| 41 | 6.823 | 4.395 | 44.828 |
| 42 | 6.698 | 4.103 | 44.828 |
| 43 | 6.516 | 3.777 | 44.828 |
| 44 | 6.303 | 3.471 | 44.828 |
| 45 | 6.062 | 3.187 | 44.828 |
| 46 | 5.799 | 2.924 | 44.828 |
| 47 | 5.516 | 2.681 | 44.828 |
| 48 | 5.218 | 2.458 | 44.828 |
| 49 | 4.907 | 2.254 | 44.828 |
| 50 | 4.586 | 2.067 | 44.828 |
| 51 | 4.064 | 1.803 | 44.828 |
| 52 | 3.528 | 1.571 | 44.828 |
| 53 | 2.981 | 1.365 | 44.828 |
| 54 | 2.428 | 1.176 | 44.828 |
| 55 | 1.432 | 0.866 | 44.828 |
| 56 | 0.431 | 0.574 | 44.828 |
| 57 | −0.574 | 0.292 | 44.828 |
| 58 | −1.581 | 0.020 | 44.828 |
| Section 6 | | | |
| Point 1 | −1.961 | 0.138 | 45.324 |
| 2 | −1.492 | 0.320 | 45.324 |
| 3 | −1.023 | 0.502 | 45.324 |
| 4 | −0.555 | 0.689 | 45.324 |
| 5 | −0.092 | 0.885 | 45.324 |
| 6 | 0.366 | 1.089 | 45.324 |
| 7 | 0.817 | 1.306 | 45.324 |
| 8 | 1.338 | 1.578 | 45.324 |
| 9 | 1.844 | 1.874 | 45.324 |
| 10 | 2.333 | 2.196 | 45.324 |
| 11 | 2.804 | 2.548 | 45.324 |
| 12 | 3.213 | 2.899 | 45.324 |
| 13 | 3.602 | 3.282 | 45.324 |
| 14 | 3.962 | 3.690 | 45.324 |
| 15 | 4.290 | 4.123 | 45.324 |
| 16 | 4.586 | 4.581 | 45.324 |
| 17 | 4.808 | 4.978 | 45.324 |
| 18 | 5.009 | 5.388 | 45.324 |

TABLE I-continued

Stage 1 Nozzle Airfoil Points (Cold)

| | Y (transv) | X (axial) | Z (ht) |
|---|---|---|---|
| 19 | 5.194 | 5.805 | 45.324 |
| 20 | 5.286 | 6.014 | 45.324 |
| 21 | 5.381 | 6.221 | 45.324 |
| 22 | 5.489 | 6.423 | 45.324 |
| 23 | 5.552 | 6.518 | 45.324 |
| 24 | 5.624 | 6.607 | 45.324 |
| 25 | 5.708 | 6.684 | 45.324 |
| 26 | 5.806 | 6.744 | 45.324 |
| 27 | 5.914 | 6.781 | 45.324 |
| 28 | 6.027 | 6.791 | 45.324 |
| 29 | 6.138 | 6.768 | 45.324 |
| 30 | 6.239 | 6.718 | 45.324 |
| 31 | 6.331 | 6.653 | 45.324 |
| 32 | 6.414 | 6.577 | 45.324 |
| 33 | 6.531 | 6.444 | 45.324 |
| 34 | 6.630 | 6.297 | 45.324 |
| 35 | 6.749 | 6.057 | 45.324 |
| 36 | 6.833 | 5.802 | 45.324 |
| 37 | 6.884 | 5.538 | 45.324 |
| 38 | 6.902 | 5.216 | 45.324 |
| 39 | 6.878 | 4.894 | 45.324 |
| 40 | 6.814 | 4.577 | 45.324 |
| 41 | 6.714 | 4.270 | 45.324 |
| 42 | 6.582 | 3.975 | 45.324 |
| 43 | 6.413 | 3.680 | 45.324 |
| 44 | 6.218 | 3.403 | 45.324 |
| 45 | 6.000 | 3.143 | 45.324 |
| 46 | 5.762 | 2.901 | 45.324 |
| 47 | 5.507 | 2.677 | 45.324 |
| 48 | 5.152 | 2.410 | 45.324 |
| 49 | 4.779 | 2.170 | 45.324 |
| 50 | 4.391 | 1.954 | 45.324 |
| 51 | 3.855 | 1.699 | 45.324 |
| 52 | 3.304 | 1.477 | 45.324 |
| 53 | 2.743 | 1.280 | 45.324 |
| 54 | 2.176 | 1.101 | 45.324 |
| 55 | 1.497 | 0.904 | 45.324 |
| 56 | 0.815 | 0.718 | 45.324 |
| 57 | 0.132 | 0.538 | 45.324 |
| 58 | −0.553 | 0.362 | 45.324 |
| 59 | −1.239 | 0.188 | 45.324 |
| 60 | −1.926 | 0.022 | 45.324 |
| Section 7 | | | |
| Point 1 | −2.176 | 0.137 | 45.820 |
| 2 | −1.702 | 0.314 | 45.820 |
| 3 | −1.227 | 0.491 | 45.820 |
| 4 | −0.756 | 0.676 | 45.820 |
| 5 | −0.288 | 0.869 | 45.820 |
| 6 | 0.175 | 1.072 | 45.820 |
| 7 | 0.632 | 1.285 | 45.820 |
| 8 | 1.161 | 1.553 | 45.820 |
| 9 | 1.676 | 1.842 | 45.820 |
| 10 | 2.174 | 2.158 | 45.820 |
| 11 | 2.653 | 2.505 | 45.820 |
| 12 | 3.070 | 2.851 | 45.820 |
| 13 | 3.466 | 3.229 | 45.820 |
| 14 | 3.833 | 3.635 | 45.820 |
| 15 | 4.169 | 4.065 | 45.820 |
| 16 | 4.473 | 4.520 | 45.820 |
| 17 | 4.704 | 4.916 | 45.820 |
| 18 | 4.914 | 5.323 | 45.820 |
| 19 | 5.109 | 5.737 | 45.820 |
| 20 | 5.207 | 5.944 | 45.820 |
| 21 | 5.308 | 6.150 | 45.820 |
| 22 | 5.420 | 6.350 | 45.820 |
| 23 | 5.484 | 6.445 | 45.820 |
| 24 | 5.557 | 6.534 | 45.820 |
| 25 | 5.641 | 6.612 | 45.820 |
| 26 | 5.738 | 6.672 | 45.820 |
| 27 | 5.846 | 6.710 | 45.820 |
| 28 | 5.960 | 6.720 | 45.820 |
| 29 | 6.071 | 6.699 | 45.820 |
| 30 | 6.174 | 6.651 | 45.820 |
| 31 | 6.267 | 6.585 | 45.820 |

TABLE I-continued

Stage 1 Nozzle Airfoil Points (Cold)

| | Y (transv) | X (axial) | Z (ht) |
|---|---|---|---|
| 32 | 6.352 | 6.509 | 45.820 |
| 33 | 6.469 | 6.375 | 45.820 |
| 34 | 6.568 | 6.226 | 45.820 |
| 35 | 6.687 | 5.982 | 45.820 |
| 36 | 6.769 | 5.724 | 45.820 |
| 37 | 6.818 | 5.457 | 45.820 |
| 38 | 6.834 | 5.132 | 45.820 |
| 39 | 6.806 | 4.807 | 45.820 |
| 40 | 6.739 | 4.488 | 45.820 |
| 41 | 6.636 | 4.179 | 45.820 |
| 42 | 6.501 | 3.883 | 45.820 |
| 43 | 6.328 | 3.586 | 45.820 |
| 44 | 6.127 | 3.308 | 45.820 |
| 45 | 5.904 | 3.049 | 45.820 |
| 46 | 5.660 | 2.808 | 45.820 |
| 47 | 5.400 | 2.586 | 45.820 |
| 48 | 5.038 | 2.322 | 45.820 |
| 49 | 4.657 | 2.085 | 45.820 |
| 50 | 4.262 | 1.874 | 45.820 |
| 51 | 3.717 | 1.626 | 45.820 |
| 52 | 3.157 | 1.410 | 45.820 |
| 53 | 2.588 | 1.220 | 45.820 |
| 54 | 2.013 | 1.049 | 45.820 |
| 55 | 1.424 | 0.887 | 45.820 |
| 56 | 0.831 | 0.734 | 45.820 |
| 57 | 0.238 | 0.586 | 45.820 |
| 58 | −0.356 | 0.441 | 45.820 |
| 59 | −0.951 | 0.297 | 45.820 |
| 60 | −1.546 | 0.157 | 45.820 |
| 61 | −2.143 | 0.023 | 45.820 |
| Section 8 | | | |
| Point 1 | −2.307 | 0.137 | 46.316 |
| 2 | −1.986 | 0.256 | 46.316 |
| 3 | −1.662 | 0.372 | 46.316 |
| 4 | −1.340 | 0.491 | 46.316 |
| 5 | −1.020 | 0.613 | 46.316 |
| 6 | −0.700 | 0.740 | 46.316 |
| 7 | −0.078 | 1.000 | 46.316 |
| 8 | 0.536 | 1.279 | 46.316 |
| 9 | 1.073 | 1.546 | 46.316 |
| 10 | 1.597 | 1.835 | 46.316 |
| 11 | 2.104 | 2.151 | 46.316 |
| 12 | 2.592 | 2.499 | 46.316 |
| 13 | 3.015 | 2.847 | 46.316 |
| 14 | 3.413 | 3.225 | 46.316 |
| 15 | 3.779 | 3.627 | 46.316 |
| 16 | 4.111 | 4.052 | 46.316 |
| 17 | 4.411 | 4.500 | 46.316 |
| 18 | 4.639 | 4.888 | 46.316 |
| 19 | 4.849 | 5.289 | 46.316 |
| 20 | 5.048 | 5.697 | 46.316 |
| 21 | 5.148 | 5.902 | 46.316 |
| 22 | 5.251 | 6.104 | 46.316 |
| 23 | 5.366 | 6.299 | 46.316 |
| 24 | 5.432 | 6.393 | 46.316 |
| 25 | 5.506 | 6.479 | 46.316 |
| 26 | 5.592 | 6.555 | 46.316 |
| 27 | 5.690 | 6.613 | 46.316 |
| 28 | 5.798 | 6.650 | 46.316 |
| 29 | 5.912 | 6.661 | 46.316 |
| 30 | 6.012 | 6.645 | 46.316 |
| 31 | 6.107 | 6.607 | 46.316 |
| 32 | 6.193 | 6.552 | 46.316 |
| 33 | 6.273 | 6.488 | 46.316 |
| 34 | 6.411 | 6.338 | 46.316 |
| 35 | 6.525 | 6.169 | 46.316 |
| 36 | 6.642 | 5.923 | 46.316 |
| 37 | 6.724 | 5.663 | 46.316 |
| 38 | 6.771 | 5.395 | 46.316 |
| 39 | 6.785 | 5.068 | 46.316 |
| 40 | 6.756 | 4.741 | 46.316 |
| 41 | 6.687 | 4.421 | 46.316 |
| 42 | 6.583 | 4.111 | 46.316 |
| 43 | 6.446 | 3.814 | 46.316 |

TABLE I-continued

Stage 1 Nozzle Airfoil Points (Cold)

| | Y (transv) | X (axial) | Z (ht) |
|---|---|---|---|
| 44 | 6.271 | 3.517 | 46.316 |
| 45 | 6.068 | 3.239 | 46.316 |
| 46 | 5.841 | 2.980 | 46.316 |
| 47 | 5.595 | 2.740 | 46.316 |
| 48 | 5.331 | 2.519 | 46.316 |
| 49 | 4.964 | 2.258 | 46.316 |
| 50 | 4.579 | 2.024 | 46.316 |
| 51 | 4.180 | 1.816 | 46.316 |
| 52 | 3.629 | 1.573 | 46.316 |
| 53 | 3.065 | 1.362 | 46.316 |
| 54 | 2.491 | 1.178 | 46.316 |
| 55 | 1.911 | 1.011 | 46.316 |
| 56 | 1.317 | 0.855 | 46.316 |
| 57 | 0.720 | 0.708 | 46.316 |
| 58 | 0.123 | 0.566 | 46.316 |
| 59 | −0.476 | 0.426 | 46.316 |
| 60 | −1.075 | 0.287 | 46.316 |
| 61 | −1.674 | 0.152 | 46.316 |
| 62 | −2.275 | 0.024 | 46.316 |
| Section 9 | | | |
| Point 1 | −2.361 | 0.136 | 46.811 |
| 2 | −1.885 | 0.310 | 46.811 |
| 3 | −1.408 | 0.483 | 46.811 |
| 4 | −0.935 | 0.664 | 46.811 |
| 5 | −0.464 | 0.852 | 46.811 |
| 6 | 0.003 | 1.050 | 46.811 |
| 7 | 0.465 | 1.259 | 46.811 |
| 8 | 0.999 | 1.521 | 46.811 |
| 9 | 1.520 | 1.804 | 46.811 |
| 10 | 2.023 | 2.112 | 46.811 |
| 11 | 2.507 | 2.450 | 46.811 |
| 12 | 2.926 | 2.787 | 46.811 |
| 13 | 3.325 | 3.157 | 46.811 |
| 14 | 3.698 | 3.559 | 46.811 |
| 15 | 4.039 | 3.988 | 46.811 |
| 16 | 4.346 | 4.442 | 46.811 |
| 17 | 4.579 | 4.836 | 46.811 |
| 18 | 4.794 | 5.241 | 46.811 |
| 19 | 4.997 | 5.652 | 46.811 |
| 20 | 5.099 | 5.858 | 46.811 |
| 21 | 5.206 | 6.060 | 46.811 |
| 22 | 5.326 | 6.257 | 46.811 |
| 23 | 5.408 | 6.367 | 46.811 |
| 24 | 5.503 | 6.466 | 46.811 |
| 25 | 5.615 | 6.545 | 46.811 |
| 26 | 5.743 | 6.596 | 46.811 |
| 27 | 5.879 | 6.612 | 46.811 |
| 28 | 5.981 | 6.597 | 46.811 |
| 29 | 6.076 | 6.561 | 46.811 |
| 30 | 6.164 | 6.508 | 46.811 |
| 31 | 6.244 | 6.444 | 46.811 |
| 32 | 6.383 | 6.295 | 46.811 |
| 33 | 6.497 | 6.125 | 46.811 |
| 34 | 6.614 | 5.879 | 46.811 |
| 35 | 6.694 | 5.619 | 46.811 |
| 36 | 6.741 | 5.351 | 46.811 |
| 37 | 6.755 | 5.024 | 46.811 |
| 38 | 6.727 | 4.698 | 46.811 |
| 39 | 6.659 | 4.378 | 46.811 |
| 40 | 6.555 | 4.068 | 46.811 |
| 41 | 6.418 | 3.770 | 46.811 |
| 42 | 6.243 | 3.472 | 46.811 |
| 43 | 6.040 | 3.194 | 46.811 |
| 44 | 5.812 | 2.935 | 46.811 |
| 45 | 5.564 | 2.696 | 46.811 |
| 46 | 5.299 | 2.477 | 46.811 |
| 47 | 4.931 | 2.217 | 46.811 |
| 48 | 4.544 | 1.986 | 46.811 |
| 49 | 4.143 | 1.780 | 46.811 |
| 50 | 3.590 | 1.540 | 46.811 |
| 51 | 3.024 | 1.332 | 46.811 |
| 52 | 2.448 | 1.151 | 46.811 |
| 53 | 1.867 | 0.988 | 46.811 |
| 54 | 1.346 | 0.854 | 46.811 |

TABLE I-continued

Stage 1 Nozzle Airfoil Points (Cold)

| | Y (transv) | X (axial) | Z (ht) |
|---|---|---|---|
| 55 | 0.823 | 0.727 | 46.811 |
| 56 | 0.299 | 0.605 | 46.811 |
| 57 | −0.226 | 0.485 | 46.811 |
| 58 | −0.751 | 0.366 | 46.811 |
| 59 | −1.276 | 0.248 | 46.811 |
| 60 | −1.802 | 0.133 | 46.811 |
| 61 | −2.329 | 0.025 | 46.811 |
| Section 10 | | | |
| Point 1 | −2.361 | 0.135 | 47.307 |
| 2 | −2.042 | 0.254 | 47.307 |
| 3 | −1.721 | 0.369 | 47.307 |
| 4 | −1.401 | 0.485 | 47.307 |
| 5 | −1.081 | 0.604 | 47.307 |
| 6 | −0.763 | 0.726 | 47.307 |
| 7 | −0.143 | 0.977 | 47.307 |
| 8 | 0.468 | 1.249 | 47.307 |
| 9 | 1.002 | 1.510 | 47.307 |
| 10 | 1.521 | 1.794 | 47.307 |
| 11 | 2.023 | 2.104 | 47.307 |
| 12 | 2.505 | 2.444 | 47.307 |
| 13 | 2.924 | 2.782 | 47.307 |
| 14 | 3.322 | 3.153 | 47.307 |
| 15 | 3.693 | 3.555 | 47.307 |
| 16 | 4.031 | 3.983 | 47.307 |
| 17 | 4.332 | 4.433 | 47.307 |
| 18 | 4.560 | 4.824 | 47.307 |
| 19 | 4.771 | 5.227 | 47.307 |
| 20 | 4.973 | 5.635 | 47.307 |
| 21 | 5.076 | 5.838 | 47.307 |
| 22 | 5.184 | 6.039 | 47.307 |
| 23 | 5.305 | 6.232 | 47.307 |
| 24 | 5.389 | 6.340 | 47.307 |
| 25 | 5.486 | 6.435 | 47.307 |
| 26 | 5.599 | 6.510 | 47.307 |
| 27 | 5.727 | 6.558 | 47.307 |
| 28 | 5.863 | 6.574 | 47.307 |
| 29 | 5.996 | 6.553 | 47.307 |
| 30 | 6.119 | 6.494 | 47.307 |
| 31 | 6.228 | 6.413 | 47.307 |
| 32 | 6.368 | 6.265 | 47.307 |
| 33 | 6.483 | 6.097 | 47.307 |
| 34 | 6.599 | 5.851 | 47.307 |
| 35 | 6.679 | 5.591 | 47.307 |
| 36 | 6.724 | 5.322 | 47.307 |
| 37 | 6.738 | 4.996 | 47.307 |
| 38 | 6.710 | 4.670 | 47.307 |
| 39 | 6.643 | 4.349 | 47.307 |
| 40 | 6.540 | 4.039 | 47.307 |
| 41 | 6.405 | 3.742 | 47.307 |
| 42 | 6.231 | 3.446 | 47.307 |
| 43 | 6.029 | 3.169 | 47.307 |
| 44 | 5.803 | 2.912 | 47.307 |
| 45 | 5.557 | 2.674 | 47.307 |
| 46 | 5.293 | 2.456 | 47.307 |
| 47 | 5.015 | 2.256 | 47.307 |
| 48 | 4.726 | 2.073 | 47.307 |
| 49 | 4.428 | 1.905 | 47.307 |
| 50 | 3.944 | 1.671 | 47.307 |
| 51 | 3.447 | 1.467 | 47.307 |
| 52 | 2.940 | 1.288 | 47.307 |
| 53 | 2.426 | 1.129 | 47.307 |
| 54 | 1.546 | 0.892 | 47.307 |
| 55 | 0.660 | 0.679 | 47.307 |
| 56 | −0.230 | 0.477 | 47.307 |
| 57 | −0.492 | 0.419 | 47.307 |
| 58 | −0.754 | 0.361 | 47.307 |
| 59 | −1.016 | 0.304 | 47.307 |
| 60 | −1.279 | 0.246 | 47.307 |
| 61 | −1.541 | 0.188 | 47.307 |
| 62 | −1.803 | 0.130 | 47.307 |
| 63 | −2.066 | 0.074 | 47.307 |
| 64 | −2.330 | 0.025 | 47.307 |

TABLE I-continued

Stage 1 Nozzle Airfoil Points (Cold)

| | Y (transv) | X (axial) | Z (ht) |
|---|---|---|---|
| Section 11 | | | |
| Point 1 | −2.309 | 0.134 | 47.803 |
| 2 | −1.993 | 0.254 | 47.803 |
| 3 | −1.675 | 0.368 | 47.803 |
| 4 | −1.357 | 0.483 | 47.803 |
| 5 | −1.039 | 0.601 | 47.803 |
| 6 | −0.723 | 0.721 | 47.803 |
| 7 | −0.106 | 0.968 | 47.803 |
| 8 | 0.501 | 1.235 | 47.803 |
| 9 | 1.030 | 1.495 | 47.803 |
| 10 | 1.543 | 1.778 | 47.803 |
| 11 | 2.039 | 2.089 | 47.803 |
| 12 | 2.515 | 2.430 | 47.803 |
| 13 | 2.928 | 2.770 | 47.803 |
| 14 | 3.320 | 3.142 | 47.803 |
| 15 | 3.686 | 3.544 | 47.803 |
| 16 | 4.018 | 3.969 | 47.803 |
| 17 | 4.318 | 4.416 | 47.803 |
| 18 | 4.545 | 4.804 | 47.803 |
| 19 | 4.756 | 5.204 | 47.803 |
| 20 | 4.958 | 5.609 | 47.803 |
| 21 | 5.061 | 5.811 | 47.803 |
| 22 | 5.169 | 6.010 | 47.803 |
| 23 | 5.290 | 6.202 | 47.803 |
| 24 | 5.375 | 6.309 | 47.803 |
| 25 | 5.473 | 6.405 | 47.803 |
| 26 | 5.587 | 6.482 | 47.803 |
| 27 | 5.715 | 6.530 | 47.803 |
| 28 | 5.851 | 6.547 | 47.803 |
| 29 | 5.985 | 6.526 | 47.803 |
| 30 | 6.107 | 6.469 | 47.803 |
| 31 | 6.216 | 6.388 | 47.803 |
| 32 | 6.356 | 6.241 | 47.803 |
| 33 | 6.470 | 6.073 | 47.803 |
| 34 | 6.587 | 5.829 | 47.803 |
| 35 | 6.668 | 5.571 | 47.803 |
| 36 | 6.716 | 5.304 | 47.803 |
| 37 | 6.734 | 4.979 | 47.803 |
| 38 | 6.709 | 4.654 | 47.803 |
| 39 | 6.646 | 4.335 | 47.803 |
| 40 | 6.546 | 4.025 | 47.803 |
| 41 | 6.413 | 3.728 | 47.803 |
| 42 | 6.242 | 3.432 | 47.803 |
| 43 | 6.043 | 3.156 | 47.803 |
| 44 | 5.818 | 2.899 | 47.803 |
| 45 | 5.574 | 2.661 | 47.803 |
| 46 | 5.311 | 2.444 | 47.803 |
| 47 | 5.035 | 2.244 | 47.803 |
| 48 | 4.747 | 2.062 | 47.803 |
| 49 | 4.450 | 1.895 | 47.803 |
| 50 | 3.969 | 1.662 | 47.803 |
| 51 | 3.474 | 1.459 | 47.803 |
| 52 | 2.969 | 1.281 | 47.803 |
| 53 | 2.457 | 1.123 | 47.803 |
| 54 | 1.581 | 0.886 | 47.803 |
| 55 | 0.698 | 0.675 | 47.803 |
| 56 | −0.187 | 0.475 | 47.803 |
| 57 | −1.357 | 0.218 | 47.803 |
| 58 | −1.541 | 0.177 | 47.803 |
| 59 | −1.725 | 0.137 | 47.803 |
| 60 | −1.909 | 0.097 | 47.803 |
| 61 | −2.093 | 0.056 | 47.803 |
| 62 | −2.278 | 0.026 | 47.803 |
| Section 12 | | | |
| Point 1 | −2.218 | 0.133 | 48.299 |
| 2 | −1.903 | 0.255 | 48.299 |
| 3 | −1.586 | 0.369 | 48.299 |
| 4 | −1.269 | 0.484 | 48.299 |
| 5 | −0.952 | 0.601 | 48.299 |
| 6 | −0.637 | 0.721 | 48.299 |
| 7 | −0.021 | 0.966 | 48.299 |
| 8 | 0.584 | 1.232 | 48.299 |
| 9 | 1.111 | 1.493 | 48.299 |

TABLE I-continued

Stage 1 Nozzle Airfoil Points (Cold)

| | Y (transv) | X (axial) | Z (ht) |
|---|---|---|---|
| 10 | 1.622 | 1.780 | 48.299 |
| 11 | 2.115 | 2.098 | 48.299 |
| 12 | 2.589 | 2.449 | 48.299 |
| 13 | 2.999 | 2.799 | 48.299 |
| 14 | 3.382 | 3.173 | 48.299 |
| 15 | 3.734 | 3.570 | 48.299 |
| 16 | 4.056 | 3.990 | 48.299 |
| 17 | 4.347 | 4.432 | 48.299 |
| 18 | 4.570 | 4.816 | 48.299 |
| 19 | 4.777 | 5.210 | 48.299 |
| 20 | 4.977 | 5.611 | 48.299 |
| 21 | 5.079 | 5.810 | 48.299 |
| 22 | 5.187 | 6.006 | 48.299 |
| 23 | 5.308 | 6.194 | 48.299 |
| 24 | 5.391 | 6.299 | 48.299 |
| 25 | 5.487 | 6.392 | 48.299 |
| 26 | 5.598 | 6.467 | 48.299 |
| 27 | 5.723 | 6.515 | 48.299 |
| 28 | 5.855 | 6.532 | 48.299 |
| 29 | 5.988 | 6.511 | 48.299 |
| 30 | 6.110 | 6.455 | 48.299 |
| 31 | 6.220 | 6.376 | 48.299 |
| 32 | 6.360 | 6.231 | 48.299 |
| 33 | 6.476 | 6.065 | 48.299 |
| 34 | 6.596 | 5.824 | 48.299 |
| 35 | 6.680 | 5.568 | 48.299 |
| 36 | 6.732 | 5.303 | 48.299 |
| 37 | 6.754 | 4.980 | 48.299 |
| 38 | 6.735 | 4.656 | 48.299 |
| 39 | 6.676 | 4.337 | 48.299 |
| 40 | 6.581 | 4.028 | 48.299 |
| 41 | 6.452 | 3.730 | 48.299 |
| 42 | 6.285 | 3.435 | 48.299 |
| 43 | 6.088 | 3.158 | 48.299 |
| 44 | 5.866 | 2.901 | 48.299 |
| 45 | 5.624 | 2.663 | 48.299 |
| 46 | 5.364 | 2.445 | 48.299 |
| 47 | 5.090 | 2.246 | 48.299 |
| 48 | 4.804 | 2.063 | 48.299 |
| 49 | 4.508 | 1.897 | 48.299 |
| 50 | 4.029 | 1.664 | 48.299 |
| 51 | 3.536 | 1.462 | 48.299 |
| 52 | 3.034 | 1.284 | 48.299 |
| 53 | 2.525 | 1.126 | 48.299 |
| 54 | 1.653 | 0.889 | 48.299 |
| 55 | 0.775 | 0.678 | 48.299 |
| 56 | −0.106 | 0.477 | 48.299 |
| 57 | −1.270 | 0.219 | 48.299 |
| 58 | −1.453 | 0.178 | 48.299 |
| 59 | −1.636 | 0.137 | 48.299 |
| 60 | −1.819 | 0.097 | 48.299 |
| 61 | −2.002 | 0.056 | 48.299 |
| 62 | −2.187 | 0.026 | 48.299 |
| Section 13 | | | |
| Point 1 | −2.096 | 0.132 | 48.795 |
| 2 | −1.838 | 0.235 | 48.795 |
| 3 | −1.577 | 0.331 | 48.795 |
| 4 | −1.316 | 0.426 | 48.795 |
| 5 | −1.055 | 0.523 | 48.795 |
| 6 | −0.795 | 0.621 | 48.795 |
| 7 | −0.536 | 0.721 | 48.795 |
| 8 | 0.072 | 0.966 | 48.795 |
| 9 | 0.670 | 1.231 | 48.795 |
| 10 | 1.190 | 1.490 | 48.795 |
| 11 | 1.695 | 1.776 | 48.795 |
| 12 | 2.183 | 2.091 | 48.795 |
| 13 | 2.651 | 2.441 | 48.795 |
| 14 | 3.056 | 2.789 | 48.795 |
| 15 | 3.432 | 3.162 | 48.795 |
| 16 | 3.779 | 3.558 | 48.795 |
| 17 | 4.097 | 3.979 | 48.795 |
| 18 | 4.386 | 4.423 | 48.795 |
| 19 | 4.608 | 4.808 | 48.795 |
| 20 | 4.814 | 5.202 | 48.795 |

TABLE I-continued

Stage 1 Nozzle Airfoil Points (Cold)

| | Y (transv) | X (axial) | Z (ht) |
|---|---|---|---|
| 21 | 5.012 | 5.602 | 48.795 |
| 22 | 5.113 | 5.800 | 48.795 |
| 23 | 5.219 | 5.996 | 48.795 |
| 24 | 5.339 | 6.183 | 48.795 |
| 25 | 5.421 | 6.289 | 48.795 |
| 26 | 5.515 | 6.384 | 48.795 |
| 27 | 5.624 | 6.460 | 48.795 |
| 28 | 5.748 | 6.510 | 48.795 |
| 29 | 5.880 | 6.527 | 48.795 |
| 30 | 6.012 | 6.506 | 48.795 |
| 31 | 6.134 | 6.450 | 48.795 |
| 32 | 6.244 | 6.373 | 48.795 |
| 33 | 6.341 | 6.280 | 48.795 |
| 34 | 6.427 | 6.177 | 48.795 |
| 35 | 6.503 | 6.066 | 48.795 |
| 36 | 6.627 | 5.828 | 48.795 |
| 37 | 6.717 | 5.575 | 48.795 |
| 38 | 6.776 | 5.313 | 48.795 |
| 39 | 6.806 | 4.991 | 48.795 |
| 40 | 6.795 | 4.668 | 48.795 |
| 41 | 6.744 | 4.349 | 48.795 |
| 42 | 6.655 | 4.039 | 48.795 |
| 43 | 6.532 | 3.740 | 48.795 |
| 44 | 6.369 | 3.443 | 48.795 |
| 45 | 6.176 | 3.166 | 48.795 |
| 46 | 5.956 | 2.908 | 48.795 |
| 47 | 5.716 | 2.670 | 48.795 |
| 48 | 5.457 | 2.452 | 48.795 |
| 49 | 5.184 | 2.253 | 48.795 |
| 50 | 4.899 | 2.071 | 48.795 |
| 51 | 4.604 | 1.906 | 48.795 |
| 52 | 4.126 | 1.674 | 48.795 |
| 53 | 3.635 | 1.473 | 48.795 |
| 54 | 3.134 | 1.296 | 48.795 |
| 55 | 2.627 | 1.138 | 48.795 |
| 56 | 1.758 | 0.900 | 48.795 |
| 57 | 0.884 | 0.686 | 48.795 |
| 58 | 0.007 | 0.483 | 48.795 |
| 59 | −1.153 | 0.221 | 48.795 |
| 60 | −1.335 | 0.179 | 48.795 |
| 61 | −1.517 | 0.138 | 48.795 |
| 62 | −1.699 | 0.097 | 48.795 |
| 63 | −1.881 | 0.056 | 48.795 |
| 64 | −2.065 | 0.026 | 48.795 |
| Section 14 | | | |
| Point 1 | −1.937 | 0.131 | 49.291 |
| 2 | −1.681 | 0.236 | 49.291 |
| 3 | −1.423 | 0.332 | 49.291 |
| 4 | −1.164 | 0.428 | 49.291 |
| 5 | −0.906 | 0.526 | 49.291 |
| 6 | −0.649 | 0.626 | 49.291 |
| 7 | −0.392 | 0.727 | 49.291 |
| 8 | 0.209 | 0.976 | 49.291 |
| 9 | 0.799 | 1.244 | 49.291 |
| 10 | 1.314 | 1.505 | 49.291 |
| 11 | 1.814 | 1.790 | 49.291 |
| 12 | 2.298 | 2.105 | 49.291 |
| 13 | 2.762 | 2.452 | 49.291 |
| 14 | 3.163 | 2.799 | 49.291 |
| 15 | 3.536 | 3.170 | 49.291 |
| 16 | 3.879 | 3.565 | 49.291 |
| 17 | 4.192 | 3.984 | 49.291 |
| 18 | 4.476 | 4.426 | 49.291 |
| 19 | 4.691 | 4.811 | 49.291 |
| 20 | 4.891 | 5.206 | 49.291 |
| 21 | 5.082 | 5.605 | 49.291 |
| 22 | 5.180 | 5.804 | 49.291 |
| 23 | 5.283 | 5.999 | 49.291 |
| 24 | 5.399 | 6.187 | 49.291 |
| 25 | 5.480 | 6.293 | 49.291 |
| 26 | 5.572 | 6.389 | 49.291 |
| 27 | 5.679 | 6.466 | 49.291 |
| 28 | 5.802 | 6.517 | 49.291 |
| 29 | 5.933 | 6.534 | 49.291 |

TABLE I-continued

Stage 1 Nozzle Airfoil Points (Cold)

| | Y (transv) | X (axial) | Z (ht) |
|---|---|---|---|
| 30 | 6.065 | 6.513 | 49.291 |
| 31 | 6.187 | 6.458 | 49.291 |
| 32 | 6.298 | 6.383 | 49.291 |
| 33 | 6.397 | 6.293 | 49.291 |
| 34 | 6.486 | 6.193 | 49.291 |
| 35 | 6.565 | 6.084 | 49.291 |
| 36 | 6.696 | 5.850 | 49.291 |
| 37 | 6.793 | 5.601 | 49.291 |
| 38 | 6.859 | 5.341 | 49.291 |
| 39 | 6.899 | 5.021 | 49.291 |
| 40 | 6.896 | 4.698 | 49.291 |
| 41 | 6.853 | 4.379 | 49.291 |
| 42 | 6.771 | 4.067 | 49.291 |
| 43 | 6.654 | 3.767 | 49.291 |
| 44 | 6.496 | 3.469 | 49.291 |
| 45 | 6.306 | 3.189 | 49.291 |
| 46 | 6.089 | 2.930 | 49.291 |
| 47 | 5.850 | 2.692 | 49.291 |
| 48 | 5.593 | 2.473 | 49.291 |
| 49 | 5.321 | 2.274 | 49.291 |
| 50 | 5.037 | 2.093 | 49.291 |
| 51 | 4.743 | 1.928 | 49.291 |
| 52 | 4.266 | 1.697 | 49.291 |
| 53 | 3.776 | 1.496 | 49.291 |
| 54 | 3.276 | 1.319 | 49.291 |
| 55 | 2.770 | 1.161 | 49.291 |
| 56 | 1.904 | 0.921 | 49.291 |
| 57 | 1.033 | 0.702 | 49.291 |
| 58 | 0.159 | 0.494 | 49.291 |
| 59 | −0.996 | 0.225 | 49.291 |
| 60 | −1.177 | 0.182 | 49.291 |
| 61 | −1.359 | 0.140 | 49.291 |
| 62 | −1.540 | 0.098 | 49.291 |
| 63 | −1.722 | 0.056 | 49.291 |
| 64 | −1.906 | 0.026 | 49.291 |
| Section 15 | | | |
| Point 1 | −1.751 | 0.131 | 49.786 |
| 2 | −1.498 | 0.236 | 49.786 |
| 3 | −1.241 | 0.333 | 49.786 |
| 4 | −0.983 | 0.430 | 49.786 |
| 5 | −0.727 | 0.528 | 49.786 |
| 6 | −0.471 | 0.628 | 49.786 |
| 7 | −0.216 | 0.730 | 49.786 |
| 8 | 0.380 | 0.982 | 49.786 |
| 9 | 0.965 | 1.254 | 49.786 |
| 10 | 1.474 | 1.519 | 49.786 |
| 11 | 1.969 | 1.809 | 49.786 |
| 12 | 2.447 | 2.126 | 49.786 |
| 13 | 2.908 | 2.473 | 49.786 |
| 14 | 3.307 | 2.817 | 49.786 |
| 15 | 3.678 | 3.186 | 49.786 |
| 16 | 4.017 | 3.579 | 49.786 |
| 17 | 4.326 | 3.997 | 49.786 |
| 18 | 4.603 | 4.440 | 49.786 |
| 19 | 4.813 | 4.825 | 49.786 |
| 20 | 5.005 | 5.221 | 49.786 |
| 21 | 5.187 | 5.622 | 49.786 |
| 22 | 5.281 | 5.821 | 49.786 |
| 23 | 5.380 | 6.017 | 49.786 |
| 24 | 5.493 | 6.205 | 49.786 |
| 25 | 5.571 | 6.312 | 49.786 |
| 26 | 5.663 | 6.408 | 49.786 |
| 27 | 5.768 | 6.485 | 49.786 |
| 28 | 5.890 | 6.536 | 49.786 |
| 29 | 6.020 | 6.553 | 49.786 |
| 30 | 6.152 | 6.532 | 49.786 |
| 31 | 6.275 | 6.479 | 49.786 |
| 32 | 6.386 | 6.405 | 49.786 |
| 33 | 6.487 | 6.317 | 49.786 |
| 34 | 6.578 | 6.219 | 49.786 |
| 35 | 6.660 | 6.113 | 49.786 |
| 36 | 6.797 | 5.883 | 49.786 |
| 37 | 6.903 | 5.637 | 49.786 |
| 38 | 6.977 | 5.379 | 49.786 |

TABLE I-continued

Stage 1 Nozzle Airfoil Points (Cold)

| | Y (transv) | X (axial) | Z (ht) |
|---|---|---|---|
| 39 | 7.026 | 5.061 | 49.786 |
| 40 | 7.033 | 4.739 | 49.786 |
| 41 | 6.998 | 4.418 | 49.786 |
| 42 | 6.924 | 4.105 | 49.786 |
| 43 | 6.812 | 3.804 | 49.786 |
| 44 | 6.659 | 3.503 | 49.786 |
| 45 | 6.472 | 3.221 | 49.786 |
| 46 | 6.258 | 2.961 | 49.786 |
| 47 | 6.021 | 2.721 | 49.786 |
| 48 | 5.765 | 2.502 | 49.786 |
| 49 | 5.493 | 2.302 | 49.786 |
| 50 | 5.209 | 2.121 | 49.786 |
| 51 | 4.915 | 1.957 | 49.786 |
| 52 | 4.439 | 1.727 | 49.786 |
| 53 | 3.948 | 1.527 | 49.786 |
| 54 | 3.449 | 1.351 | 49.786 |
| 55 | 2.944 | 1.191 | 49.786 |
| 56 | 2.080 | 0.946 | 49.786 |
| 57 | 1.212 | 0.721 | 49.786 |
| 58 | 0.340 | 0.505 | 49.786 |
| 59 | −0.812 | 0.228 | 49.786 |
| 60 | −0.993 | 0.185 | 49.786 |
| 61 | −1.174 | 0.142 | 49.786 |
| 62 | −1.355 | 0.099 | 49.786 |
| 63 | −1.536 | 0.057 | 49.786 |
| 64 | −1.720 | 0.026 | 49.786 |
| Section 16 | | | |
| Point 1 | −1.553 | 0.129 | 50.282 |
| 2 | −1.301 | 0.236 | 50.282 |
| 3 | −1.046 | 0.334 | 50.282 |
| 4 | −0.791 | 0.432 | 50.282 |
| 5 | −0.536 | 0.530 | 50.282 |
| 6 | −0.281 | 0.629 | 50.282 |
| 7 | −0.027 | 0.730 | 50.282 |
| 8 | 0.567 | 0.978 | 50.282 |
| 9 | 1.151 | 1.245 | 50.282 |
| 10 | 1.658 | 1.507 | 50.282 |
| 11 | 2.148 | 1.797 | 50.282 |
| 12 | 2.620 | 2.119 | 50.282 |
| 13 | 3.071 | 2.475 | 50.282 |
| 14 | 3.460 | 2.827 | 50.282 |
| 15 | 3.824 | 3.201 | 50.282 |
| 16 | 4.162 | 3.596 | 50.282 |
| 17 | 4.473 | 4.014 | 50.282 |
| 18 | 4.755 | 4.455 | 50.282 |
| 19 | 4.964 | 4.841 | 50.282 |
| 20 | 5.150 | 5.239 | 50.282 |
| 21 | 5.322 | 5.643 | 50.282 |
| 22 | 5.410 | 5.844 | 50.282 |
| 23 | 5.504 | 6.042 | 50.282 |
| 24 | 5.612 | 6.232 | 50.282 |
| 25 | 5.688 | 6.340 | 50.282 |
| 26 | 5.777 | 6.437 | 50.282 |
| 27 | 5.883 | 6.516 | 50.282 |
| 28 | 6.005 | 6.566 | 50.282 |
| 29 | 6.136 | 6.583 | 50.282 |
| 30 | 6.268 | 6.563 | 50.282 |
| 31 | 6.391 | 6.511 | 50.282 |
| 32 | 6.504 | 6.438 | 50.282 |
| 33 | 6.607 | 6.353 | 50.282 |
| 34 | 6.700 | 6.257 | 50.282 |
| 35 | 6.785 | 6.153 | 50.282 |
| 36 | 6.929 | 5.928 | 50.282 |
| 37 | 7.041 | 5.684 | 50.282 |
| 38 | 7.121 | 5.428 | 50.282 |
| 39 | 7.177 | 5.111 | 50.282 |
| 40 | 7.191 | 4.789 | 50.282 |
| 41 | 7.163 | 4.468 | 50.282 |
| 42 | 7.096 | 4.153 | 50.282 |
| 43 | 6.992 | 3.848 | 50.282 |
| 44 | 6.861 | 3.576 | 50.282 |
| 45 | 6.700 | 3.320 | 50.282 |
| 46 | 6.515 | 3.081 | 50.282 |
| 47 | 6.308 | 2.860 | 50.282 |

TABLE I-continued

Stage 1 Nozzle Airfoil Points (Cold)

| | Y (transv) | X (axial) | Z (ht) |
|---|---|---|---|
| 48 | 6.085 | 2.656 | 50.282 |
| 49 | 5.773 | 2.413 | 50.282 |
| 50 | 5.444 | 2.195 | 50.282 |
| 51 | 5.101 | 1.998 | 50.282 |
| 52 | 4.627 | 1.763 | 50.282 |
| 53 | 4.139 | 1.557 | 50.282 |
| 54 | 3.643 | 1.373 | 50.282 |
| 55 | 3.139 | 1.208 | 50.282 |
| 56 | 2.278 | 0.957 | 50.282 |
| 57 | 1.409 | 0.729 | 50.282 |
| 58 | 0.538 | 0.513 | 50.282 |
| 59 | −0.614 | 0.234 | 50.282 |
| 60 | −0.794 | 0.190 | 50.282 |
| 61 | −0.975 | 0.146 | 50.282 |
| 62 | −1.156 | 0.102 | 50.282 |
| 63 | −1.337 | 0.058 | 50.282 |
| 64 | −1.520 | 0.025 | 50.282 |
| Section 17 | | | |
| Point 1 | −1.353 | 0.126 | 50.778 |
| 2 | −1.102 | 0.236 | 50.778 |
| 3 | −0.848 | 0.336 | 50.778 |
| 4 | −0.593 | 0.435 | 50.778 |
| 5 | −0.338 | 0.535 | 50.778 |
| 6 | −0.083 | 0.634 | 50.778 |
| 7 | 0.172 | 0.735 | 50.778 |
| 8 | 0.768 | 0.979 | 50.778 |
| 9 | 1.354 | 1.242 | 50.778 |
| 10 | 1.864 | 1.501 | 50.778 |
| 11 | 2.358 | 1.788 | 50.778 |
| 12 | 2.832 | 2.111 | 50.778 |
| 13 | 3.282 | 2.473 | 50.778 |
| 14 | 3.664 | 2.831 | 50.778 |
| 15 | 4.015 | 3.214 | 50.778 |
| 16 | 4.338 | 3.621 | 50.778 |
| 17 | 4.632 | 4.051 | 50.778 |
| 18 | 4.901 | 4.502 | 50.778 |
| 19 | 5.105 | 4.890 | 50.778 |
| 20 | 5.293 | 5.286 | 50.778 |
| 21 | 5.469 | 5.687 | 50.778 |
| 22 | 5.558 | 5.887 | 50.778 |
| 23 | 5.652 | 6.086 | 50.778 |
| 24 | 5.758 | 6.277 | 50.778 |
| 25 | 5.854 | 6.410 | 50.778 |
| 26 | 5.972 | 6.524 | 50.778 |
| 27 | 6.066 | 6.580 | 50.778 |
| 28 | 6.169 | 6.615 | 50.778 |
| 29 | 6.278 | 6.627 | 50.778 |
| 30 | 6.410 | 6.605 | 50.778 |
| 31 | 6.532 | 6.552 | 50.778 |
| 32 | 6.645 | 6.479 | 50.778 |
| 33 | 6.747 | 6.393 | 50.778 |
| 34 | 6.841 | 6.297 | 50.778 |
| 35 | 6.926 | 6.194 | 50.778 |
| 36 | 7.072 | 5.969 | 50.778 |
| 37 | 7.190 | 5.729 | 50.778 |
| 38 | 7.280 | 5.476 | 50.778 |
| 39 | 7.348 | 5.161 | 50.778 |
| 40 | 7.373 | 4.839 | 50.778 |
| 41 | 7.354 | 4.516 | 50.778 |
| 42 | 7.291 | 4.200 | 50.778 |
| 43 | 7.186 | 3.895 | 50.778 |
| 44 | 7.053 | 3.623 | 50.778 |
| 45 | 6.890 | 3.369 | 50.778 |
| 46 | 6.702 | 3.131 | 50.778 |
| 47 | 6.494 | 2.912 | 50.778 |
| 48 | 6.270 | 2.708 | 50.778 |
| 49 | 5.958 | 2.465 | 50.778 |
| 50 | 5.631 | 2.243 | 50.778 |
| 51 | 5.290 | 2.042 | 50.778 |
| 52 | 4.820 | 1.799 | 50.778 |
| 53 | 4.336 | 1.584 | 50.778 |
| 54 | 3.841 | 1.393 | 50.778 |
| 55 | 3.340 | 1.221 | 50.778 |
| 56 | 2.479 | 0.964 | 50.778 |

TABLE I-continued

Stage 1 Nozzle Airfoil Points (Cold)

| | Y (transv) | X (axial) | Z (ht) |
|---|---|---|---|
| 57 | 1.611 | 0.735 | 50.778 |
| 58 | 0.738 | 0.521 | 50.778 |
| 59 | −0.414 | 0.241 | 50.778 |
| 60 | −0.595 | 0.196 | 50.778 |
| 61 | −0.776 | 0.150 | 50.778 |
| 62 | −0.956 | 0.105 | 50.778 |
| 63 | −1.137 | 0.060 | 50.778 |
| 64 | −1.320 | 0.025 | 50.778 |
| Section 18 | | | |
| Point 1 | −1.152 | 0.122 | 51.274 |
| 2 | −0.903 | 0.236 | 51.274 |
| 3 | −0.648 | 0.338 | 51.274 |
| 4 | −0.393 | 0.439 | 51.274 |
| 5 | −0.138 | 0.540 | 51.274 |
| 6 | 0.117 | 0.640 | 51.274 |
| 7 | 0.372 | 0.740 | 51.274 |
| 8 | 0.971 | 0.982 | 51.274 |
| 9 | 1.561 | 1.242 | 51.274 |
| 10 | 1.973 | 1.443 | 51.274 |
| 11 | 2.375 | 1.664 | 51.274 |
| 12 | 2.765 | 1.907 | 51.274 |
| 13 | 3.141 | 2.176 | 51.274 |
| 14 | 3.499 | 2.472 | 51.274 |
| 15 | 3.877 | 2.835 | 51.274 |
| 16 | 4.224 | 3.224 | 51.274 |
| 17 | 4.540 | 3.640 | 51.274 |
| 18 | 4.826 | 4.080 | 51.274 |
| 19 | 5.084 | 4.541 | 51.274 |
| 20 | 5.277 | 4.936 | 51.274 |
| 21 | 5.454 | 5.338 | 51.274 |
| 22 | 5.624 | 5.743 | 51.274 |
| 23 | 5.712 | 5.945 | 51.274 |
| 24 | 5.805 | 6.143 | 51.274 |
| 25 | 5.913 | 6.334 | 51.274 |
| 26 | 6.011 | 6.467 | 51.274 |
| 27 | 6.130 | 6.580 | 51.274 |
| 28 | 6.224 | 6.636 | 51.274 |
| 29 | 6.328 | 6.671 | 51.274 |
| 30 | 6.437 | 6.682 | 51.274 |
| 31 | 6.549 | 6.664 | 51.274 |
| 32 | 6.654 | 6.624 | 51.274 |
| 33 | 6.752 | 6.568 | 51.274 |
| 34 | 6.844 | 6.503 | 51.274 |
| 35 | 6.976 | 6.384 | 51.274 |
| 36 | 7.095 | 6.253 | 51.274 |
| 37 | 7.250 | 6.034 | 51.274 |
| 38 | 7.377 | 5.797 | 51.274 |
| 39 | 7.474 | 5.546 | 51.274 |
| 40 | 7.540 | 5.284 | 51.274 |
| 41 | 7.572 | 5.016 | 51.274 |
| 42 | 7.573 | 4.746 | 51.274 |
| 43 | 7.542 | 4.477 | 51.274 |
| 44 | 7.481 | 4.215 | 51.274 |
| 45 | 7.390 | 3.961 | 51.274 |
| 46 | 7.255 | 3.689 | 51.274 |
| 47 | 7.091 | 3.434 | 51.274 |
| 48 | 6.902 | 3.197 | 51.274 |
| 49 | 6.693 | 2.976 | 51.274 |
| 50 | 6.469 | 2.772 | 51.274 |
| 51 | 6.158 | 2.526 | 51.274 |
| 52 | 5.832 | 2.300 | 51.274 |
| 53 | 5.494 | 2.092 | 51.274 |
| 54 | 5.026 | 1.840 | 51.274 |
| 55 | 4.544 | 1.616 | 51.274 |
| 56 | 4.052 | 1.416 | 51.274 |
| 57 | 3.551 | 1.237 | 51.274 |
| 58 | 2.906 | 1.035 | 51.274 |
| 59 | 2.255 | 0.855 | 51.274 |
| 60 | 1.600 | 0.689 | 51.274 |
| 61 | 0.943 | 0.530 | 51.274 |
| 62 | −0.213 | 0.248 | 51.274 |
| 63 | −0.394 | 0.202 | 51.274 |
| 64 | −0.756 | 0.109 | 51.274 |
| 65 | −1.119 | 0.024 | 51.274 |

TABLE I-continued

| Stage 1 Nozzle Airfoil Points (Cold) | | | |
|---|---|---|---|
| | Y (transv) | X (axial) | Z (ht) |
| Section 19 | | | |
| Point 1 | −0.952 | 0.119 | 51.770 |
| 2 | −0.738 | 0.221 | 51.770 |
| 3 | −0.301 | 0.400 | 51.770 |
| 4 | 0.139 | 0.575 | 51.770 |
| 5 | 0.579 | 0.748 | 51.770 |
| 6 | 1.183 | 0.990 | 51.770 |
| 7 | 1.779 | 1.246 | 51.770 |
| 8 | 2.195 | 1.447 | 51.770 |
| 9 | 2.601 | 1.666 | 51.770 |
| 10 | 2.993 | 1.910 | 51.770 |
| 11 | 3.370 | 2.181 | 51.770 |
| 12 | 3.728 | 2.480 | 51.770 |
| 13 | 4.103 | 2.851 | 51.770 |
| 14 | 4.444 | 3.249 | 51.770 |
| 15 | 4.752 | 3.674 | 51.770 |
| 16 | 5.029 | 4.125 | 51.770 |
| 17 | 5.275 | 4.595 | 51.770 |
| 18 | 5.458 | 4.996 | 51.770 |
| 19 | 5.627 | 5.404 | 51.770 |
| 20 | 5.789 | 5.814 | 51.770 |
| 21 | 5.874 | 6.018 | 51.770 |
| 22 | 5.967 | 6.218 | 51.770 |
| 23 | 6.076 | 6.409 | 51.770 |
| 24 | 6.154 | 6.515 | 51.770 |
| 25 | 6.247 | 6.609 | 51.770 |
| 26 | 6.357 | 6.683 | 51.770 |
| 27 | 6.480 | 6.729 | 51.770 |
| 28 | 6.611 | 6.745 | 51.770 |
| 29 | 6.724 | 6.727 | 51.770 |
| 30 | 6.830 | 6.687 | 51.770 |
| 31 | 6.929 | 6.632 | 51.770 |
| 32 | 7.022 | 6.567 | 51.770 |
| 33 | 7.156 | 6.450 | 51.770 |
| 34 | 7.277 | 6.320 | 51.770 |
| 35 | 7.437 | 6.103 | 51.770 |
| 36 | 7.569 | 5.868 | 51.770 |
| 37 | 7.670 | 5.618 | 51.770 |
| 38 | 7.740 | 5.357 | 51.770 |
| 39 | 7.776 | 5.089 | 51.770 |
| 40 | 7.778 | 4.819 | 51.770 |
| 41 | 7.748 | 4.550 | 51.770 |
| 42 | 7.686 | 4.286 | 51.770 |
| 43 | 7.595 | 4.032 | 51.770 |
| 44 | 7.460 | 3.758 | 51.770 |
| 45 | 7.295 | 3.503 | 51.770 |
| 46 | 7.105 | 3.265 | 51.770 |
| 47 | 6.895 | 3.044 | 51.770 |
| 48 | 6.671 | 2.838 | 51.770 |
| 49 | 6.361 | 2.589 | 51.770 |
| 50 | 6.037 | 2.358 | 51.770 |
| 51 | 5.701 | 2.144 | 51.770 |
| 52 | 5.236 | 1.882 | 51.770 |
| 53 | 4.757 | 1.647 | 51.770 |
| 54 | 4.266 | 1.438 | 51.770 |
| 55 | 3.766 | 1.253 | 51.770 |
| 56 | 3.120 | 1.046 | 51.770 |
| 57 | 2.466 | 0.863 | 51.770 |
| 58 | 1.809 | 0.698 | 51.770 |
| 59 | 1.149 | 0.539 | 51.770 |
| 60 | 0.631 | 0.415 | 51.770 |
| 61 | 0.114 | 0.286 | 51.770 |
| 62 | −0.402 | 0.152 | 51.770 |
| 63 | −0.919 | 0.023 | 51.770 |

Figure 6:
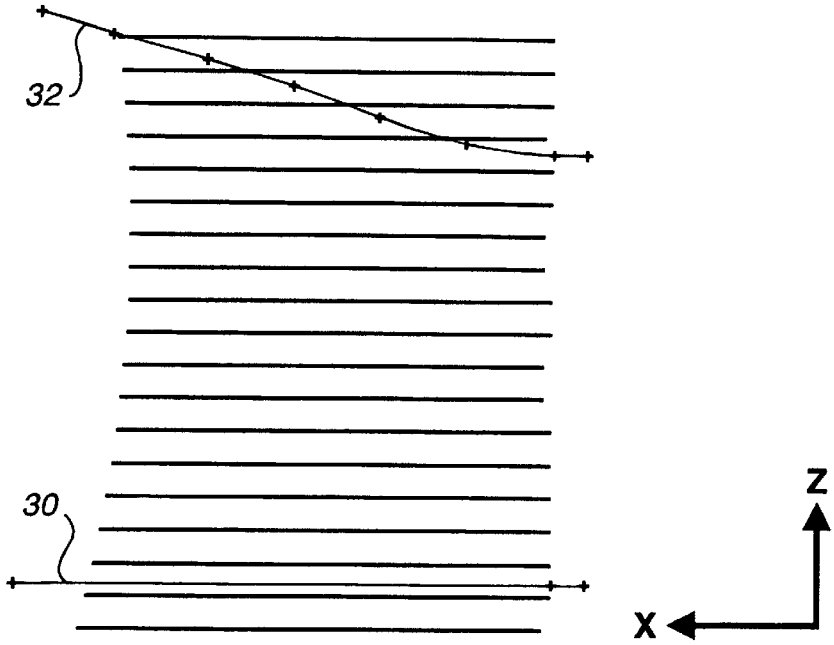
FIG. 6 is a right side view illustrating in graphic form the profile of the inner and outer bands defining the gas path annulus through the nozzle stage.

Similar X, Y, Z, coordinate values are given below in Table II to define the inner diameter and outer diameter wall surfaces 30 and 32, respectively (FIG. 6), that create the inner and outer walls of the annulus which, together with the vanes, define the hot gas path. The coordinate values are given similarly as in Table I with the same tolerances and can be read in conjunction with FIG. 6. As illustrated, FIG. 6 shows the profile of the inner and outer band walls from left to right, i.e., from adjacent the leading edge to adjacent the trailing edge of the vane. Thus, the entire profile of the annulus can be obtained from Tables I and II in conjunction with the arrangement of forty-two equally circumferentially spaced vanes about the machine centerline.

TABLE II

| Radial Gaspath points (Cylindrical sweep) | | | |
|---|---|---|---|
| Annulus | | X (axial) | Z (ht) |
| OD 1 | 0.000 | +7.910 | 52.123 |
| OD 2 | 0.000 | +6.717 | 51.802 |
| OD 3 | 0.000 | +5.373 | 51.439 |
| OD 4 | 0.000 | +4.030 | 51.054 |
| OD 5 | 0.000 | +2.687 | 50.590 |
| OD 6 | 0.000 | +1.343 | 50.199 |
| OD 7 | 0.000 | 0.000 | 50.035 |
| OD 8 | 0.000 | −0.500 | 50.035 |
| ID 1 | 0.000 | +8.277 | 43.533 |
| ID 2 | 0.000 | 0.000 | 43.533 |
| ID 3 | 0.000 | −0.500 | 43.533 |

Additional features of the nozzle include the formation of the nozzle from a high-strength nickel-based superalloy, multiple internal ribs to withstand pressure loadings and a thermal barrier coating to release thermal load on the metal. Additionally, the leading edge radius is optimized to reduce thermodynamic loading. The trailing edge region near the inner side wall, i.e., the inner diameter wall 16, is thickened locally to improve castability of the nozzle, while maintaining stage performance. Additionally, the preferred nozzle has seven closed-circuit cavities 22 (FIG. 4) and one trailing edge air-cooled cavity (26), although it will be appreciated that the present invention can be employed in a nozzle having any one of a number of cavities or none at all.

Figure 7:
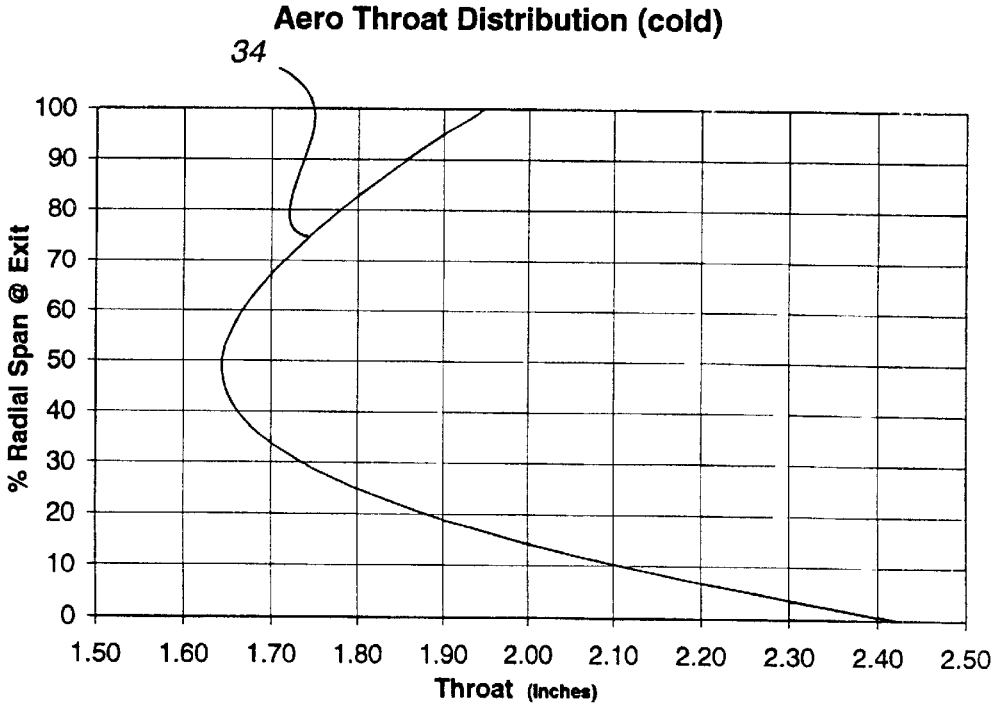
FIG. 7 is a graph illustrating the change in radial span with the throat.

Referring to FIG. 7, the minimum throat distance at various distances in the Z direction are given. Particularly, the minimum throat 28 (FIG. 3) is given in inches by line 34 (FIG. 7) as a function of the percent radial span of the vane from the inner wall to the outer wall.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An airfoil for a gas turbine nozzle stage having a profile at ambient temperature substantially in accordance with Cartesian coordinate values of X, Y and Z set forth in Table I as follows:

TABLE I

| Stage 1 Nozzle Airfoil Points (Cold) | | | |
|---|---|---|---|
| | Y (transv) | X (axial) | Z (ht) |
| Section 1 | | | |
| Point 1 | 0.929 | 0.153 | 42.845 |
| 2 | 1.235 | 0.368 | 42.845 |
| 3 | 1.551 | 0.571 | 42.845 |
| 4 | 1.876 | 0.762 | 42.845 |
| 5 | 2.199 | 0.955 | 42.845 |
| 6 | 2.507 | 1.167 | 42.845 |
| 7 | 2.805 | 1.393 | 42.845 |
| 8 | 3.086 | 1.643 | 42.845 |

TABLE I-continued

Stage 1 Nozzle Airfoil Points (Cold)

| | Y (transv) | X (axial) | Z (ht) |
|---|---|---|---|
| 9 | 3.444 | 2.023 | 42.845 |
| 10 | 3.784 | 2.423 | 42.845 |
| 11 | 4.108 | 2.835 | 42.845 |
| 12 | 4.420 | 3.256 | 42.845 |
| 13 | 4.758 | 3.747 | 42.845 |
| 14 | 5.072 | 4.253 | 42.845 |
| 15 | 5.350 | 4.774 | 42.845 |
| 16 | 5.588 | 5.313 | 42.845 |
| 17 | 5.785 | 5.871 | 42.845 |
| 18 | 5.949 | 6.443 | 42.845 |
| 19 | 6.003 | 6.634 | 42.845 |
| 20 | 6.063 | 6.824 | 42.845 |
| 21 | 6.139 | 7.008 | 42.845 |
| 22 | 6.189 | 7.095 | 42.845 |
| 23 | 6.250 | 7.174 | 42.845 |
| 24 | 6.326 | 7.239 | 42.845 |
| 25 | 6.417 | 7.283 | 42.845 |
| 26 | 6.515 | 7.303 | 42.845 |
| 27 | 6.616 | 7.304 | 42.845 |
| 28 | 6.711 | 7.282 | 42.845 |
| 29 | 6.799 | 7.240 | 42.845 |
| 30 | 6.881 | 7.188 | 42.845 |
| 31 | 6.958 | 7.128 | 42.845 |
| 32 | 7.068 | 7.022 | 42.845 |
| 33 | 7.167 | 6.906 | 42.845 |
| 34 | 7.297 | 6.715 | 42.845 |
| 35 | 7.403 | 6.509 | 42.845 |
| 36 | 7.485 | 6.293 | 42.845 |
| 37 | 7.551 | 6.023 | 42.845 |
| 38 | 7.584 | 5.747 | 42.845 |
| 39 | 7.583 | 5.469 | 42.845 |
| 40 | 7.550 | 5.192 | 42.845 |
| 41 | 7.488 | 4.921 | 42.845 |
| 42 | 7.380 | 4.612 | 42.845 |
| 43 | 7.240 | 4.316 | 42.845 |
| 44 | 7.072 | 4.035 | 42.845 |
| 45 | 6.881 | 3.770 | 42.845 |
| 46 | 6.671 | 3.520 | 42.845 |
| 47 | 6.445 | 3.284 | 42.845 |
| 48 | 6.206 | 3.062 | 42.845 |
| 49 | 5.957 | 2.851 | 42.845 |
| 50 | 5.549 | 2.541 | 42.845 |
| 51 | 5.125 | 2.252 | 42.845 |
| 52 | 4.691 | 1.981 | 42.845 |
| 53 | 4.248 | 1.723 | 42.845 |
| 54 | 3.715 | 1.426 | 42.845 |
| 55 | 3.178 | 1.137 | 42.845 |
| 56 | 2.639 | 0.853 | 42.845 |
| 57 | 2.098 | 0.572 | 42.845 |
| 58 | 1.556 | 0.291 | 42.845 |
| 59 | 1.012 | 0.016 | 42.845 |
| Section 2 | | | |
| Point 1 | 0.191 | 0.145 | 43.341 |
| 2 | 0.578 | 0.391 | 43.341 |
| 3 | 0.972 | 0.625 | 43.341 |
| 4 | 1.370 | 0.851 | 43.341 |
| 5 | 1.765 | 1.082 | 43.341 |
| 6 | 2.148 | 1.327 | 43.341 |
| 7 | 2.515 | 1.593 | 43.341 |
| 8 | 2.929 | 1.930 | 43.341 |
| 9 | 3.326 | 2.288 | 43.341 |
| 10 | 3.710 | 2.663 | 43.341 |
| 11 | 4.077 | 3.058 | 43.341 |
| 12 | 4.393 | 3.432 | 43.341 |
| 13 | 4.686 | 3.820 | 43.341 |
| 14 | 4.952 | 4.224 | 43.341 |
| 15 | 5.189 | 4.646 | 43.341 |
| 16 | 5.394 | 5.087 | 43.341 |
| 17 | 5.542 | 5.469 | 43.341 |
| 18 | 5.672 | 5.860 | 43.341 |
| 19 | 5.792 | 6.254 | 43.341 |
| 20 | 5.854 | 6.451 | 43.341 |
| 21 | 5.922 | 6.646 | 43.341 |
| 22 | 6.005 | 6.835 | 43.341 |

TABLE I-continued

Stage 1 Nozzle Airfoil Points (Cold)

| | Y (transv) | X (axial) | Z (ht) |
|---|---|---|---|
| 23 | 6.058 | 6.925 | 43.341 |
| 24 | 6.120 | 7.010 | 43.341 |
| 25 | 6.196 | 7.083 | 43.341 |
| 26 | 6.284 | 7.139 | 43.341 |
| 27 | 6.383 | 7.172 | 43.341 |
| 28 | 6.488 | 7.179 | 43.341 |
| 29 | 6.587 | 7.159 | 43.341 |
| 30 | 6.680 | 7.116 | 43.341 |
| 31 | 6.765 | 7.061 | 43.341 |
| 32 | 6.844 | 6.998 | 43.341 |
| 33 | 6.957 | 6.885 | 43.341 |
| 34 | 7.056 | 6.761 | 43.341 |
| 35 | 7.184 | 6.556 | 43.341 |
| 36 | 7.284 | 6.336 | 43.341 |
| 37 | 7.358 | 6.106 | 43.341 |
| 38 | 7.413 | 5.821 | 43.341 |
| 39 | 7.431 | 5.532 | 43.341 |
| 40 | 7.414 | 5.242 | 43.341 |
| 41 | 7.365 | 4.956 | 43.341 |
| 42 | 7.286 | 4.677 | 43.341 |
| 43 | 7.159 | 4.360 | 43.341 |
| 44 | 6.999 | 4.058 | 43.341 |
| 45 | 6.811 | 3.773 | 43.341 |
| 46 | 6.599 | 3.506 | 43.341 |
| 47 | 6.367 | 3.257 | 43.341 |
| 48 | 6.119 | 3.024 | 43.341 |
| 49 | 5.857 | 2.807 | 43.341 |
| 50 | 5.583 | 2.604 | 43.341 |
| 51 | 5.135 | 2.309 | 43.341 |
| 52 | 4.673 | 2.040 | 43.341 |
| 53 | 4.210 | 1.795 | 43.341 |
| 54 | 3.743 | 1.565 | 43.341 |
| 55 | 2.884 | 1.165 | 43.341 |
| 56 | 2.010 | 0.773 | 43.341 |
| 57 | 1.137 | 0.391 | 43.341 |
| 58 | 0.258 | 0.018 | 43.341 |
| Section 3 | | | |
| Point 1 | −0.544 | 0.140 | 43.836 |
| 2 | −0.048 | 0.419 | 43.836 |
| 3 | 0.453 | 0.688 | 43.836 |
| 4 | 0.960 | 0.947 | 43.836 |
| 5 | 1.462 | 1.215 | 43.836 |
| 6 | 1.950 | 1.508 | 43.836 |
| 7 | 2.416 | 1.817 | 43.836 |
| 8 | 2.866 | 2.147 | 43.836 |
| 9 | 3.296 | 2.498 | 43.836 |
| 10 | 3.703 | 2.871 | 43.836 |
| 11 | 4.051 | 3.234 | 43.836 |
| 12 | 4.376 | 3.620 | 43.836 |
| 13 | 4.676 | 4.033 | 43.836 |
| 14 | 4.943 | 4.470 | 43.836 |
| 15 | 5.172 | 4.926 | 43.836 |
| 16 | 5.337 | 5.319 | 43.836 |
| 17 | 5.481 | 5.722 | 43.836 |
| 18 | 5.610 | 6.130 | 43.836 |
| 19 | 5.676 | 6.333 | 43.836 |
| 20 | 5.748 | 6.535 | 43.836 |
| 21 | 5.835 | 6.730 | 43.836 |
| 22 | 5.890 | 6.822 | 43.836 |
| 23 | 5.957 | 6.906 | 43.836 |
| 24 | 6.038 | 6.977 | 43.836 |
| 25 | 6.132 | 7.029 | 43.836 |
| 26 | 6.235 | 7.058 | 43.836 |
| 27 | 6.342 | 7.067 | 43.836 |
| 28 | 6.445 | 7.044 | 43.836 |
| 29 | 6.539 | 6.996 | 43.836 |
| 30 | 6.625 | 6.936 | 43.836 |
| 31 | 6.704 | 6.868 | 43.836 |
| 32 | 6.816 | 6.747 | 43.836 |
| 33 | 6.915 | 6.615 | 43.836 |
| 34 | 7.039 | 6.399 | 43.836 |
| 35 | 7.133 | 6.168 | 43.836 |
| 36 | 7.198 | 5.927 | 43.836 |
| 37 | 7.238 | 5.630 | 43.836 |

TABLE I-continued

Stage 1 Nozzle Airfoil Points (Cold)

| | Y (transv) | X (axial) | Z (ht) |
|---|---|---|---|
| 38 | 7.238 | 5.330 | 43.836 |
| 39 | 7.201 | 5.033 | 43.836 |
| 40 | 7.131 | 4.741 | 43.836 |
| 41 | 7.031 | 4.459 | 43.836 |
| 42 | 6.880 | 4.140 | 43.836 |
| 43 | 6.698 | 3.837 | 43.836 |
| 44 | 6.490 | 3.553 | 43.836 |
| 45 | 6.259 | 3.287 | 43.836 |
| 46 | 6.010 | 3.038 | 43.836 |
| 47 | 5.746 | 2.806 | 43.836 |
| 48 | 5.467 | 2.591 | 43.836 |
| 49 | 5.178 | 2.391 | 43.836 |
| 50 | 4.705 | 2.106 | 43.836 |
| 51 | 4.215 | 1.850 | 43.836 |
| 52 | 3.714 | 1.617 | 43.836 |
| 53 | 3.206 | 1.401 | 43.836 |
| 54 | 2.289 | 1.037 | 43.836 |
| 55 | 1.367 | 0.688 | 43.836 |
| 56 | 0.442 | 0.347 | 43.836 |
| 57 | −0.487 | 0.015 | 43.836 |
| Section 4 | | | |
| Point 1 | −1.158 | 0.139 | 44.332 |
| 2 | −0.627 | 0.397 | 44.332 |
| 3 | −0.089 | 0.641 | 44.332 |
| 4 | 0.453 | 0.877 | 44.332 |
| 5 | 0.987 | 1.131 | 44.332 |
| 6 | 1.507 | 1.412 | 44.332 |
| 7 | 2.002 | 1.711 | 44.332 |
| 8 | 2.478 | 2.033 | 44.332 |
| 9 | 2.934 | 2.381 | 44.332 |
| 10 | 3.369 | 2.757 | 44.332 |
| 11 | 3.744 | 3.124 | 44.332 |
| 12 | 4.096 | 3.519 | 44.332 |
| 13 | 4.417 | 3.935 | 44.332 |
| 14 | 4.704 | 4.370 | 44.332 |
| 15 | 4.954 | 4.824 | 44.332 |
| 16 | 5.137 | 5.216 | 44.332 |
| 17 | 5.298 | 5.619 | 44.332 |
| 18 | 5.444 | 6.031 | 44.332 |
| 19 | 5.517 | 6.237 | 44.332 |
| 20 | 5.595 | 6.440 | 44.332 |
| 21 | 5.691 | 6.636 | 44.332 |
| 22 | 5.750 | 6.727 | 44.332 |
| 23 | 5.821 | 6.809 | 44.332 |
| 24 | 5.906 | 6.878 | 44.332 |
| 25 | 6.003 | 6.927 | 44.332 |
| 26 | 6.108 | 6.956 | 44.332 |
| 27 | 6.216 | 6.965 | 44.332 |
| 28 | 6.322 | 6.941 | 44.332 |
| 29 | 6.418 | 6.892 | 44.332 |
| 30 | 6.506 | 6.829 | 44.332 |
| 31 | 6.587 | 6.757 | 44.332 |
| 32 | 6.702 | 6.632 | 44.332 |
| 33 | 6.801 | 6.494 | 44.332 |
| 34 | 6.924 | 6.267 | 44.332 |
| 35 | 7.015 | 6.025 | 44.332 |
| 36 | 7.074 | 5.774 | 44.332 |
| 37 | 7.105 | 5.466 | 44.332 |
| 38 | 7.094 | 5.156 | 44.332 |
| 39 | 7.044 | 4.849 | 44.332 |
| 40 | 6.961 | 4.550 | 44.332 |
| 41 | 6.846 | 4.262 | 44.332 |
| 42 | 6.677 | 3.939 | 44.332 |
| 43 | 6.477 | 3.635 | 44.332 |
| 44 | 6.250 | 3.351 | 44.332 |
| 45 | 6.000 | 3.086 | 44.332 |
| 46 | 5.732 | 2.841 | 44.332 |
| 47 | 5.448 | 2.614 | 44.332 |
| 48 | 5.151 | 2.404 | 44.332 |
| 49 | 4.844 | 2.211 | 44.332 |
| 50 | 4.343 | 1.936 | 44.332 |
| 51 | 3.827 | 1.693 | 44.332 |
| 52 | 3.300 | 1.474 | 44.332 |
| 53 | 2.766 | 1.273 | 44.332 |

TABLE I-continued

Stage 1 Nozzle Airfoil Points (Cold)

| | Y (transv) | X (axial) | Z (ht) |
|---|---|---|---|
| 54 | 1.803 | 0.939 | 44.332 |
| 55 | 0.835 | 0.622 | 44.332 |
| 56 | −0.137 | 0.315 | 44.332 |
| 57 | −1.111 | 0.019 | 44.332 |
| Section 5 | | | |
| Point 1 | −1.621 | 0.137 | 44.828 |
| 2 | −1.159 | 0.335 | 44.828 |
| 3 | −0.695 | 0.528 | 44.828 |
| 4 | −0.231 | 0.720 | 44.828 |
| 5 | 0.230 | 0.920 | 44.828 |
| 6 | 0.685 | 1.132 | 44.828 |
| 7 | 1.130 | 1.357 | 44.828 |
| 8 | 1.642 | 1.643 | 44.828 |
| 9 | 2.137 | 1.953 | 44.828 |
| 10 | 2.615 | 2.289 | 44.828 |
| 11 | 3.073 | 2.656 | 44.828 |
| 12 | 3.469 | 3.019 | 44.828 |
| 13 | 3.842 | 3.411 | 44.828 |
| 14 | 4.184 | 3.824 | 44.828 |
| 15 | 4.491 | 4.257 | 44.828 |
| 16 | 4.763 | 4.710 | 44.828 |
| 17 | 4.965 | 5.103 | 44.828 |
| 18 | 5.147 | 5.507 | 44.828 |
| 19 | 5.313 | 5.921 | 44.828 |
| 20 | 5.396 | 6.127 | 44.828 |
| 21 | 5.484 | 6.332 | 44.828 |
| 22 | 5.585 | 6.528 | 44.828 |
| 23 | 5.646 | 6.620 | 44.828 |
| 24 | 5.716 | 6.704 | 44.828 |
| 25 | 5.800 | 6.776 | 44.828 |
| 26 | 5.896 | 6.830 | 44.828 |
| 27 | 6.002 | 6.864 | 44.828 |
| 28 | 6.113 | 6.873 | 44.828 |
| 29 | 6.221 | 6.849 | 44.828 |
| 30 | 6.320 | 6.800 | 44.828 |
| 31 | 6.410 | 6.735 | 44.828 |
| 32 | 6.493 | 6.661 | 44.828 |
| 33 | 6.608 | 6.531 | 44.828 |
| 34 | 6.707 | 6.387 | 44.828 |
| 35 | 6.828 | 6.153 | 44.828 |
| 36 | 6.916 | 5.903 | 44.828 |
| 37 | 6.970 | 5.645 | 44.828 |
| 38 | 6.993 | 5.328 | 44.828 |
| 39 | 6.974 | 5.011 | 44.828 |
| 40 | 6.916 | 4.698 | 44.828 |
| 41 | 6.823 | 4.395 | 44.828 |
| 42 | 6.698 | 4.103 | 44.828 |
| 43 | 6.516 | 3.777 | 44.828 |
| 44 | 6.303 | 3.471 | 44.828 |
| 45 | 6.062 | 3.187 | 44.828 |
| 46 | 5.799 | 2.924 | 44.828 |
| 47 | 5.516 | 2.681 | 44.828 |
| 48 | 5.218 | 2.458 | 44.828 |
| 49 | 4.907 | 2.254 | 44.828 |
| 50 | 4.586 | 2.067 | 44.828 |
| 51 | 4.064 | 1.803 | 44.828 |
| 52 | 3.528 | 1.571 | 44.828 |
| 53 | 2.981 | 1.365 | 44.828 |
| 54 | 2.428 | 1.176 | 44.828 |
| 55 | 1.432 | 0.866 | 44.828 |
| 56 | 0.431 | 0.574 | 44.828 |
| 57 | −0.574 | 0.292 | 44.828 |
| 58 | −1.581 | 0.020 | 44.828 |
| Section 6 | | | |
| Point 1 | −1.961 | 0.138 | 45.324 |
| 2 | −1.492 | 0.320 | 45.324 |
| 3 | −1.023 | 0.502 | 45.324 |
| 4 | −0.555 | 0.689 | 45.324 |
| 5 | −0.092 | 0.885 | 45.324 |
| 6 | 0.366 | 1.089 | 45.324 |
| 7 | 0.817 | 1.306 | 45.324 |
| 8 | 1.338 | 1.578 | 45.324 |
| 9 | 1.844 | 1.874 | 45.324 |

TABLE I-continued

Stage 1 Nozzle Airfoil Points (Cold)

| | Y (transv) | X (axial) | Z (ht) |
|---|---|---|---|
| 10 | 2.333 | 2.196 | 45.324 |
| 11 | 2.804 | 2.548 | 45.324 |
| 12 | 3.213 | 2.899 | 45.324 |
| 13 | 3.602 | 3.282 | 45.324 |
| 14 | 3.962 | 3.690 | 45.324 |
| 15 | 4.290 | 4.123 | 45.324 |
| 16 | 4.586 | 4.581 | 45.324 |
| 17 | 4.808 | 4.978 | 45.324 |
| 18 | 5.009 | 5.388 | 45.324 |
| 19 | 5.194 | 5.805 | 45.324 |
| 20 | 5.286 | 6.014 | 45.324 |
| 21 | 5.381 | 6.221 | 45.324 |
| 22 | 5.489 | 6.423 | 45.324 |
| 23 | 5.552 | 6.518 | 45.324 |
| 24 | 5.624 | 6.607 | 45.324 |
| 25 | 5.708 | 6.684 | 45.324 |
| 26 | 5.806 | 6.744 | 45.324 |
| 27 | 5.914 | 6.781 | 45.324 |
| 28 | 6.027 | 6.791 | 45.324 |
| 29 | 6.138 | 6.768 | 45.324 |
| 30 | 6.239 | 6.718 | 45.324 |
| 31 | 6.331 | 6.653 | 45.324 |
| 32 | 6.414 | 6.577 | 45.324 |
| 33 | 6.531 | 6.444 | 45.324 |
| 34 | 6.630 | 6.297 | 45.324 |
| 35 | 6.749 | 6.057 | 45.324 |
| 36 | 6.833 | 5.802 | 45.324 |
| 37 | 6.884 | 5.538 | 45.324 |
| 38 | 6.902 | 5.216 | 45.324 |
| 39 | 6.878 | 4.894 | 45.324 |
| 40 | 6.814 | 4.577 | 45.324 |
| 41 | 6.714 | 4.270 | 45.324 |
| 42 | 6.582 | 3.975 | 45.324 |
| 43 | 6.413 | 3.680 | 45.324 |
| 44 | 6.218 | 3.403 | 45.324 |
| 45 | 6.000 | 3.143 | 45.324 |
| 46 | 5.762 | 2.901 | 45.324 |
| 47 | 5.507 | 2.677 | 45.324 |
| 48 | 5.152 | 2.410 | 45.324 |
| 49 | 4.779 | 2.170 | 45.324 |
| 50 | 4.391 | 1.954 | 45.324 |
| 51 | 3.855 | 1.699 | 45.324 |
| 52 | 3.304 | 1.477 | 45.324 |
| 53 | 2.743 | 1.280 | 45.324 |
| 54 | 2.176 | 1.101 | 45.324 |
| 55 | 1.497 | 0.904 | 45.324 |
| 56 | 0.815 | 0.718 | 45.324 |
| 57 | 0.132 | 0.538 | 45.324 |
| 58 | −0.553 | 0.362 | 45.324 |
| 59 | −1.239 | 0.188 | 45.324 |
| 60 | −1.926 | 0.022 | 45.324 |
| Section 7 | | | |
| Point 1 | −2.176 | 0.137 | 45.820 |
| 2 | −1.702 | 0.314 | 45.820 |
| 3 | −1.227 | 0.491 | 45.820 |
| 4 | −0.756 | 0.676 | 45.820 |
| 5 | −0.288 | 0.869 | 45.820 |
| 6 | 0.175 | 1.072 | 45.820 |
| 7 | 0.632 | 1.285 | 45.820 |
| 8 | 1.161 | 1.553 | 45.820 |
| 9 | 1.676 | 1.842 | 45.820 |
| 10 | 2.174 | 2.158 | 45.820 |
| 11 | 2.653 | 2.505 | 45.820 |
| 12 | 3.070 | 2.851 | 45.820 |
| 13 | 3.466 | 3.229 | 45.820 |
| 14 | 3.833 | 3.635 | 45.820 |
| 15 | 4.169 | 4.065 | 45.820 |
| 16 | 4.473 | 4.520 | 45.820 |
| 17 | 4.704 | 4.916 | 45.820 |
| 18 | 4.914 | 5.323 | 45.820 |
| 19 | 5.109 | 5.737 | 45.820 |
| 20 | 5.207 | 5.944 | 45.820 |
| 21 | 5.308 | 6.150 | 45.820 |
| 22 | 5.420 | 6.350 | 45.820 |

TABLE I-continued

Stage 1 Nozzle Airfoil Points (Cold)

| | Y (transv) | X (axial) | Z (ht) |
|---|---|---|---|
| 23 | 5.484 | 6.445 | 45.820 |
| 24 | 5.557 | 6.534 | 45.820 |
| 25 | 5.641 | 6.612 | 45.820 |
| 26 | 5.738 | 6.672 | 45.820 |
| 27 | 5.846 | 6.710 | 45.820 |
| 28 | 5.960 | 6.720 | 45.820 |
| 29 | 6.071 | 6.699 | 45.820 |
| 30 | 6.174 | 6.651 | 45.820 |
| 31 | 6.267 | 6.585 | 45.820 |
| 32 | 6.352 | 6.509 | 45.820 |
| 33 | 6.469 | 6.375 | 45.820 |
| 34 | 6.568 | 6.226 | 45.820 |
| 35 | 6.687 | 5.982 | 45.820 |
| 36 | 6.769 | 5.724 | 45.820 |
| 37 | 6.818 | 5.457 | 45.820 |
| 38 | 6.834 | 5.132 | 45.820 |
| 39 | 6.806 | 4.807 | 45.820 |
| 40 | 6.739 | 4.488 | 45.820 |
| 41 | 6.636 | 4.179 | 45.820 |
| 42 | 6.501 | 3.883 | 45.820 |
| 43 | 6.328 | 3.586 | 45.820 |
| 44 | 6.127 | 3.308 | 45.820 |
| 45 | 5.904 | 3.049 | 45.820 |
| 46 | 5.660 | 2.808 | 45.820 |
| 47 | 5.400 | 2.586 | 45.820 |
| 48 | 5.038 | 2.322 | 45.820 |
| 49 | 4.657 | 2.085 | 45.820 |
| 50 | 4.262 | 1.874 | 45.820 |
| 51 | 3.717 | 1.626 | 45.820 |
| 52 | 3.157 | 1.410 | 45.820 |
| 53 | 2.588 | 1.220 | 45.820 |
| 54 | 2.013 | 1.049 | 45.820 |
| 55 | 1.424 | 0.887 | 45.820 |
| 56 | 0.831 | 0.734 | 45.820 |
| 57 | 0.238 | 0.586 | 45.820 |
| 58 | −0.356 | 0.441 | 45.820 |
| 59 | −0.951 | 0.297 | 45.820 |
| 60 | −1.546 | 0.157 | 45.820 |
| 61 | −2.143 | 0.023 | 45.820 |
| Section 8 | | | |
| Point 1 | −2.307 | 0.137 | 46.316 |
| 2 | −1.986 | 0.256 | 46.316 |
| 3 | −1.662 | 0.372 | 46.316 |
| 4 | −1.340 | 0.491 | 46.316 |
| 5 | −1.020 | 0.613 | 46.316 |
| 6 | −0.700 | 0.740 | 46.316 |
| 7 | −0.078 | 1.000 | 46.316 |
| 8 | 0.536 | 1.279 | 46.316 |
| 9 | 1.073 | 1.546 | 46.316 |
| 10 | 1.597 | 1.835 | 46.316 |
| 11 | 2.104 | 2.151 | 46.316 |
| 12 | 2.592 | 2.499 | 46.316 |
| 13 | 3.015 | 2.847 | 46.316 |
| 14 | 3.413 | 3.225 | 46.316 |
| 15 | 3.779 | 3.627 | 46.316 |
| 16 | 4.111 | 4.052 | 46.316 |
| 17 | 4.411 | 4.500 | 46.316 |
| 18 | 4.639 | 4.888 | 46.316 |
| 19 | 4.849 | 5.289 | 46.316 |
| 20 | 5.048 | 5.697 | 46.316 |
| 21 | 5.148 | 5.902 | 46.316 |
| 22 | 5.251 | 6.104 | 46.316 |
| 23 | 5.366 | 6.299 | 46.316 |
| 24 | 5.432 | 6.393 | 46.316 |
| 25 | 5.506 | 6.479 | 46.316 |
| 26 | 5.592 | 6.555 | 46.316 |
| 27 | 5.690 | 6.613 | 46.316 |
| 28 | 5.798 | 6.650 | 46.316 |
| 29 | 5.912 | 6.661 | 46.316 |
| 30 | 6.012 | 6.645 | 46.316 |
| 31 | 6.107 | 6.607 | 46.316 |
| 32 | 6.193 | 6.552 | 46.316 |
| 33 | 6.273 | 6.488 | 46.316 |
| 34 | 6.411 | 6.338 | 46.316 |

TABLE I-continued

Stage 1 Nozzle Airfoil Points (Cold)

| | Y (transv) | X (axial) | Z (ht) |
|---|---|---|---|
| 35 | 6.525 | 6.169 | 46.316 |
| 36 | 6.642 | 5.923 | 46.316 |
| 37 | 6.724 | 5.663 | 46.316 |
| 38 | 6.771 | 5.395 | 46.316 |
| 39 | 6.785 | 5.068 | 46.316 |
| 40 | 6.756 | 4.741 | 46.316 |
| 41 | 6.687 | 4.421 | 46.316 |
| 42 | 6.583 | 4.111 | 46.316 |
| 43 | 6.446 | 3.814 | 46.316 |
| 44 | 6.271 | 3.517 | 46.316 |
| 45 | 6.068 | 3.239 | 46.316 |
| 46 | 5.841 | 2.980 | 46.316 |
| 47 | 5.595 | 2.740 | 46.316 |
| 48 | 5.331 | 2.519 | 46.316 |
| 49 | 4.964 | 2.258 | 46.316 |
| 50 | 4.579 | 2.024 | 46.316 |
| 51 | 4.180 | 1.816 | 46.316 |
| 52 | 3.629 | 1.573 | 46.316 |
| 53 | 3.065 | 1.362 | 46.316 |
| 54 | 2.491 | 1.178 | 46.316 |
| 55 | 1.911 | 1.011 | 46.316 |
| 56 | 1.317 | 0.855 | 46.316 |
| 57 | 0.720 | 0.708 | 46.316 |
| 58 | 0.123 | 0.566 | 46.316 |
| 59 | −0.476 | 0.426 | 46.316 |
| 60 | −1.075 | 0.287 | 46.316 |
| 61 | −1.674 | 0.152 | 46.316 |
| 62 | −2.275 | 0.024 | 46.316 |
| Section 9 | | | |
| Point 1 | −2.361 | 0.136 | 46.811 |
| 2 | −1.885 | 0.310 | 46.811 |
| 3 | −1.408 | 0.483 | 46.811 |
| 4 | −0.935 | 0.664 | 46.811 |
| 5 | −0.464 | 0.852 | 46.811 |
| 6 | 0.003 | 1.050 | 46.811 |
| 7 | 0.465 | 1.259 | 46.811 |
| 8 | 0.999 | 1.521 | 46.811 |
| 9 | 1.520 | 1.804 | 46.811 |
| 10 | 2.023 | 2.112 | 46.811 |
| 11 | 2.507 | 2.450 | 46.811 |
| 12 | 2.926 | 2.787 | 46.811 |
| 13 | 3.325 | 3.157 | 46.811 |
| 14 | 3.698 | 3.559 | 46.811 |
| 15 | 4.039 | 3.988 | 46.811 |
| 16 | 4.346 | 4.442 | 46.811 |
| 17 | 4.579 | 4.836 | 46.811 |
| 18 | 4.794 | 5.241 | 46.811 |
| 19 | 4.997 | 5.652 | 46.811 |
| 20 | 5.099 | 5.858 | 46.811 |
| 21 | 5.206 | 6.060 | 46.811 |
| 22 | 5.326 | 6.257 | 46.811 |
| 23 | 5.408 | 6.367 | 46.811 |
| 24 | 5.503 | 6.466 | 46.811 |
| 25 | 5.615 | 6.545 | 46.811 |
| 26 | 5.743 | 6.596 | 46.811 |
| 27 | 5.879 | 6.612 | 46.811 |
| 28 | 5.981 | 6.597 | 46.811 |
| 29 | 6.076 | 6.561 | 46.811 |
| 30 | 6.164 | 6.508 | 46.811 |
| 31 | 6.244 | 6.444 | 46.811 |
| 32 | 6.383 | 6.295 | 46.811 |
| 33 | 6.497 | 6.125 | 46.811 |
| 34 | 6.614 | 5.879 | 46.811 |
| 35 | 6.694 | 5.619 | 46.811 |
| 36 | 6.741 | 5.351 | 46.811 |
| 37 | 6.755 | 5.024 | 46.811 |
| 38 | 6.727 | 4.698 | 46.811 |
| 39 | 6.659 | 4.378 | 46.811 |
| 40 | 6.555 | 4.068 | 46.811 |
| 41 | 6.418 | 3.770 | 46.811 |
| 42 | 6.243 | 3.472 | 46.811 |
| 43 | 6.040 | 3.194 | 46.811 |
| 44 | 5.812 | 2.935 | 46.811 |
| 45 | 5.564 | 2.696 | 46.811 |

TABLE I-continued

Stage 1 Nozzle Airfoil Points (Cold)

| | Y (transv) | X (axial) | Z (ht) |
|---|---|---|---|
| 46 | 5.299 | 2.477 | 46.811 |
| 47 | 4.931 | 2.217 | 46.811 |
| 48 | 4.544 | 1.986 | 46.811 |
| 49 | 4.143 | 1.780 | 46.811 |
| 50 | 3.590 | 1.540 | 46.811 |
| 51 | 3.024 | 1.332 | 46.811 |
| 52 | 2.448 | 1.151 | 46.811 |
| 53 | 1.867 | 0.988 | 46.811 |
| 54 | 1.346 | 0.854 | 46.811 |
| 55 | 0.823 | 0.727 | 46.811 |
| 56 | 0.299 | 0.605 | 46.811 |
| 57 | −0.226 | 0.485 | 46.811 |
| 58 | −0.751 | 0.366 | 46.811 |
| 59 | −1.276 | 0.248 | 46.811 |
| 60 | −1.802 | 0.133 | 46.811 |
| 61 | −2.329 | 0.025 | 46.811 |
| Section 10 | | | |
| Point 1 | −2.361 | 0.135 | 47.307 |
| 2 | −2.042 | 0.254 | 47.307 |
| 3 | −1.721 | 0.369 | 47.307 |
| 4 | −1.401 | 0.485 | 47.307 |
| 5 | −1.081 | 0.604 | 47.307 |
| 6 | −0.763 | 0.726 | 47.307 |
| 7 | −0.143 | 0.977 | 47.307 |
| 8 | 0.468 | 1.249 | 47.307 |
| 9 | 1.002 | 1.510 | 47.307 |
| 10 | 1.521 | 1.794 | 47.307 |
| 11 | 2.023 | 2.104 | 47.307 |
| 12 | 2.505 | 2.444 | 47.307 |
| 13 | 2.924 | 2.782 | 47.307 |
| 14 | 3.322 | 3.153 | 47.307 |
| 15 | 3.693 | 3.555 | 47.307 |
| 16 | 4.031 | 3.983 | 47.307 |
| 17 | 4.332 | 4.433 | 47.307 |
| 18 | 4.560 | 4.824 | 47.307 |
| 19 | 4.771 | 5.227 | 47.307 |
| 20 | 4.973 | 5.635 | 47.307 |
| 21 | 5.076 | 5.838 | 47.307 |
| 22 | 5.184 | 6.039 | 47.307 |
| 23 | 5.305 | 6.232 | 47.307 |
| 24 | 5.389 | 6.340 | 47.307 |
| 25 | 5.486 | 6.435 | 47.307 |
| 26 | 5.599 | 6.510 | 47.307 |
| 27 | 5.727 | 6.558 | 47.307 |
| 28 | 5.863 | 6.574 | 47.307 |
| 29 | 5.996 | 6.553 | 47.307 |
| 30 | 6.119 | 6.494 | 47.307 |
| 31 | 6.228 | 6.413 | 47.307 |
| 32 | 6.368 | 6.265 | 47.307 |
| 33 | 6.483 | 6.097 | 47.307 |
| 34 | 6.599 | 5.851 | 47.307 |
| 35 | 6.679 | 5.591 | 47.307 |
| 36 | 6.724 | 5.322 | 47.307 |
| 37 | 6.738 | 4.996 | 47.307 |
| 38 | 6.710 | 4.670 | 47.307 |
| 39 | 6.643 | 4.349 | 47.307 |
| 40 | 6.540 | 4.039 | 47.307 |
| 41 | 6.405 | 3.742 | 47.307 |
| 42 | 6.231 | 3.446 | 47.307 |
| 43 | 6.029 | 3.169 | 47.307 |
| 44 | 5.803 | 2.912 | 47.307 |
| 45 | 5.557 | 2.674 | 47.307 |
| 46 | 5.293 | 2.456 | 47.307 |
| 47 | 5.015 | 2.256 | 47.307 |
| 48 | 4.726 | 2.073 | 47.307 |
| 49 | 4.428 | 1.905 | 47.307 |
| 50 | 3.944 | 1.671 | 47.307 |
| 51 | 3.447 | 1.467 | 47.307 |
| 52 | 2.940 | 1.288 | 47.307 |
| 53 | 2.426 | 1.129 | 47.307 |
| 54 | 1.546 | 0.892 | 47.307 |
| 55 | 0.660 | 0.679 | 47.307 |
| 56 | −0.230 | 0.477 | 47.307 |
| 57 | −0.492 | 0.419 | 47.307 |

TABLE I-continued

Stage 1 Nozzle Airfoil Points (Cold)

| | Y (transv) | X (axial) | Z (ht) |
|---|---|---|---|
| 58 | −0.754 | 0.361 | 47.307 |
| 59 | −1.016 | 0.304 | 47.307 |
| 60 | −1.279 | 0.246 | 47.307 |
| 61 | −1.541 | 0.188 | 47.307 |
| 62 | −1.803 | 0.130 | 47.307 |
| 63 | −2.066 | 0.074 | 47.307 |
| 64 | −2.330 | 0.025 | 47.307 |
| Section 11 | | | |
| Point 1 | −2.309 | 0.134 | 47.803 |
| 2 | −1.993 | 0.254 | 47.803 |
| 3 | −1.675 | 0.368 | 47.803 |
| 4 | −1.357 | 0.483 | 47.803 |
| 5 | −1.039 | 0.601 | 47.803 |
| 6 | −0.723 | 0.721 | 47.803 |
| 7 | −0.106 | 0.968 | 47.803 |
| 8 | 0.501 | 1.235 | 47.803 |
| 9 | 1.030 | 1.495 | 47.803 |
| 10 | 1.543 | 1.778 | 47.803 |
| 11 | 2.039 | 2.089 | 47.803 |
| 12 | 2.515 | 2.430 | 47.803 |
| 13 | 2.928 | 2.770 | 47.803 |
| 14 | 3.320 | 3.142 | 47.803 |
| 15 | 3.686 | 3.544 | 47.803 |
| 16 | 4.018 | 3.969 | 47.803 |
| 17 | 4.318 | 4.416 | 47.803 |
| 18 | 4.545 | 4.804 | 47.803 |
| 19 | 4.756 | 5.204 | 47.803 |
| 20 | 4.958 | 5.609 | 47.803 |
| 21 | 5.061 | 5.811 | 47.803 |
| 22 | 5.169 | 6.010 | 47.803 |
| 23 | 5.290 | 6.202 | 47.803 |
| 24 | 5.375 | 6.309 | 47.803 |
| 25 | 5.473 | 6.405 | 47.803 |
| 26 | 5.587 | 6.482 | 47.803 |
| 27 | 5.715 | 6.530 | 47.803 |
| 28 | 5.851 | 6.547 | 47.803 |
| 29 | 5.985 | 6.526 | 47.803 |
| 30 | 6.107 | 6.469 | 47.803 |
| 31 | 6.216 | 6.388 | 47.803 |
| 32 | 6.356 | 6.241 | 47.803 |
| 33 | 6.470 | 6.073 | 47.803 |
| 34 | 6.587 | 5.829 | 47.803 |
| 35 | 6.668 | 5.571 | 47.803 |
| 36 | 6.716 | 5.304 | 47.803 |
| 37 | 6.734 | 4.979 | 47.803 |
| 38 | 6.709 | 4.654 | 47.803 |
| 39 | 6.646 | 4.335 | 47.803 |
| 40 | 6.546 | 4.025 | 47.803 |
| 41 | 6.413 | 3.728 | 47.803 |
| 42 | 6.242 | 3.432 | 47.803 |
| 43 | 6.043 | 3.156 | 47.803 |
| 44 | 5.818 | 2.899 | 47.803 |
| 45 | 5.574 | 2.661 | 47.803 |
| 46 | 5.311 | 2.444 | 47.803 |
| 47 | 5.035 | 2.244 | 47.803 |
| 48 | 4.747 | 2.062 | 47.803 |
| 49 | 4.450 | 1.895 | 47.803 |
| 50 | 3.969 | 1.662 | 47.803 |
| 51 | 3.474 | 1.459 | 47.803 |
| 52 | 2.969 | 1.281 | 47.803 |
| 53 | 2.457 | 1.123 | 47.803 |
| 54 | 1.581 | 0.886 | 47.803 |
| 55 | 0.698 | 0.675 | 47.803 |
| 56 | −0.187 | 0.475 | 47.803 |
| 57 | −1.357 | 0.218 | 47.803 |
| 58 | −1.541 | 0.177 | 47.803 |
| 59 | −1.725 | 0.137 | 47.803 |
| 60 | −1.909 | 0.097 | 47.803 |
| 61 | −2.093 | 0.056 | 47.803 |
| 62 | −2.278 | 0.026 | 47.803 |
| Section 12 | | | |
| Point 1 | −2.218 | 0.133 | 48.299 |
| 2 | −1.903 | 0.255 | 48.299 |

TABLE I-continued

Stage 1 Nozzle Airfoil Points (Cold)

| | Y (transv) | X (axial) | Z (ht) |
|---|---|---|---|
| 3 | −1.586 | 0.369 | 48.299 |
| 4 | −1.269 | 0.484 | 48.299 |
| 5 | −0.952 | 0.601 | 48.299 |
| 6 | −0.637 | 0.721 | 48.299 |
| 7 | −0.021 | 0.966 | 48.299 |
| 8 | 0.584 | 1.232 | 48.299 |
| 9 | 1.111 | 1.493 | 48.299 |
| 10 | 1.622 | 1.780 | 48.299 |
| 11 | 2.115 | 2.098 | 48.299 |
| 12 | 2.589 | 2.449 | 48.299 |
| 13 | 2.999 | 2.799 | 48.299 |
| 14 | 3.382 | 3.173 | 48.299 |
| 15 | 3.734 | 3.570 | 48.299 |
| 16 | 4.056 | 3.990 | 48.299 |
| 17 | 4.347 | 4.432 | 48.299 |
| 18 | 4.570 | 4.816 | 48.299 |
| 19 | 4.777 | 5.210 | 48.299 |
| 20 | 4.977 | 5.611 | 48.299 |
| 21 | 5.079 | 5.810 | 48.299 |
| 22 | 5.187 | 6.006 | 48.299 |
| 23 | 5.308 | 6.194 | 48.299 |
| 24 | 5.391 | 6.299 | 48.299 |
| 25 | 5.487 | 6.392 | 48.299 |
| 26 | 5.598 | 6.467 | 48.299 |
| 27 | 5.723 | 6.515 | 48.299 |
| 28 | 5.855 | 6.532 | 48.299 |
| 29 | 5.988 | 6.511 | 48.299 |
| 30 | 6.110 | 6.455 | 48.299 |
| 31 | 6.220 | 6.376 | 48.299 |
| 32 | 6.360 | 6.231 | 48.299 |
| 33 | 6.476 | 6.065 | 48.299 |
| 34 | 6.596 | 5.824 | 48.299 |
| 35 | 6.680 | 5.568 | 48.299 |
| 36 | 6.732 | 5.303 | 48.299 |
| 37 | 6.754 | 4.980 | 48.299 |
| 38 | 6.735 | 4.656 | 48.299 |
| 39 | 6.676 | 4.337 | 48.299 |
| 40 | 6.581 | 4.028 | 48.299 |
| 41 | 6.452 | 3.730 | 48.299 |
| 42 | 6.285 | 3.435 | 48.299 |
| 43 | 6.088 | 3.158 | 48.299 |
| 44 | 5.866 | 2.901 | 48.299 |
| 45 | 5.624 | 2.663 | 48.299 |
| 46 | 5.364 | 2.445 | 48.299 |
| 47 | 5.090 | 2.246 | 48.299 |
| 48 | 4.804 | 2.063 | 48.299 |
| 49 | 4.508 | 1.897 | 48.299 |
| 50 | 4.029 | 1.664 | 48.299 |
| 51 | 3.536 | 1.462 | 48.299 |
| 52 | 3.034 | 1.284 | 48.299 |
| 53 | 2.525 | 1.126 | 48.299 |
| 54 | 1.653 | 0.889 | 48.299 |
| 55 | 0.775 | 0.678 | 48.299 |
| 56 | −0.106 | 0.477 | 48.299 |
| 57 | −1.270 | 0.219 | 48.299 |
| 58 | −1.453 | 0.178 | 48.299 |
| 59 | −1.636 | 0.137 | 48.299 |
| 60 | −1.819 | 0.097 | 48.299 |
| 61 | −2.002 | 0.056 | 48.299 |
| 62 | −2.187 | 0.026 | 48.299 |
| Section 13 | | | |
| Point 1 | −2.096 | 0.132 | 48.795 |
| 2 | −1.838 | 0.235 | 48.795 |
| 3 | −1.577 | 0.331 | 48.795 |
| 4 | −1.316 | 0.426 | 48.795 |
| 5 | −1.055 | 0.523 | 48.795 |
| 6 | −0.795 | 0.621 | 48.795 |
| 7 | −0.536 | 0.721 | 48.795 |
| 8 | 0.072 | 0.966 | 48.795 |
| 9 | 0.670 | 1.231 | 48.795 |
| 10 | 1.190 | 1.490 | 48.795 |
| 11 | 1.695 | 1.776 | 48.795 |
| 12 | 2.183 | 2.091 | 48.795 |
| 13 | 2.651 | 2.441 | 48.795 |

TABLE I-continued

Stage 1 Nozzle Airfoil Points (Cold)

| | Y (transv) | X (axial) | Z (ht) |
|---|---|---|---|
| 14 | 3.056 | 2.789 | 48.795 |
| 15 | 3.432 | 3.162 | 48.795 |
| 16 | 3.779 | 3.558 | 48.795 |
| 17 | 4.097 | 3.979 | 48.795 |
| 18 | 4.386 | 4.423 | 48.795 |
| 19 | 4.608 | 4.808 | 48.795 |
| 20 | 4.814 | 5.202 | 48.795 |
| 21 | 5.012 | 5.602 | 48.795 |
| 22 | 5.113 | 5.800 | 48.795 |
| 23 | 5.219 | 5.996 | 48.795 |
| 24 | 5.339 | 6.183 | 48.795 |
| 25 | 5.421 | 6.289 | 48.795 |
| 26 | 5.515 | 6.384 | 48.795 |
| 27 | 5.624 | 6.460 | 48.795 |
| 28 | 5.748 | 6.510 | 48.795 |
| 29 | 5.880 | 6.527 | 48.795 |
| 30 | 6.012 | 6.506 | 48.795 |
| 31 | 6.134 | 6.450 | 48.795 |
| 32 | 6.244 | 6.373 | 48.795 |
| 33 | 6.341 | 6.280 | 48.795 |
| 34 | 6.427 | 6.177 | 48.795 |
| 35 | 6.503 | 6.066 | 48.795 |
| 36 | 6.627 | 5.828 | 48.795 |
| 37 | 6.717 | 5.575 | 48.795 |
| 38 | 6.776 | 5.313 | 48.795 |
| 39 | 6.806 | 4.991 | 48.795 |
| 40 | 6.795 | 4.668 | 48.795 |
| 41 | 6.744 | 4.349 | 48.795 |
| 42 | 6.655 | 4.039 | 48.795 |
| 43 | 6.532 | 3.740 | 48.795 |
| 44 | 6.369 | 3.443 | 48.795 |
| 45 | 6.176 | 3.166 | 48.795 |
| 46 | 5.956 | 2.908 | 48.795 |
| 47 | 5.716 | 2.670 | 48.795 |
| 48 | 5.457 | 2.452 | 48.795 |
| 49 | 5.184 | 2.253 | 48.795 |
| 50 | 4.899 | 2.071 | 48.795 |
| 51 | 4.604 | 1.906 | 48.795 |
| 52 | 4.126 | 1.674 | 48.795 |
| 53 | 3.635 | 1.473 | 48.795 |
| 54 | 3.134 | 1.296 | 48.795 |
| 55 | 2.627 | 1.138 | 48.795 |
| 56 | 1.758 | 0.900 | 48.795 |
| 57 | 0.884 | 0.686 | 48.795 |
| 58 | 0.007 | 0.483 | 48.795 |
| 59 | −1.153 | 0.221 | 48.795 |
| 60 | −1.335 | 0.179 | 48.795 |
| 61 | −1.517 | 0.138 | 48.795 |
| 62 | −1.699 | 0.097 | 48.795 |
| 63 | −1.881 | 0.056 | 48.795 |
| 64 | −2.065 | 0.026 | 48.795 |
| Section 14 | | | |
| Point 1 | −1.937 | 0.131 | 49.291 |
| 2 | −1.681 | 0.236 | 49.291 |
| 3 | −1.423 | 0.332 | 49.291 |
| 4 | −1.164 | 0.428 | 49.291 |
| 5 | −0.906 | 0.526 | 49.291 |
| 6 | −0.649 | 0.626 | 49.291 |
| 7 | −0.392 | 0.727 | 49.291 |
| 8 | 0.209 | 0.976 | 49.291 |
| 9 | 0.799 | 1.244 | 49.291 |
| 10 | 1.314 | 1.505 | 49.291 |
| 11 | 1.814 | 1.790 | 49.291 |
| 12 | 2.298 | 2.105 | 49.291 |
| 13 | 2.762 | 2.452 | 49.291 |
| 14 | 3.163 | 2.799 | 49.291 |
| 15 | 3.536 | 3.170 | 49.291 |
| 16 | 3.879 | 3.565 | 49.291 |
| 17 | 4.192 | 3.984 | 49.291 |
| 18 | 4.476 | 4.426 | 49.291 |
| 19 | 4.691 | 4.811 | 49.291 |
| 20 | 4.891 | 5.206 | 49.291 |
| 21 | 5.082 | 5.605 | 49.291 |
| 22 | 5.180 | 5.804 | 49.291 |

TABLE I-continued

Stage 1 Nozzle Airfoil Points (Cold)

| | Y (transv) | X (axial) | Z (ht) |
|---|---|---|---|
| 23 | 5.283 | 5.999 | 49.291 |
| 24 | 5.399 | 6.187 | 49.291 |
| 25 | 5.480 | 6.293 | 49.291 |
| 26 | 5.572 | 6.389 | 49.291 |
| 27 | 5.679 | 6.466 | 49.291 |
| 28 | 5.802 | 6.517 | 49.291 |
| 29 | 5.933 | 6.534 | 49.291 |
| 30 | 6.065 | 6.513 | 49.291 |
| 31 | 6.187 | 6.458 | 49.291 |
| 32 | 6.298 | 6.383 | 49.291 |
| 33 | 6.397 | 6.293 | 49.291 |
| 34 | 6.486 | 6.193 | 49.291 |
| 35 | 6.565 | 6.084 | 49.291 |
| 36 | 6.696 | 5.850 | 49.291 |
| 37 | 6.793 | 5.601 | 49.291 |
| 38 | 6.859 | 5.341 | 49.291 |
| 39 | 6.899 | 5.021 | 49.291 |
| 40 | 6.896 | 4.698 | 49.291 |
| 41 | 6.853 | 4.379 | 49.291 |
| 42 | 6.771 | 4.067 | 49.291 |
| 43 | 6.654 | 3.767 | 49.291 |
| 44 | 6.496 | 3.469 | 49.291 |
| 45 | 6.306 | 3.189 | 49.291 |
| 46 | 6.089 | 2.930 | 49.291 |
| 47 | 5.850 | 2.692 | 49.291 |
| 48 | 5.593 | 2.473 | 49.291 |
| 49 | 5.321 | 2.274 | 49.291 |
| 50 | 5.037 | 2.093 | 49.291 |
| 51 | 4.743 | 1.928 | 49.291 |
| 52 | 4.266 | 1.697 | 49.291 |
| 53 | 3.776 | 1.496 | 49.291 |
| 54 | 3.276 | 1.319 | 49.291 |
| 55 | 2.770 | 1.161 | 49.291 |
| 56 | 1.904 | 0.921 | 49.291 |
| 57 | 1.033 | 0.702 | 49.291 |
| 58 | 0.159 | 0.494 | 49.291 |
| 59 | −0.996 | 0.225 | 49.291 |
| 60 | −1.177 | 0.182 | 49.291 |
| 61 | −1.359 | 0.140 | 49.291 |
| 62 | −1.540 | 0.098 | 49.291 |
| 63 | −1.722 | 0.056 | 49.291 |
| 64 | −1.906 | 0.026 | 49.291 |
| Section 15 | | | |
| Point 1 | −1.751 | 0.131 | 49.786 |
| 2 | −1.498 | 0.236 | 49.786 |
| 3 | −1.241 | 0.333 | 49.786 |
| 4 | −0.983 | 0.430 | 49.786 |
| 5 | −0.727 | 0.528 | 49.786 |
| 6 | −0.471 | 0.628 | 49.786 |
| 7 | −0.216 | 0.730 | 49.786 |
| 8 | 0.380 | 0.982 | 49.786 |
| 9 | 0.965 | 1.254 | 49.786 |
| 10 | 1.474 | 1.519 | 49.786 |
| 11 | 1.969 | 1.809 | 49.786 |
| 12 | 2.447 | 2.126 | 49.786 |
| 13 | 2.908 | 2.473 | 49.786 |
| 14 | 3.307 | 2.817 | 49.786 |
| 15 | 3.678 | 3.186 | 49.786 |
| 16 | 4.017 | 3.579 | 49.786 |
| 17 | 4.326 | 3.997 | 49.786 |
| 18 | 4.603 | 4.440 | 49.786 |
| 19 | 4.813 | 4.825 | 49.786 |
| 20 | 5.005 | 5.221 | 49.786 |
| 21 | 5.187 | 5.622 | 49.786 |
| 22 | 5.281 | 5.821 | 49.786 |
| 23 | 5.380 | 6.017 | 49.786 |
| 24 | 5.493 | 6.205 | 49.786 |
| 25 | 5.571 | 6.312 | 49.786 |
| 26 | 5.663 | 6.408 | 49.786 |
| 27 | 5.768 | 6.485 | 49.786 |
| 28 | 5.890 | 6.536 | 49.786 |
| 29 | 6.020 | 6.553 | 49.786 |
| 30 | 6.152 | 6.532 | 49.786 |
| 31 | 6.275 | 6.479 | 49.786 |

TABLE I-continued

Stage 1 Nozzle Airfoil Points (Cold)

| | Y (transv) | X (axial) | Z (ht) |
|---|---|---|---|
| 32 | 6.386 | 6.405 | 49.786 |
| 33 | 6.487 | 6.317 | 49.786 |
| 34 | 6.578 | 6.219 | 49.786 |
| 35 | 6.660 | 6.113 | 49.786 |
| 36 | 6.797 | 5.883 | 49.786 |
| 37 | 6.903 | 5.637 | 49.786 |
| 38 | 6.977 | 5.379 | 49.786 |
| 39 | 7.026 | 5.061 | 49.786 |
| 40 | 7.033 | 4.739 | 49.786 |
| 41 | 6.998 | 4.418 | 49.786 |
| 42 | 6.924 | 4.105 | 49.786 |
| 43 | 6.812 | 3.804 | 49.786 |
| 44 | 6.659 | 3.503 | 49.786 |
| 45 | 6.472 | 3.221 | 49.786 |
| 46 | 6.258 | 2.961 | 49.786 |
| 47 | 6.021 | 2.721 | 49.786 |
| 48 | 5.765 | 2.502 | 49.786 |
| 49 | 5.493 | 2.302 | 49.786 |
| 50 | 5.209 | 2.121 | 49.786 |
| 51 | 4.915 | 1.957 | 49.786 |
| 52 | 4.439 | 1.727 | 49.786 |
| 53 | 3.948 | 1.527 | 49.786 |
| 54 | 3.449 | 1.351 | 49.786 |
| 55 | 2.944 | 1.191 | 49.786 |
| 56 | 2.080 | 0.946 | 49.786 |
| 57 | 1.212 | 0.721 | 49.786 |
| 58 | 0.340 | 0.505 | 49.786 |
| 59 | −0.812 | 0.228 | 49.786 |
| 60 | −0.993 | 0.185 | 49.786 |
| 61 | −1.174 | 0.142 | 49.786 |
| 62 | −1.355 | 0.099 | 49.786 |
| 63 | −1.536 | 0.057 | 49.786 |
| 64 | −1.720 | 0.026 | 49.786 |
| Section 16 | | | |
| Point 1 | −1.553 | 0.129 | 50.282 |
| 2 | −1.301 | 0.236 | 50.282 |
| 3 | −1.046 | 0.334 | 50.282 |
| 4 | −0.791 | 0.432 | 50.282 |
| 5 | −0.536 | 0.530 | 50.282 |
| 6 | −0.281 | 0.629 | 50.282 |
| 7 | −0.027 | 0.730 | 50.282 |
| 8 | 0.567 | 0.978 | 50.282 |
| 9 | 1.151 | 1.245 | 50.282 |
| 10 | 1.658 | 1.507 | 50.282 |
| 11 | 2.148 | 1.797 | 50.282 |
| 12 | 2.620 | 2.119 | 50.282 |
| 13 | 3.071 | 2.475 | 50.282 |
| 14 | 3.460 | 2.827 | 50.282 |
| 15 | 3.824 | 3.201 | 50.282 |
| 16 | 4.162 | 3.596 | 50.282 |
| 17 | 4.473 | 4.014 | 50.282 |
| 18 | 4.755 | 4.455 | 50.282 |
| 19 | 4.964 | 4.841 | 50.282 |
| 20 | 5.150 | 5.239 | 50.282 |
| 21 | 5.322 | 5.643 | 50.282 |
| 22 | 5.410 | 5.844 | 50.282 |
| 23 | 5.504 | 6.042 | 50.282 |
| 24 | 5.612 | 6.232 | 50.282 |
| 25 | 5.688 | 6.340 | 50.282 |
| 26 | 5.777 | 6.437 | 50.282 |
| 27 | 5.883 | 6.516 | 50.282 |
| 28 | 6.005 | 6.566 | 50.282 |
| 29 | 6.136 | 6.583 | 50.282 |
| 30 | 6.268 | 6.563 | 50.282 |
| 31 | 6.391 | 6.511 | 50.282 |
| 32 | 6.504 | 6.438 | 50.282 |
| 33 | 6.607 | 6.353 | 50.282 |
| 34 | 6.700 | 6.257 | 50.282 |
| 35 | 6.785 | 6.153 | 50.282 |
| 36 | 6.929 | 5.928 | 50.282 |
| 37 | 7.041 | 5.684 | 50.282 |
| 38 | 7.121 | 5.428 | 50.282 |
| 39 | 7.177 | 5.111 | 50.282 |
| 40 | 7.191 | 4.789 | 50.282 |

TABLE I-continued

Stage 1 Nozzle Airfoil Points (Cold)

| | Y (transv) | X (axial) | Z (ht) |
|---|---|---|---|
| 41 | 7.163 | 4.468 | 50.282 |
| 42 | 7.096 | 4.153 | 50.282 |
| 43 | 6.992 | 3.848 | 50.282 |
| 44 | 6.861 | 3.576 | 50.282 |
| 45 | 6.700 | 3.320 | 50.282 |
| 46 | 6.515 | 3.081 | 50.282 |
| 47 | 6.308 | 2.860 | 50.282 |
| 48 | 6.085 | 2.656 | 50.282 |
| 49 | 5.773 | 2.413 | 50.282 |
| 50 | 5.444 | 2.195 | 50.282 |
| 51 | 5.101 | 1.998 | 50.282 |
| 52 | 4.627 | 1.763 | 50.282 |
| 53 | 4.139 | 1.557 | 50.282 |
| 54 | 3.643 | 1.373 | 50.282 |
| 55 | 3.139 | 1.208 | 50.282 |
| 56 | 2.278 | 0.957 | 50.282 |
| 57 | 1.409 | 0.729 | 50.282 |
| 58 | 0.538 | 0.513 | 50.282 |
| 59 | −0.614 | 0.234 | 50.282 |
| 60 | −0.794 | 0.190 | 50.282 |
| 61 | −0.975 | 0.146 | 50.282 |
| 62 | −1.156 | 0.102 | 50.282 |
| 63 | −1.337 | 0.058 | 50.282 |
| 64 | −1.520 | 0.025 | 50.282 |
| Section 17 | | | |
| Point 1 | −1.353 | 0.126 | 50.778 |
| 2 | −1.102 | 0.236 | 50.778 |
| 3 | −0.848 | 0.336 | 50.778 |
| 4 | −0.593 | 0.435 | 50.778 |
| 5 | −0.338 | 0.535 | 50.778 |
| 6 | −0.083 | 0.634 | 50.778 |
| 7 | 0.172 | 0.735 | 50.778 |
| 8 | 0.768 | 0.979 | 50.778 |
| 9 | 1.354 | 1.242 | 50.778 |
| 10 | 1.864 | 1.501 | 50.778 |
| 11 | 2.358 | 1.788 | 50.778 |
| 12 | 2.832 | 2.111 | 50.778 |
| 13 | 3.282 | 2.473 | 50.778 |
| 14 | 3.664 | 2.831 | 50.778 |
| 15 | 4.015 | 3.214 | 50.778 |
| 16 | 4.338 | 3.621 | 50.778 |
| 17 | 4.632 | 4.051 | 50.778 |
| 18 | 4.901 | 4.502 | 50.778 |
| 19 | 5.105 | 4.890 | 50.778 |
| 20 | 5.293 | 5.286 | 50.778 |
| 21 | 5.469 | 5.687 | 50.778 |
| 22 | 5.558 | 5.887 | 50.778 |
| 23 | 5.652 | 6.086 | 50.778 |
| 24 | 5.758 | 6.277 | 50.778 |
| 25 | 5.854 | 6.410 | 50.778 |
| 26 | 5.972 | 6.524 | 50.778 |
| 27 | 6.066 | 6.580 | 50.778 |
| 28 | 6.169 | 6.615 | 50.778 |
| 29 | 6.278 | 6.627 | 50.778 |
| 30 | 6.410 | 6.605 | 50.778 |
| 31 | 6.532 | 6.552 | 50.778 |
| 32 | 6.645 | 6.479 | 50.778 |
| 33 | 6.747 | 6.393 | 50.778 |
| 34 | 6.841 | 6.297 | 50.778 |
| 35 | 6.926 | 6.194 | 50.778 |
| 36 | 7.072 | 5.969 | 50.778 |
| 37 | 7.190 | 5.729 | 50.778 |
| 38 | 7.280 | 5.476 | 50.778 |
| 39 | 7.348 | 5.161 | 50.778 |
| 40 | 7.373 | 4.839 | 50.778 |
| 41 | 7.354 | 4.516 | 50.778 |
| 42 | 7.291 | 4.200 | 50.778 |
| 43 | 7.186 | 3.895 | 50.778 |
| 44 | 7.053 | 3.623 | 50.778 |
| 45 | 6.890 | 3.369 | 50.778 |
| 46 | 6.702 | 3.131 | 50.778 |
| 47 | 6.494 | 2.912 | 50.778 |
| 48 | 6.270 | 2.708 | 50.778 |
| 49 | 5.958 | 2.465 | 50.778 |

TABLE I-continued

| Stage 1 Nozzle Airfoil Points (Cold) | | | |
|---|---|---|---|
| | Y (transv) | X (axial) | Z (ht) |
| 50 | 5.631 | 2.243 | 50.778 |
| 51 | 5.290 | 2.042 | 50.778 |
| 52 | 4.820 | 1.799 | 50.778 |
| 53 | 4.336 | 1.584 | 50.778 |
| 54 | 3.841 | 1.393 | 50.778 |
| 55 | 3.340 | 1.221 | 50.778 |
| 56 | 2.479 | 0.964 | 50.778 |
| 57 | 1.611 | 0.735 | 50.778 |
| 58 | 0.738 | 0.521 | 50.778 |
| 59 | −0.414 | 0.241 | 50.778 |
| 60 | −0.595 | 0.196 | 50.778 |
| 61 | −0.776 | 0.150 | 50.778 |
| 62 | −0.956 | 0.105 | 50.778 |
| 63 | −1.137 | 0.060 | 50.778 |
| 64 | −1.320 | 0.025 | 50.778 |
| Section 18 | | | |
| Point 1 | −1.152 | 0.122 | 51.274 |
| 2 | −0.903 | 0.236 | 51.274 |
| 3 | −0.648 | 0.338 | 51.274 |
| 4 | −0.393 | 0.439 | 51.274 |
| 5 | −0.138 | 0.540 | 51.274 |
| 6 | 0.117 | 0.640 | 51.274 |
| 7 | 0.372 | 0.740 | 51.274 |
| 8 | 0.971 | 0.982 | 51.274 |
| 9 | 1.561 | 1.242 | 51.274 |
| 10 | 1.973 | 1.443 | 51.274 |
| 11 | 2.375 | 1.664 | 51.274 |
| 12 | 2.765 | 1.907 | 51.274 |
| 13 | 3.141 | 2.176 | 51.274 |
| 14 | 3.499 | 2.472 | 51.274 |
| 15 | 3.877 | 2.835 | 51.274 |
| 16 | 4.224 | 3.224 | 51.274 |
| 17 | 4.540 | 3.640 | 51.274 |
| 18 | 4.826 | 4.080 | 51.274 |
| 19 | 5.084 | 4.541 | 51.274 |
| 20 | 5.277 | 4.936 | 51.274 |
| 21 | 5.454 | 5.338 | 51.274 |
| 22 | 5.624 | 5.743 | 51.274 |
| 23 | 5.712 | 5.945 | 51.274 |
| 24 | 5.805 | 6.143 | 51.274 |
| 25 | 5.913 | 6.334 | 51.274 |
| 26 | 6.011 | 6.467 | 51.274 |
| 27 | 6.130 | 6.580 | 51.274 |
| 28 | 6.224 | 6.636 | 51.274 |
| 29 | 6.328 | 6.671 | 51.274 |
| 30 | 6.437 | 6.682 | 51.274 |
| 31 | 6.549 | 6.664 | 51.274 |
| 32 | 6.654 | 6.624 | 51.274 |
| 33 | 6.752 | 6.568 | 51.274 |
| 34 | 6.844 | 6.503 | 51.274 |
| 35 | 6.976 | 6.384 | 51.274 |
| 36 | 7.095 | 6.253 | 51.274 |
| 37 | 7.250 | 6.034 | 51.274 |
| 38 | 7.377 | 5.797 | 51.274 |
| 39 | 7.474 | 5.546 | 51.274 |
| 40 | 7.540 | 5.284 | 51.274 |
| 41 | 7.572 | 5.016 | 51.274 |
| 42 | 7.573 | 4.746 | 51.274 |
| 43 | 7.542 | 4.477 | 51.274 |
| 44 | 7.481 | 4.215 | 51.274 |
| 45 | 7.390 | 3.961 | 51.274 |
| 46 | 7.255 | 3.689 | 51.274 |
| 47 | 7.091 | 3.434 | 51.274 |
| 48 | 6.902 | 3.197 | 51.274 |
| 49 | 6.693 | 2.976 | 51.274 |
| 50 | 6.469 | 2.772 | 51.274 |
| 51 | 6.158 | 2.526 | 51.274 |
| 52 | 5.832 | 2.300 | 51.274 |
| 53 | 5.494 | 2.092 | 51.274 |
| 54 | 5.026 | 1.840 | 51.274 |
| 55 | 4.544 | 1.616 | 51.274 |
| 56 | 4.052 | 1.416 | 51.274 |
| 57 | 3.551 | 1.237 | 51.274 |
| 58 | 2.906 | 1.035 | 51.274 |

TABLE I-continued

| Stage 1 Nozzle Airfoil Points (Cold) | | | |
|---|---|---|---|
| | Y (transv) | X (axial) | Z (ht) |
| 59 | 2.255 | 0.855 | 51.274 |
| 60 | 1.600 | 0.689 | 51.274 |
| 61 | 0.943 | 0.530 | 51.274 |
| 62 | −0.213 | 0.248 | 51.274 |
| 63 | −0.394 | 0.202 | 51.274 |
| 64 | −0.756 | 0.109 | 51.274 |
| 65 | −1.119 | 0.024 | 51.274 |
| Section 19 | | | |
| Point 1 | −0.952 | 0.119 | 51.770 |
| 2 | −0.738 | 0.221 | 51.770 |
| 3 | −0.301 | 0.400 | 51.770 |
| 4 | 0.139 | 0.575 | 51.770 |
| 5 | 0.579 | 0.748 | 51.770 |
| 6 | 1.183 | 0.990 | 51.770 |
| 7 | 1.779 | 1.246 | 51.770 |
| 8 | 2.195 | 1.447 | 51.770 |
| 9 | 2.601 | 1.666 | 51.770 |
| 10 | 2.993 | 1.910 | 51.770 |
| 11 | 3.370 | 2.181 | 51.770 |
| 12 | 3.728 | 2.480 | 51.770 |
| 13 | 4.103 | 2.851 | 51.770 |
| 14 | 4.444 | 3.249 | 51.770 |
| 15 | 4.752 | 3.674 | 51.770 |
| 16 | 5.029 | 4.125 | 51.770 |
| 17 | 5.275 | 4.595 | 51.770 |
| 18 | 5.458 | 4.996 | 51.770 |
| 19 | 5.627 | 5.404 | 51.770 |
| 20 | 5.789 | 5.814 | 51.770 |
| 21 | 5.874 | 6.018 | 51.770 |
| 22 | 5.967 | 6.218 | 51.770 |
| 23 | 6.076 | 6.409 | 51.770 |
| 24 | 6.154 | 6.515 | 51.770 |
| 25 | 6.247 | 6.609 | 51.770 |
| 26 | 6.357 | 6.683 | 51.770 |
| 27 | 6.480 | 6.729 | 51.770 |
| 28 | 6.611 | 6.745 | 51.770 |
| 29 | 6.724 | 6.727 | 51.770 |
| 30 | 6.830 | 6.687 | 51.770 |
| 31 | 6.929 | 6.632 | 51.770 |
| 32 | 7.022 | 6.567 | 51.770 |
| 33 | 7.156 | 6.450 | 51.770 |
| 34 | 7.277 | 6.320 | 51.770 |
| 35 | 7.437 | 6.103 | 51.770 |
| 36 | 7.569 | 5.868 | 51.770 |
| 37 | 7.670 | 5.618 | 51.770 |
| 38 | 7.740 | 5.357 | 51.770 |
| 39 | 7.776 | 5.089 | 51.770 |
| 40 | 7.778 | 4.819 | 51.770 |
| 41 | 7.748 | 4.550 | 51.770 |
| 42 | 7.686 | 4.286 | 51.770 |
| 43 | 7.595 | 4.032 | 51.770 |
| 44 | 7.460 | 3.758 | 51.770 |
| 45 | 7.295 | 3.503 | 51.770 |
| 46 | 7.105 | 3.265 | 51.770 |
| 47 | 6.895 | 3.044 | 51.770 |
| 48 | 6.671 | 2.838 | 51.770 |
| 49 | 6.361 | 2.589 | 51.770 |
| 50 | 6.037 | 2.358 | 51.770 |
| 51 | 5.701 | 2.144 | 51.770 |
| 52 | 5.236 | 1.882 | 51.770 |
| 53 | 4.757 | 1.647 | 51.770 |
| 54 | 4.266 | 1.438 | 51.770 |
| 55 | 3.766 | 1.253 | 51.770 |
| 56 | 3.120 | 1.046 | 51.770 |
| 57 | 2.466 | 0.863 | 51.770 |
| 58 | 1.809 | 0.698 | 51.770 |
| 59 | 1.149 | 0.539 | 51.770 |
| 60 | 0.631 | 0.415 | 51.770 |
| 61 | 0.114 | 0.286 | 51.770 |
| 62 | −0.402 | 0.152 | 51.770 |
| 63 | −0.919 | 0.023 | 51.770 |

wherein Z is a height from a plane through a horizontal centerline of the turbine and X and Y are coordinate values defining the profile at each distance Z from a plane through the horizontal centerline of the turbine, said values being in inches and having a tolerance of +0.165 to −0.135.

2. An airfoil according to claim 1 including a thermal barrier coating on said airfoil.

3. An airfoil according to claim 1 wherein said airfoil has a plurality of cavities within the airfoil extending substantially the entire length of the airfoil.

4. An airfoil according to claim 1 having an outer wall and an inner wall defining with said airfoil an airfoil segment.

5. An airfoil according to claim 4 wherein an inner diameter and an outer diameter of the inner outer walls, respectively, have profiles at ambient temperature substantially in accordance with Cartesian coordinate values of X, Y and Z as set forth in Table II as follows:

TABLE II

| Radial Gaspath points (Cylindrical sweep) | | | |
|---|---|---|---|
| Annulus | | X (axial) | Z (ht) |
| OD 1 | 0.000 | +7.910 | 52.123 |
| OD 2 | 0.000 | +6.717 | 51.802 |
| OD 3 | 0.000 | +5.373 | 51.439 |
| OD 4 | 0.000 | +4.030 | 51.054 |
| OD 5 | 0.000 | +2.687 | 50.590 |
| OD 6 | 0.000 | +1.343 | 50.199 |
| OD 7 | 0.000 | 0.000 | 50.035 |
| OD 8 | 0.000 | −0.500 | 50.035 |
| ID 1 | 0.000 | +8.277 | 43.533 |
| ID 2 | 0.000 | 0.000 | 43.533 |
| ID 3 | 0.000 | −0.500 | 43.533 |

wherein Z is a height from a plane through the horizontal centerline of the turbine and X and Y are coordinate values defining the inner and outer radii of the inner and outer walls at each distance Z from the plane through the horizontal centerline of the turbine, said values of Table II being in inches and having a tolerance of +0.165 to −0.135.

6. A nozzle stage for a gas turbine comprising:

forty-two airfoils spaced equally one from the other about a horizontal centerline of the gas turbine, each said airfoil having a profile at ambient temperature substantially in accordance with Cartesian coordinate values of X, Y and Z set forth in Table I as follows:

TABLE I

| Stage 1 Nozzle Airfoil Points (Cold) | | | |
|---|---|---|---|
| | Y (transv) | X (axial) | Z (ht) |
| Section 1 | | | |
| Point 1 | 0.929 | 0.153 | 42.845 |
| 2 | 1.235 | 0.368 | 42.845 |
| 3 | 1.551 | 0.571 | 42.845 |
| 4 | 1.876 | 0.762 | 42.845 |
| 5 | 2.199 | 0.955 | 42.845 |
| 6 | 2.507 | 1.167 | 42.845 |
| 7 | 2.805 | 1.393 | 42.845 |
| 8 | 3.086 | 1.643 | 42.845 |
| 9 | 3.444 | 2.023 | 42.845 |
| 10 | 3.784 | 2.423 | 42.845 |
| 11 | 4.108 | 2.835 | 42.845 |
| 12 | 4.420 | 3.256 | 42.845 |
| 13 | 4.758 | 3.747 | 42.845 |
| 14 | 5.072 | 4.253 | 42.845 |
| 15 | 5.350 | 4.774 | 42.845 |
| 16 | 5.588 | 5.313 | 42.845 |

TABLE I-continued

| Stage 1 Nozzle Airfoil Points (Cold) | | | |
|---|---|---|---|
| | Y (transv) | X (axial) | Z (ht) |
| 17 | 5.785 | 5.871 | 42.845 |
| 18 | 5.949 | 6.443 | 42.845 |
| 19 | 6.003 | 6.634 | 42.845 |
| 20 | 6.063 | 6.824 | 42.845 |
| 21 | 6.139 | 7.008 | 42.845 |
| 22 | 6.189 | 7.095 | 42.845 |
| 23 | 6.250 | 7.174 | 42.845 |
| 24 | 6.326 | 7.239 | 42.845 |
| 25 | 6.417 | 7.283 | 42.845 |
| 26 | 6.515 | 7.303 | 42.845 |
| 27 | 6.616 | 7.304 | 42.845 |
| 28 | 6.711 | 7.282 | 42.845 |
| 29 | 6.799 | 7.240 | 42.845 |
| 30 | 6.881 | 7.188 | 42.845 |
| 31 | 6.958 | 7.128 | 42.845 |
| 32 | 7.068 | 7.022 | 42.845 |
| 33 | 7.167 | 6.906 | 42.845 |
| 34 | 7.297 | 6.715 | 42.845 |
| 35 | 7.403 | 6.509 | 42.845 |
| 36 | 7.485 | 6.293 | 42.845 |
| 37 | 7.551 | 6.023 | 42.845 |
| 38 | 7.584 | 5.747 | 42.845 |
| 39 | 7.583 | 5.469 | 42.845 |
| 40 | 7.550 | 5.192 | 42.845 |
| 41 | 7.488 | 4.921 | 42.845 |
| 42 | 7.380 | 4.612 | 42.845 |
| 43 | 7.240 | 4.316 | 42.845 |
| 44 | 7.072 | 4.035 | 42.845 |
| 45 | 6.881 | 3.770 | 42.845 |
| 46 | 6.671 | 3.520 | 42.845 |
| 47 | 6.445 | 3.284 | 42.845 |
| 48 | 6.206 | 3.062 | 42.845 |
| 49 | 5.957 | 2.851 | 42.845 |
| 50 | 5.549 | 2.541 | 42.845 |
| 51 | 5.125 | 2.252 | 42.845 |
| 52 | 4.691 | 1.981 | 42.845 |
| 53 | 4.248 | 1.723 | 42.845 |
| 54 | 3.715 | 1.426 | 42.845 |
| 55 | 3.178 | 1.137 | 42.845 |
| 56 | 2.639 | 0.853 | 42.845 |
| 57 | 2.098 | 0.572 | 42.845 |
| 58 | 1.556 | 0.291 | 42.845 |
| 59 | 1.012 | 0.016 | 42.845 |
| Section 2 | | | |
| Point 1 | 0.191 | 0.145 | 43.341 |
| 2 | 0.578 | 0.391 | 43.341 |
| 3 | 0.972 | 0.625 | 43.341 |
| 4 | 1.370 | 0.851 | 43.341 |
| 5 | 1.765 | 1.082 | 43.341 |
| 6 | 2.148 | 1.327 | 43.341 |
| 7 | 2.515 | 1.593 | 43.341 |
| 8 | 2.929 | 1.930 | 43.341 |
| 9 | 3.326 | 2.288 | 43.341 |
| 10 | 3.710 | 2.663 | 43.341 |
| 11 | 4.077 | 3.058 | 43.341 |
| 12 | 4.393 | 3.432 | 43.341 |
| 13 | 4.686 | 3.820 | 43.341 |
| 14 | 4.952 | 4.224 | 43.341 |
| 15 | 5.189 | 4.646 | 43.341 |
| 16 | 5.394 | 5.087 | 43.341 |
| 17 | 5.542 | 5.469 | 43.341 |
| 18 | 5.672 | 5.860 | 43.341 |
| 19 | 5.792 | 6.254 | 43.341 |
| 20 | 5.854 | 6.451 | 43.341 |
| 21 | 5.922 | 6.646 | 43.341 |
| 22 | 6.005 | 6.835 | 43.341 |
| 23 | 6.058 | 6.925 | 43.341 |
| 24 | 6.120 | 7.010 | 43.341 |
| 25 | 6.196 | 7.083 | 43.341 |
| 26 | 6.284 | 7.139 | 43.341 |
| 27 | 6.383 | 7.172 | 43.341 |
| 28 | 6.488 | 7.179 | 43.341 |
| 29 | 6.587 | 7.159 | 43.341 |
| 30 | 6.680 | 7.116 | 43.341 |

TABLE I-continued

Stage 1 Nozzle Airfoil Points (Cold)

| | Y (transv) | X (axial) | Z (ht) |
|---|---|---|---|
| 31 | 6.765 | 7.061 | 43.341 |
| 32 | 6.844 | 6.998 | 43.341 |
| 33 | 6.957 | 6.885 | 43.341 |
| 34 | 7.056 | 6.761 | 43.341 |
| 35 | 7.184 | 6.556 | 43.341 |
| 36 | 7.284 | 6.336 | 43.341 |
| 37 | 7.358 | 6.106 | 43.341 |
| 38 | 7.413 | 5.821 | 43.341 |
| 39 | 7.431 | 5.532 | 43.341 |
| 40 | 7.414 | 5.242 | 43.341 |
| 41 | 7.365 | 4.956 | 43.341 |
| 42 | 7.286 | 4.677 | 43.341 |
| 43 | 7.159 | 4.360 | 43.341 |
| 44 | 6.999 | 4.058 | 43.341 |
| 45 | 6.811 | 3.773 | 43.341 |
| 46 | 6.599 | 3.506 | 43.341 |
| 47 | 6.367 | 3.257 | 43.341 |
| 48 | 6.119 | 3.024 | 43.341 |
| 49 | 5.857 | 2.807 | 43.341 |
| 50 | 5.583 | 2.604 | 43.341 |
| 51 | 5.135 | 2.309 | 43.341 |
| 52 | 4.673 | 2.040 | 43.341 |
| 53 | 4.210 | 1.795 | 43.341 |
| 54 | 3.743 | 1.565 | 43.341 |
| 55 | 2.884 | 1.165 | 43.341 |
| 56 | 2.010 | 0.773 | 43.341 |
| 57 | 1.137 | 0.391 | 43.341 |
| 58 | 0.258 | 0.018 | 43.341 |
| Section 3 | | | |
| Point 1 | −0.544 | 0.140 | 43.836 |
| 2 | −0.048 | 0.419 | 43.836 |
| 3 | 0.453 | 0.688 | 43.836 |
| 4 | 0.960 | 0.947 | 43.836 |
| 5 | 1.462 | 1.215 | 43.836 |
| 6 | 1.950 | 1.508 | 43.836 |
| 7 | 2.416 | 1.817 | 43.836 |
| 8 | 2.866 | 2.147 | 43.836 |
| 9 | 3.296 | 2.498 | 43.836 |
| 10 | 3.703 | 2.871 | 43.836 |
| 11 | 4.051 | 3.234 | 43.836 |
| 12 | 4.376 | 3.620 | 43.836 |
| 13 | 4.676 | 4.033 | 43.836 |
| 14 | 4.943 | 4.470 | 43.836 |
| 15 | 5.172 | 4.926 | 43.836 |
| 16 | 5.337 | 5.319 | 43.836 |
| 17 | 5.481 | 5.722 | 43.836 |
| 18 | 5.610 | 6.130 | 43.836 |
| 19 | 5.676 | 6.333 | 43.836 |
| 20 | 5.748 | 6.535 | 43.836 |
| 21 | 5.835 | 6.730 | 43.836 |
| 22 | 5.890 | 6.822 | 43.836 |
| 23 | 5.957 | 6.906 | 43.836 |
| 24 | 6.038 | 6.977 | 43.836 |
| 25 | 6.132 | 7.029 | 43.836 |
| 26 | 6.235 | 7.058 | 43.836 |
| 27 | 6.342 | 7.067 | 43.836 |
| 28 | 6.445 | 7.044 | 43.836 |
| 29 | 6.539 | 6.996 | 43.836 |
| 30 | 6.625 | 6.936 | 43.836 |
| 31 | 6.704 | 6.868 | 43.836 |
| 32 | 6.816 | 6.747 | 43.836 |
| 33 | 6.915 | 6.615 | 43.836 |
| 34 | 7.039 | 6.399 | 43.836 |
| 35 | 7.133 | 6.168 | 43.836 |
| 36 | 7.198 | 5.927 | 43.836 |
| 37 | 7.238 | 5.630 | 43.836 |
| 38 | 7.238 | 5.330 | 43.836 |
| 39 | 7.201 | 5.033 | 43.836 |
| 40 | 7.131 | 4.741 | 43.836 |
| 41 | 7.031 | 4.459 | 43.836 |
| 42 | 6.880 | 4.140 | 43.836 |
| 43 | 6.698 | 3.837 | 43.836 |
| 44 | 6.490 | 3.553 | 43.836 |
| 45 | 6.259 | 3.287 | 43.836 |

TABLE I-continued

Stage 1 Nozzle Airfoil Points (Cold)

| | Y (transv) | X (axial) | Z (ht) |
|---|---|---|---|
| 46 | 6.010 | 3.038 | 43.836 |
| 47 | 5.746 | 2.806 | 43.836 |
| 48 | 5.467 | 2.591 | 43.836 |
| 49 | 5.178 | 2.391 | 43.836 |
| 50 | 4.705 | 2.106 | 43.836 |
| 51 | 4.215 | 1.850 | 43.836 |
| 52 | 3.714 | 1.617 | 43.836 |
| 53 | 3.206 | 1.401 | 43.836 |
| 54 | 2.289 | 1.037 | 43.836 |
| 55 | 1.367 | 0.688 | 43.836 |
| 56 | 0.442 | 0.347 | 43.836 |
| 57 | −0.487 | 0.015 | 43.836 |
| Section 4 | | | |
| Point 1 | −1.158 | 0.139 | 44.332 |
| 2 | −0.627 | 0.397 | 44.332 |
| 3 | −0.089 | 0.641 | 44.332 |
| 4 | 0.453 | 0.877 | 44.332 |
| 5 | 0.987 | 1.131 | 44.332 |
| 6 | 1.507 | 1.412 | 44.332 |
| 7 | 2.002 | 1.711 | 44.332 |
| 8 | 2.478 | 2.033 | 44.332 |
| 9 | 2.934 | 2.381 | 44.332 |
| 10 | 3.369 | 2.757 | 44.332 |
| 11 | 3.744 | 3.124 | 44.332 |
| 12 | 4.096 | 3.519 | 44.332 |
| 13 | 4.417 | 3.935 | 44.332 |
| 14 | 4.704 | 4.370 | 44.332 |
| 15 | 4.954 | 4.824 | 44.332 |
| 16 | 5.137 | 5.216 | 44.332 |
| 17 | 5.298 | 5.619 | 44.332 |
| 18 | 5.444 | 6.031 | 44.332 |
| 19 | 5.517 | 6.237 | 44.332 |
| 20 | 5.595 | 6.440 | 44.332 |
| 21 | 5.691 | 6.636 | 44.332 |
| 22 | 5.750 | 6.727 | 44.332 |
| 23 | 5.821 | 6.809 | 44.332 |
| 24 | 5.906 | 6.878 | 44.332 |
| 25 | 6.003 | 6.927 | 44.332 |
| 26 | 6.108 | 6.956 | 44.332 |
| 27 | 6.216 | 6.965 | 44.332 |
| 28 | 6.322 | 6.941 | 44.332 |
| 29 | 6.418 | 6.892 | 44.332 |
| 30 | 6.506 | 6.829 | 44.332 |
| 31 | 6.587 | 6.757 | 44.332 |
| 32 | 6.702 | 6.632 | 44.332 |
| 33 | 6.801 | 6.494 | 44.332 |
| 34 | 6.924 | 6.267 | 44.332 |
| 35 | 7.015 | 6.025 | 44.332 |
| 36 | 7.074 | 5.774 | 44.332 |
| 37 | 7.105 | 5.466 | 44.332 |
| 38 | 7.094 | 5.156 | 44.332 |
| 39 | 7.044 | 4.849 | 44.332 |
| 40 | 6.961 | 4.550 | 44.332 |
| 41 | 6.846 | 4.262 | 44.332 |
| 42 | 6.677 | 3.939 | 44.332 |
| 43 | 6.477 | 3.635 | 44.332 |
| 44 | 6.250 | 3.351 | 44.332 |
| 45 | 6.000 | 3.086 | 44.332 |
| 46 | 5.732 | 2.841 | 44.332 |
| 47 | 5.448 | 2.614 | 44.332 |
| 48 | 5.151 | 2.404 | 44.332 |
| 49 | 4.844 | 2.211 | 44.332 |
| 50 | 4.343 | 1.936 | 44.332 |
| 51 | 3.827 | 1.693 | 44.332 |
| 52 | 3.300 | 1.474 | 44.332 |
| 53 | 2.766 | 1.273 | 44.332 |
| 54 | 1.803 | 0.939 | 44.332 |
| 55 | 0.835 | 0.622 | 44.332 |
| 56 | −0.137 | 0.315 | 44.332 |
| 57 | −1.111 | 0.019 | 44.332 |
| Section 5 | | | |
| Point 1 | −1.621 | 0.137 | 44.828 |
| 2 | −1.159 | 0.335 | 44.828 |

TABLE I-continued

Stage 1 Nozzle Airfoil Points (Cold)

| | Y (transv) | X (axial) | Z (ht) |
|---|---|---|---|
| 3 | −0.695 | 0.528 | 44.828 |
| 4 | −0.231 | 0.720 | 44.828 |
| 5 | 0.230 | 0.920 | 44.828 |
| 6 | 0.685 | 1.132 | 44.828 |
| 7 | 1.130 | 1.357 | 44.828 |
| 8 | 1.642 | 1.643 | 44.828 |
| 9 | 2.137 | 1.953 | 44.828 |
| 10 | 2.615 | 2.289 | 44.828 |
| 11 | 3.073 | 2.656 | 44.828 |
| 12 | 3.469 | 3.019 | 44.828 |
| 13 | 3.842 | 3.411 | 44.828 |
| 14 | 4.184 | 3.824 | 44.828 |
| 15 | 4.491 | 4.257 | 44.828 |
| 16 | 4.763 | 4.710 | 44.828 |
| 17 | 4.965 | 5.103 | 44.828 |
| 18 | 5.147 | 5.507 | 44.828 |
| 19 | 5.313 | 5.921 | 44.828 |
| 20 | 5.396 | 6.127 | 44.828 |
| 21 | 5.484 | 6.332 | 44.828 |
| 22 | 5.585 | 6.528 | 44.828 |
| 23 | 5.646 | 6.620 | 44.828 |
| 24 | 5.716 | 6.704 | 44.828 |
| 25 | 5.800 | 6.776 | 44.828 |
| 26 | 5.896 | 6.830 | 44.828 |
| 27 | 6.002 | 6.864 | 44.828 |
| 28 | 6.113 | 6.873 | 44.828 |
| 29 | 6.221 | 6.849 | 44.828 |
| 30 | 6.320 | 6.800 | 44.828 |
| 31 | 6.410 | 6.735 | 44.828 |
| 32 | 6.493 | 6.661 | 44.828 |
| 33 | 6.608 | 6.531 | 44.828 |
| 34 | 6.707 | 6.387 | 44.828 |
| 35 | 6.828 | 6.153 | 44.828 |
| 36 | 6.916 | 5.903 | 44.828 |
| 37 | 6.970 | 5.645 | 44.828 |
| 38 | 6.993 | 5.328 | 44.828 |
| 39 | 6.974 | 5.011 | 44.828 |
| 40 | 6.916 | 4.698 | 44.828 |
| 41 | 6.823 | 4.395 | 44.828 |
| 42 | 6.698 | 4.103 | 44.828 |
| 43 | 6.516 | 3.777 | 44.828 |
| 44 | 6.303 | 3.471 | 44.828 |
| 45 | 6.062 | 3.187 | 44.828 |
| 46 | 5.799 | 2.924 | 44.828 |
| 47 | 5.516 | 2.681 | 44.828 |
| 48 | 5.218 | 2.458 | 44.828 |
| 49 | 4.907 | 2.254 | 44.828 |
| 50 | 4.586 | 2.067 | 44.828 |
| 51 | 4.064 | 1.803 | 44.828 |
| 52 | 3.528 | 1.571 | 44.828 |
| 53 | 2.981 | 1.365 | 44.828 |
| 54 | 2.428 | 1.176 | 44.828 |
| 55 | 1.432 | 0.866 | 44.828 |
| 56 | 0.431 | 0.574 | 44.828 |
| 57 | −0.574 | 0.292 | 44.828 |
| 58 | −1.581 | 0.020 | 44.828 |
| Section 6 | | | |
| Point 1 | −1.961 | 0.138 | 45.324 |
| 2 | −1.492 | 0.320 | 45.324 |
| 3 | −1.023 | 0.502 | 45.324 |
| 4 | −0.555 | 0.689 | 45.324 |
| 5 | −0.092 | 0.885 | 45.324 |
| 6 | 0.366 | 1.089 | 45.324 |
| 7 | 0.817 | 1.306 | 45.324 |
| 8 | 1.338 | 1.578 | 45.324 |
| 9 | 1.844 | 1.874 | 45.324 |
| 10 | 2.333 | 2.196 | 45.324 |
| 11 | 2.804 | 2.548 | 45.324 |
| 12 | 3.213 | 2.899 | 45.324 |
| 13 | 3.602 | 3.282 | 45.324 |
| 14 | 3.962 | 3.690 | 45.324 |
| 15 | 4.290 | 4.123 | 45.324 |
| 16 | 4.586 | 4.581 | 45.324 |
| 17 | 4.808 | 4.978 | 45.324 |

TABLE I-continued

Stage 1 Nozzle Airfoil Points (Cold)

| | Y (transv) | X (axial) | Z (ht) |
|---|---|---|---|
| 18 | 5.009 | 5.388 | 45.324 |
| 19 | 5.194 | 5.805 | 45.324 |
| 20 | 5.286 | 6.014 | 45.324 |
| 21 | 5.381 | 6.221 | 45.324 |
| 22 | 5.489 | 6.423 | 45.324 |
| 23 | 5.552 | 6.518 | 45.324 |
| 24 | 5.624 | 6.607 | 45.324 |
| 25 | 5.708 | 6.684 | 45.324 |
| 26 | 5.806 | 6.744 | 45.324 |
| 27 | 5.914 | 6.781 | 45.324 |
| 28 | 6.027 | 6.791 | 45.324 |
| 29 | 6.138 | 6.768 | 45.324 |
| 30 | 6.239 | 6.718 | 45.324 |
| 31 | 6.331 | 6.653 | 45.324 |
| 32 | 6.414 | 6.577 | 45.324 |
| 33 | 6.531 | 6.444 | 45.324 |
| 34 | 6.630 | 6.297 | 45.324 |
| 35 | 6.749 | 6.057 | 45.324 |
| 36 | 6.833 | 5.802 | 45.324 |
| 37 | 6.884 | 5.538 | 45.324 |
| 38 | 6.902 | 5.216 | 45.324 |
| 39 | 6.878 | 4.894 | 45.324 |
| 40 | 6.814 | 4.577 | 45.324 |
| 41 | 6.714 | 4.270 | 45.324 |
| 42 | 6.582 | 3.975 | 45.324 |
| 43 | 6.413 | 3.680 | 45.324 |
| 44 | 6.218 | 3.403 | 45.324 |
| 45 | 6.000 | 3.143 | 45.324 |
| 46 | 5.762 | 2.901 | 45.324 |
| 47 | 5.507 | 2.677 | 45.324 |
| 48 | 5.152 | 2.410 | 45.324 |
| 49 | 4.779 | 2.170 | 45.324 |
| 50 | 4.391 | 1.954 | 45.324 |
| 51 | 3.855 | 1.699 | 45.324 |
| 52 | 3.304 | 1.477 | 45.324 |
| 53 | 2.743 | 1.280 | 45.324 |
| 54 | 2.176 | 1.101 | 45.324 |
| 55 | 1.497 | 0.904 | 45.324 |
| 56 | 0.815 | 0.718 | 45.324 |
| 57 | 0.132 | 0.538 | 45.324 |
| 58 | −0.553 | 0.362 | 45.324 |
| 59 | −1.239 | 0.188 | 45.324 |
| 60 | −1.926 | 0.022 | 45.324 |
| Section 7 | | | |
| Point 1 | −2.176 | 0.137 | 45.820 |
| 2 | −1.702 | 0.314 | 45.820 |
| 3 | −1.227 | 0.491 | 45.820 |
| 4 | −0.756 | 0.676 | 45.820 |
| 5 | −0.288 | 0.869 | 45.820 |
| 6 | 0.175 | 1.072 | 45.820 |
| 7 | 0.632 | 1.285 | 45.820 |
| 8 | 1.161 | 1.553 | 45.820 |
| 9 | 1.676 | 1.842 | 45.820 |
| 10 | 2.174 | 2.158 | 45.820 |
| 11 | 2.653 | 2.505 | 45.820 |
| 12 | 3.070 | 2.851 | 45.820 |
| 13 | 3.466 | 3.229 | 45.820 |
| 14 | 3.833 | 3.635 | 45.820 |
| 15 | 4.169 | 4.065 | 45.820 |
| 16 | 4.473 | 4.520 | 45.820 |
| 17 | 4.704 | 4.916 | 45.820 |
| 18 | 4.914 | 5.323 | 45.820 |
| 19 | 5.109 | 5.737 | 45.820 |
| 20 | 5.207 | 5.944 | 45.820 |
| 21 | 5.308 | 6.150 | 45.820 |
| 22 | 5.420 | 6.350 | 45.820 |
| 23 | 5.484 | 6.445 | 45.820 |
| 24 | 5.557 | 6.534 | 45.820 |
| 25 | 5.641 | 6.612 | 45.820 |
| 26 | 5.738 | 6.672 | 45.820 |
| 27 | 5.846 | 6.710 | 45.820 |
| 28 | 5.960 | 6.720 | 45.820 |
| 29 | 6.071 | 6.699 | 45.820 |
| 30 | 6.174 | 6.651 | 45.820 |

TABLE I-continued

Stage 1 Nozzle Airfoil Points (Cold)

| | Y (transv) | X (axial) | Z (ht) |
|---|---|---|---|
| 31 | 6.267 | 6.585 | 45.820 |
| 32 | 6.352 | 6.509 | 45.820 |
| 33 | 6.469 | 6.375 | 45.820 |
| 34 | 6.568 | 6.226 | 45.820 |
| 35 | 6.687 | 5.982 | 45.820 |
| 36 | 6.769 | 5.724 | 45.820 |
| 37 | 6.818 | 5.457 | 45.820 |
| 38 | 6.834 | 5.132 | 45.820 |
| 39 | 6.806 | 4.807 | 45.820 |
| 40 | 6.739 | 4.488 | 45.820 |
| 41 | 6.636 | 4.179 | 45.820 |
| 42 | 6.501 | 3.883 | 45.820 |
| 43 | 6.328 | 3.586 | 45.820 |
| 44 | 6.127 | 3.308 | 45.820 |
| 45 | 5.904 | 3.049 | 45.820 |
| 46 | 5.660 | 2.808 | 45.820 |
| 47 | 5.400 | 2.586 | 45.820 |
| 48 | 5.038 | 2.322 | 45.820 |
| 49 | 4.657 | 2.085 | 45.820 |
| 50 | 4.262 | 1.874 | 45.820 |
| 51 | 3.717 | 1.626 | 45.820 |
| 52 | 3.157 | 1.410 | 45.820 |
| 53 | 2.588 | 1.220 | 45.820 |
| 54 | 2.013 | 1.049 | 45.820 |
| 55 | 1.424 | 0.887 | 45.820 |
| 56 | 0.831 | 0.734 | 45.820 |
| 57 | 0.238 | 0.586 | 45.820 |
| 58 | −0.356 | 0.441 | 45.820 |
| 59 | −0.951 | 0.297 | 45.820 |
| 60 | −1.546 | 0.157 | 45.820 |
| 61 | −2.143 | 0.023 | 45.820 |
| Section 8 | | | |
| Point 1 | −2.307 | 0.137 | 46.316 |
| 2 | −1.986 | 0.256 | 46.316 |
| 3 | −1.662 | 0.372 | 46.316 |
| 4 | −1.340 | 0.491 | 46.316 |
| 5 | −1.020 | 0.613 | 46.316 |
| 6 | −0.700 | 0.740 | 46.316 |
| 7 | −0.078 | 1.000 | 46.316 |
| 8 | 0.536 | 1.279 | 46.316 |
| 9 | 1.073 | 1.546 | 46.316 |
| 10 | 1.597 | 1.835 | 46.316 |
| 11 | 2.104 | 2.151 | 46.316 |
| 12 | 2.592 | 2.499 | 46.316 |
| 13 | 3.015 | 2.847 | 46.316 |
| 14 | 3.413 | 3.225 | 46.316 |
| 15 | 3.779 | 3.627 | 46.316 |
| 16 | 4.111 | 4.052 | 46.316 |
| 17 | 4.411 | 4.500 | 46.316 |
| 18 | 4.639 | 4.888 | 46.316 |
| 19 | 4.849 | 5.289 | 46.316 |
| 20 | 5.048 | 5.697 | 46.316 |
| 21 | 5.148 | 5.902 | 46.316 |
| 22 | 5.251 | 6.104 | 46.316 |
| 23 | 5.366 | 6.299 | 46.316 |
| 24 | 5.432 | 6.393 | 46.316 |
| 25 | 5.506 | 6.479 | 46.316 |
| 26 | 5.592 | 6.555 | 46.316 |
| 27 | 5.690 | 6.613 | 46.316 |
| 28 | 5.798 | 6.650 | 46.316 |
| 29 | 5.912 | 6.661 | 46.316 |
| 30 | 6.012 | 6.645 | 46.316 |
| 31 | 6.107 | 6.607 | 46.316 |
| 32 | 6.193 | 6.552 | 46.316 |
| 33 | 6.273 | 6.488 | 46.316 |
| 34 | 6.411 | 6.338 | 46.316 |
| 35 | 6.525 | 6.169 | 46.316 |
| 36 | 6.642 | 5.923 | 46.316 |
| 37 | 6.724 | 5.663 | 46.316 |
| 38 | 6.771 | 5.395 | 46.316 |
| 39 | 6.785 | 5.068 | 46.316 |
| 40 | 6.756 | 4.741 | 46.316 |
| 41 | 6.687 | 4.421 | 46.316 |
| 42 | 6.583 | 4.111 | 46.316 |

TABLE I-continued

Stage 1 Nozzle Airfoil Points (Cold)

| | Y (transv) | X (axial) | Z (ht) |
|---|---|---|---|
| 43 | 6.446 | 3.814 | 46.316 |
| 44 | 6.271 | 3.517 | 46.316 |
| 45 | 6.068 | 3.239 | 46.316 |
| 46 | 5.841 | 2.980 | 46.316 |
| 47 | 5.595 | 2.740 | 46.316 |
| 48 | 5.331 | 2.519 | 46.316 |
| 49 | 4.964 | 2.258 | 46.316 |
| 50 | 4.579 | 2.024 | 46.316 |
| 51 | 4.180 | 1.816 | 46.316 |
| 52 | 3.629 | 1.573 | 46.316 |
| 53 | 3.065 | 1.362 | 46.316 |
| 54 | 2.491 | 1.178 | 46.316 |
| 55 | 1.911 | 1.011 | 46.316 |
| 56 | 1.317 | 0.855 | 46.316 |
| 57 | 0.720 | 0.708 | 46.316 |
| 58 | 0.123 | 0.566 | 46.316 |
| 59 | −0.476 | 0.426 | 46.316 |
| 60 | −1.075 | 0.287 | 46.316 |
| 61 | −1.674 | 0.152 | 46.316 |
| 62 | −2.275 | 0.024 | 46.316 |
| Section 9 | | | |
| Point 1 | −2.361 | 0.136 | 46.811 |
| 2 | −1.885 | 0.310 | 46.811 |
| 3 | −1.408 | 0.483 | 46.811 |
| 4 | −0.935 | 0.664 | 46.811 |
| 5 | −0.464 | 0.852 | 46.811 |
| 6 | 0.003 | 1.050 | 46.811 |
| 7 | 0.465 | 1.259 | 46.811 |
| 8 | 0.999 | 1.521 | 46.811 |
| 9 | 1.520 | 1.804 | 46.811 |
| 10 | 2.023 | 2.112 | 46.811 |
| 11 | 2.507 | 2.450 | 46.811 |
| 12 | 2.926 | 2.787 | 46.811 |
| 13 | 3.325 | 3.157 | 46.811 |
| 14 | 3.698 | 3.559 | 46.811 |
| 15 | 4.039 | 3.988 | 46.811 |
| 16 | 4.346 | 4.442 | 46.811 |
| 17 | 4.579 | 4.836 | 46.811 |
| 18 | 4.794 | 5.241 | 46.811 |
| 19 | 4.997 | 5.652 | 46.811 |
| 20 | 5.099 | 5.858 | 46.811 |
| 21 | 5.206 | 6.060 | 46.811 |
| 22 | 5.326 | 6.257 | 46.811 |
| 23 | 5.408 | 6.367 | 46.811 |
| 24 | 5.503 | 6.466 | 46.811 |
| 25 | 5.615 | 6.545 | 46.811 |
| 26 | 5.743 | 6.596 | 46.811 |
| 27 | 5.879 | 6.612 | 46.811 |
| 28 | 5.981 | 6.597 | 46.811 |
| 29 | 6.076 | 6.561 | 46.811 |
| 30 | 6.164 | 6.508 | 46.811 |
| 31 | 6.244 | 6.444 | 46.811 |
| 32 | 6.383 | 6.295 | 46.811 |
| 33 | 6.497 | 6.125 | 46.811 |
| 34 | 6.614 | 5.879 | 46.811 |
| 35 | 6.694 | 5.619 | 46.811 |
| 36 | 6.741 | 5.351 | 46.811 |
| 37 | 6.755 | 5.024 | 46.811 |
| 38 | 6.727 | 4.698 | 46.811 |
| 39 | 6.659 | 4.378 | 46.811 |
| 40 | 6.555 | 4.068 | 46.811 |
| 41 | 6.418 | 3.770 | 46.811 |
| 42 | 6.243 | 3.472 | 46.811 |
| 43 | 6.040 | 3.194 | 46.811 |
| 44 | 5.812 | 2.935 | 46.811 |
| 45 | 5.564 | 2.696 | 46.811 |
| 46 | 5.299 | 2.477 | 46.811 |
| 47 | 4.931 | 2.217 | 46.811 |
| 48 | 4.544 | 1.986 | 46.811 |
| 49 | 4.143 | 1.780 | 46.811 |
| 50 | 3.590 | 1.540 | 46.811 |
| 51 | 3.024 | 1.332 | 46.811 |
| 52 | 2.448 | 1.151 | 46.811 |
| 53 | 1.867 | 0.988 | 46.811 |

TABLE I-continued

Stage 1 Nozzle Airfoil Points (Cold)

| | Y (transv) | X (axial) | Z (ht) |
|---|---|---|---|
| 54 | 1.346 | 0.854 | 46.811 |
| 55 | 0.823 | 0.727 | 46.811 |
| 56 | 0.299 | 0.605 | 46.811 |
| 57 | −0.226 | 0.485 | 46.811 |
| 58 | −0.751 | 0.366 | 46.811 |
| 59 | −1.276 | 0.248 | 46.811 |
| 60 | −1.802 | 0.133 | 46.811 |
| 61 | −2.329 | 0.025 | 46.811 |
| Section 10 | | | |
| Point 1 | −2.361 | 0.135 | 47.307 |
| 2 | −2.042 | 0.254 | 47.307 |
| 3 | −1.721 | 0.369 | 47.307 |
| 4 | −1.401 | 0.485 | 47.307 |
| 5 | −1.081 | 0.604 | 47.307 |
| 6 | −0.763 | 0.726 | 47.307 |
| 7 | −0.143 | 0.977 | 47.307 |
| 8 | 0.468 | 1.249 | 47.307 |
| 9 | 1.002 | 1.510 | 47.307 |
| 10 | 1.521 | 1.794 | 47.307 |
| 11 | 2.023 | 2.104 | 47.307 |
| 12 | 2.505 | 2.444 | 47.307 |
| 13 | 2.924 | 2.782 | 47.307 |
| 14 | 3.322 | 3.153 | 47.307 |
| 15 | 3.693 | 3.555 | 47.307 |
| 16 | 4.031 | 3.983 | 47.307 |
| 17 | 4.332 | 4.433 | 47.307 |
| 18 | 4.560 | 4.824 | 47.307 |
| 19 | 4.771 | 5.227 | 47.307 |
| 20 | 4.973 | 5.635 | 47.307 |
| 21 | 5.076 | 5.838 | 47.307 |
| 22 | 5.184 | 6.039 | 47.307 |
| 23 | 5.305 | 6.232 | 47.307 |
| 24 | 5.389 | 6.340 | 47.307 |
| 25 | 5.486 | 6.435 | 47.307 |
| 26 | 5.599 | 6.510 | 47.307 |
| 27 | 5.727 | 6.558 | 47.307 |
| 28 | 5.863 | 6.574 | 47.307 |
| 29 | 5.996 | 6.553 | 47.307 |
| 30 | 6.119 | 6.494 | 47.307 |
| 31 | 6.228 | 6.413 | 47.307 |
| 32 | 6.368 | 6.265 | 47.307 |
| 33 | 6.483 | 6.097 | 47.307 |
| 34 | 6.599 | 5.851 | 47.307 |
| 35 | 6.679 | 5.591 | 47.307 |
| 36 | 6.724 | 5.322 | 47.307 |
| 37 | 6.738 | 4.996 | 47.307 |
| 38 | 6.710 | 4.670 | 47.307 |
| 39 | 6.643 | 4.349 | 47.307 |
| 40 | 6.540 | 4.039 | 47.307 |
| 41 | 6.405 | 3.742 | 47.307 |
| 42 | 6.231 | 3.446 | 47.307 |
| 43 | 6.029 | 3.169 | 47.307 |
| 44 | 5.803 | 2.912 | 47.307 |
| 45 | 5.557 | 2.674 | 47.307 |
| 46 | 5.293 | 2.456 | 47.307 |
| 47 | 5.015 | 2.256 | 47.307 |
| 48 | 4.726 | 2.073 | 47.307 |
| 49 | 4.428 | 1.905 | 47.307 |
| 50 | 3.944 | 1.671 | 47.307 |
| 51 | 3.447 | 1.467 | 47.307 |
| 52 | 2.940 | 1.288 | 47.307 |
| 53 | 2.426 | 1.129 | 47.307 |
| 54 | 1.546 | 0.892 | 47.307 |
| 55 | 0.660 | 0.679 | 47.307 |
| 56 | −0.230 | 0.477 | 47.307 |
| 57 | −0.492 | 0.419 | 47.307 |
| 58 | −0.754 | 0.361 | 47.307 |
| 59 | −1.016 | 0.304 | 47.307 |
| 60 | −1.279 | 0.246 | 47.307 |
| 61 | −1.541 | 0.188 | 47.307 |
| 62 | −1.803 | 0.130 | 47.307 |
| 63 | −2.066 | 0.074 | 47.307 |
| 64 | −2.330 | 0.025 | 47.307 |

TABLE I-continued

Stage 1 Nozzle Airfoil Points (Cold)

| | Y (transv) | X (axial) | Z (ht) |
|---|---|---|---|
| Section 11 | | | |
| Point 1 | −2.309 | 0.134 | 47.803 |
| 2 | −1.993 | 0.254 | 47.803 |
| 3 | −1.675 | 0.368 | 47.803 |
| 4 | −1.357 | 0.483 | 47.803 |
| 5 | −1.039 | 0.601 | 47.803 |
| 6 | −0.723 | 0.721 | 47.803 |
| 7 | −0.106 | 0.968 | 47.803 |
| 8 | 0.501 | 1.235 | 47.803 |
| 9 | 1.030 | 1.495 | 47.803 |
| 10 | 1.543 | 1.778 | 47.803 |
| 11 | 2.039 | 2.089 | 47.803 |
| 12 | 2.515 | 2.430 | 47.803 |
| 13 | 2.928 | 2.770 | 47.803 |
| 14 | 3.320 | 3.142 | 47.803 |
| 15 | 3.686 | 3.544 | 47.803 |
| 16 | 4.018 | 3.969 | 47.803 |
| 17 | 4.318 | 4.416 | 47.803 |
| 18 | 4.545 | 4.804 | 47.803 |
| 19 | 4.756 | 5.204 | 47.803 |
| 20 | 4.958 | 5.609 | 47.803 |
| 21 | 5.061 | 5.811 | 47.803 |
| 22 | 5.169 | 6.010 | 47.803 |
| 23 | 5.290 | 6.202 | 47.803 |
| 24 | 5.375 | 6.309 | 47.803 |
| 25 | 5.473 | 6.405 | 47.803 |
| 26 | 5.587 | 6.482 | 47.803 |
| 27 | 5.715 | 6.530 | 47.803 |
| 28 | 5.851 | 6.547 | 47.803 |
| 29 | 5.985 | 6.526 | 47.803 |
| 30 | 6.107 | 6.469 | 47.803 |
| 31 | 6.216 | 6.388 | 47.803 |
| 32 | 6.356 | 6.241 | 47.803 |
| 33 | 6.470 | 6.073 | 47.803 |
| 34 | 6.587 | 5.829 | 47.803 |
| 35 | 6.668 | 5.571 | 47.803 |
| 36 | 6.716 | 5.304 | 47.803 |
| 37 | 6.734 | 4.979 | 47.803 |
| 38 | 6.709 | 4.654 | 47.803 |
| 39 | 6.646 | 4.335 | 47.803 |
| 40 | 6.546 | 4.025 | 47.803 |
| 41 | 6.413 | 3.728 | 47.803 |
| 42 | 6.242 | 3.432 | 47.803 |
| 43 | 6.043 | 3.156 | 47.803 |
| 44 | 5.818 | 2.899 | 47.803 |
| 45 | 5.574 | 2.661 | 47.803 |
| 46 | 5.311 | 2.444 | 47.803 |
| 47 | 5.035 | 2.244 | 47.803 |
| 48 | 4.747 | 2.062 | 47.803 |
| 49 | 4.450 | 1.895 | 47.803 |
| 50 | 3.969 | 1.662 | 47.803 |
| 51 | 3.474 | 1.459 | 47.803 |
| 52 | 2.969 | 1.281 | 47.803 |
| 53 | 2.457 | 1.123 | 47.803 |
| 54 | 1.581 | 0.886 | 47.803 |
| 55 | 0.698 | 0.675 | 47.803 |
| 56 | −0.187 | 0.475 | 47.803 |
| 57 | −1.357 | 0.218 | 47.803 |
| 58 | −1.541 | 0.177 | 47.803 |
| 59 | −1.725 | 0.137 | 47.803 |
| 60 | −1.909 | 0.097 | 47.803 |
| 61 | −2.093 | 0.056 | 47.803 |
| 62 | −2.278 | 0.026 | 47.803 |
| Section 12 | | | |
| Point 1 | −2.218 | 0.133 | 48.299 |
| 2 | −1.903 | 0.255 | 48.299 |
| 3 | −1.586 | 0.369 | 48.299 |
| 4 | −1.269 | 0.484 | 48.299 |
| 5 | −0.952 | 0.601 | 48.299 |
| 6 | −0.637 | 0.721 | 48.299 |
| 7 | −0.021 | 0.966 | 48.299 |
| 8 | 0.584 | 1.232 | 48.299 |
| 9 | 1.111 | 1.493 | 48.299 |

TABLE I-continued

Stage 1 Nozzle Airfoil Points (Cold)

| | Y (transv) | X (axial) | Z (ht) |
|---|---|---|---|
| 10 | 1.622 | 1.780 | 48.299 |
| 11 | 2.115 | 2.098 | 48.299 |
| 12 | 2.589 | 2.449 | 48.299 |
| 13 | 2.999 | 2.799 | 48.299 |
| 14 | 3.382 | 3.173 | 48.299 |
| 15 | 3.734 | 3.570 | 48.299 |
| 16 | 4.056 | 3.990 | 48.299 |
| 17 | 4.347 | 4.432 | 48.299 |
| 18 | 4.570 | 4.816 | 48.299 |
| 19 | 4.777 | 5.210 | 48.299 |
| 20 | 4.977 | 5.611 | 48.299 |
| 21 | 5.079 | 5.810 | 48.299 |
| 22 | 5.187 | 6.006 | 48.299 |
| 23 | 5.308 | 6.194 | 48.299 |
| 24 | 5.391 | 6.299 | 48.299 |
| 25 | 5.487 | 6.392 | 48.299 |
| 26 | 5.598 | 6.467 | 48.299 |
| 27 | 5.723 | 6.515 | 48.299 |
| 28 | 5.855 | 6.532 | 48.299 |
| 29 | 5.988 | 6.511 | 48.299 |
| 30 | 6.110 | 6.455 | 48.299 |
| 31 | 6.220 | 6.376 | 48.299 |
| 32 | 6.360 | 6.231 | 48.299 |
| 33 | 6.476 | 6.065 | 48.299 |
| 34 | 6.596 | 5.824 | 48.299 |
| 35 | 6.680 | 5.568 | 48.299 |
| 36 | 6.732 | 5.303 | 48.299 |
| 37 | 6.754 | 4.980 | 48.299 |
| 38 | 6.735 | 4.656 | 48.299 |
| 39 | 6.676 | 4.337 | 48.299 |
| 40 | 6.581 | 4.028 | 48.299 |
| 41 | 6.452 | 3.730 | 48.299 |
| 42 | 6.285 | 3.435 | 48.299 |
| 43 | 6.088 | 3.158 | 48.299 |
| 44 | 5.866 | 2.901 | 48.299 |
| 45 | 5.624 | 2.663 | 48.299 |
| 46 | 5.364 | 2.445 | 48.299 |
| 47 | 5.090 | 2.246 | 48.299 |
| 48 | 4.804 | 2.063 | 48.299 |
| 49 | 4.508 | 1.897 | 48.299 |
| 50 | 4.029 | 1.664 | 48.299 |
| 51 | 3.536 | 1.462 | 48.299 |
| 52 | 3.034 | 1.284 | 48.299 |
| 53 | 2.525 | 1.126 | 48.299 |
| 54 | 1.653 | 0.889 | 48.299 |
| 55 | 0.775 | 0.678 | 48.299 |
| 56 | −0.106 | 0.477 | 48.299 |
| 57 | −1.270 | 0.219 | 48.299 |
| 58 | −1.453 | 0.178 | 48.299 |
| 59 | −1.636 | 0.137 | 48.299 |
| 60 | −1.819 | 0.097 | 48.299 |
| 61 | −2.002 | 0.056 | 48.299 |
| 62 | −2.187 | 0.026 | 48.299 |
| Section 13 | | | |
| Point 1 | −2.096 | 0.132 | 48.795 |
| 2 | −1.838 | 0.235 | 48.795 |
| 3 | −1.577 | 0.331 | 48.795 |
| 4 | −1.316 | 0.426 | 48.795 |
| 5 | −1.055 | 0.523 | 48.795 |
| 6 | −0.795 | 0.621 | 48.795 |
| 7 | −0.536 | 0.721 | 48.795 |
| 8 | 0.072 | 0.966 | 48.795 |
| 9 | 0.670 | 1.231 | 48.795 |
| 10 | 1.190 | 1.490 | 48.795 |
| 11 | 1.695 | 1.776 | 48.795 |
| 12 | 2.183 | 2.091 | 48.795 |
| 13 | 2.651 | 2.441 | 48.795 |
| 14 | 3.056 | 2.789 | 48.795 |
| 15 | 3.432 | 3.162 | 48.795 |
| 16 | 3.779 | 3.558 | 48.795 |
| 17 | 4.097 | 3.979 | 48.795 |
| 18 | 4.386 | 4.423 | 48.795 |
| 19 | 4.608 | 4.808 | 48.795 |
| 20 | 4.814 | 5.202 | 48.795 |

TABLE I-continued

Stage 1 Nozzle Airfoil Points (Cold)

| | Y (transv) | X (axial) | Z (ht) |
|---|---|---|---|
| 21 | 5.012 | 5.602 | 48.795 |
| 22 | 5.113 | 5.800 | 48.795 |
| 23 | 5.219 | 5.996 | 48.795 |
| 24 | 5.339 | 6.183 | 48.795 |
| 25 | 5.421 | 6.289 | 48.795 |
| 26 | 5.515 | 6.384 | 48.795 |
| 27 | 5.624 | 6.460 | 48.795 |
| 28 | 5.748 | 6.510 | 48.795 |
| 29 | 5.880 | 6.527 | 48.795 |
| 30 | 6.012 | 6.506 | 48.795 |
| 31 | 6.134 | 6.450 | 48.795 |
| 32 | 6.244 | 6.373 | 48.795 |
| 33 | 6.341 | 6.280 | 48.795 |
| 34 | 6.427 | 6.177 | 48.795 |
| 35 | 6.503 | 6.066 | 48.795 |
| 36 | 6.627 | 5.828 | 48.795 |
| 37 | 6.717 | 5.575 | 48.795 |
| 38 | 6.776 | 5.313 | 48.795 |
| 39 | 6.806 | 4.991 | 48.795 |
| 40 | 6.795 | 4.668 | 48.795 |
| 41 | 6.744 | 4.349 | 48.795 |
| 42 | 6.655 | 4.039 | 48.795 |
| 43 | 6.532 | 3.740 | 48.795 |
| 44 | 6.369 | 3.443 | 48.795 |
| 45 | 6.176 | 3.166 | 48.795 |
| 46 | 5.956 | 2.908 | 48.795 |
| 47 | 5.716 | 2.670 | 48.795 |
| 48 | 5.457 | 2.452 | 48.795 |
| 49 | 5.184 | 2.253 | 48.795 |
| 50 | 4.899 | 2.071 | 48.795 |
| 51 | 4.604 | 1.906 | 48.795 |
| 52 | 4.126 | 1.674 | 48.795 |
| 53 | 3.635 | 1.473 | 48.795 |
| 54 | 3.134 | 1.296 | 48.795 |
| 55 | 2.627 | 1.138 | 48.795 |
| 56 | 1.758 | 0.900 | 48.795 |
| 57 | 0.884 | 0.686 | 48.795 |
| 58 | 0.007 | 0.483 | 48.795 |
| 59 | −1.153 | 0.221 | 48.795 |
| 60 | −1.335 | 0.179 | 48.795 |
| 61 | −1.517 | 0.138 | 48.795 |
| 62 | −1.699 | 0.097 | 48.795 |
| 63 | −1.881 | 0.056 | 48.795 |
| 64 | −2.065 | 0.026 | 48.795 |
| Section 14 | | | |
| Point 1 | −1.937 | 0.131 | 49.291 |
| 2 | −1.681 | 0.236 | 49.291 |
| 3 | −1.423 | 0.332 | 49.291 |
| 4 | −1.164 | 0.428 | 49.291 |
| 5 | −0.906 | 0.526 | 49.291 |
| 6 | −0.649 | 0.626 | 49.291 |
| 7 | −0.392 | 0.727 | 49.291 |
| 8 | 0.209 | 0.976 | 49.291 |
| 9 | 0.799 | 1.244 | 49.291 |
| 10 | 1.314 | 1.505 | 49.291 |
| 11 | 1.814 | 1.790 | 49.291 |
| 12 | 2.298 | 2.105 | 49.291 |
| 13 | 2.762 | 2.452 | 49.291 |
| 14 | 3.163 | 2.799 | 49.291 |
| 15 | 3.536 | 3.170 | 49.291 |
| 16 | 3.879 | 3.565 | 49.291 |
| 17 | 4.192 | 3.984 | 49.291 |
| 18 | 4.476 | 4.426 | 49.291 |
| 19 | 4.691 | 4.811 | 49.291 |
| 20 | 4.891 | 5.206 | 49.291 |
| 21 | 5.082 | 5.605 | 49.291 |
| 22 | 5.180 | 5.804 | 49.291 |
| 23 | 5.283 | 5.999 | 49.291 |
| 24 | 5.399 | 6.187 | 49.291 |
| 25 | 5.480 | 6.293 | 49.291 |
| 26 | 5.572 | 6.389 | 49.291 |
| 27 | 5.679 | 6.466 | 49.291 |
| 28 | 5.802 | 6.517 | 49.291 |
| 29 | 5.933 | 6.534 | 49.291 |

TABLE I-continued

Stage 1 Nozzle Airfoil Points (Cold)

| | Y (transv) | X (axial) | Z (ht) |
|---|---|---|---|
| 30 | 6.065 | 6.513 | 49.291 |
| 31 | 6.187 | 6.458 | 49.291 |
| 32 | 6.298 | 6.383 | 49.291 |
| 33 | 6.397 | 6.293 | 49.291 |
| 34 | 6.486 | 6.193 | 49.291 |
| 35 | 6.565 | 6.084 | 49.291 |
| 36 | 6.696 | 5.850 | 49.291 |
| 37 | 6.793 | 5.601 | 49.291 |
| 38 | 6.859 | 5.341 | 49.291 |
| 39 | 6.899 | 5.021 | 49.291 |
| 40 | 6.896 | 4.698 | 49.291 |
| 41 | 6.853 | 4.379 | 49.291 |
| 42 | 6.771 | 4.067 | 49.291 |
| 43 | 6.654 | 3.767 | 49.291 |
| 44 | 6.496 | 3.469 | 49.291 |
| 45 | 6.306 | 3.189 | 49.291 |
| 46 | 6.089 | 2.930 | 49.291 |
| 47 | 5.850 | 2.692 | 49.291 |
| 48 | 5.593 | 2.473 | 49.291 |
| 49 | 5.321 | 2.274 | 49.291 |
| 50 | 5.037 | 2.093 | 49.291 |
| 51 | 4.743 | 1.928 | 49.291 |
| 52 | 4.266 | 1.697 | 49.291 |
| 53 | 3.776 | 1.496 | 49.291 |
| 54 | 3.276 | 1.319 | 49.291 |
| 55 | 2.770 | 1.161 | 49.291 |
| 56 | 1.904 | 0.921 | 49.291 |
| 57 | 1.033 | 0.702 | 49.291 |
| 58 | 0.159 | 0.494 | 49.291 |
| 59 | −0.996 | 0.225 | 49.291 |
| 60 | −1.177 | 0.182 | 49.291 |
| 61 | −1.359 | 0.140 | 49.291 |
| 62 | −1.540 | 0.098 | 49.291 |
| 63 | −1.722 | 0.056 | 49.291 |
| 64 | −1.906 | 0.026 | 49.291 |
| Section 15 | | | |
| Point 1 | −1.751 | 0.131 | 49.786 |
| 2 | −1.498 | 0.236 | 49.786 |
| 3 | −1.241 | 0.333 | 49.786 |
| 4 | −0.983 | 0.430 | 49.786 |
| 5 | −0.727 | 0.528 | 49.786 |
| 6 | −0.471 | 0.628 | 49.786 |
| 7 | −0.216 | 0.730 | 49.786 |
| 8 | 0.380 | 0.982 | 49.786 |
| 9 | 0.965 | 1.254 | 49.786 |
| 10 | 1.474 | 1.519 | 49.786 |
| 11 | 1.969 | 1.809 | 49.786 |
| 12 | 2.447 | 2.126 | 49.786 |
| 13 | 2.908 | 2.473 | 49.786 |
| 14 | 3.307 | 2.817 | 49.786 |
| 15 | 3.678 | 3.186 | 49.786 |
| 16 | 4.017 | 3.579 | 49.786 |
| 17 | 4.326 | 3.997 | 49.786 |
| 18 | 4.603 | 4.440 | 49.786 |
| 19 | 4.813 | 4.825 | 49.786 |
| 20 | 5.005 | 5.221 | 49.786 |
| 21 | 5.187 | 5.622 | 49.786 |
| 22 | 5.281 | 5.821 | 49.786 |
| 23 | 5.380 | 6.017 | 49.786 |
| 24 | 5.493 | 6.205 | 49.786 |
| 25 | 5.571 | 6.312 | 49.786 |
| 26 | 5.663 | 6.408 | 49.786 |
| 27 | 5.768 | 6.485 | 49.786 |
| 28 | 5.890 | 6.536 | 49.786 |
| 29 | 6.020 | 6.553 | 49.786 |
| 30 | 6.152 | 6.532 | 49.786 |
| 31 | 6.275 | 6.479 | 49.786 |
| 32 | 6.386 | 6.405 | 49.786 |
| 33 | 6.487 | 6.317 | 49.786 |
| 34 | 6.578 | 6.219 | 49.786 |
| 35 | 6.660 | 6.113 | 49.786 |
| 36 | 6.797 | 5.883 | 49.786 |
| 37 | 6.903 | 5.637 | 49.786 |
| 38 | 6.977 | 5.379 | 49.786 |

TABLE I-continued

Stage 1 Nozzle Airfoil Points (Cold)

| | Y (transv) | X (axial) | Z (ht) |
|---|---|---|---|
| 39 | 7.026 | 5.061 | 49.786 |
| 40 | 7.033 | 4.739 | 49.786 |
| 41 | 6.998 | 4.418 | 49.786 |
| 42 | 6.924 | 4.105 | 49.786 |
| 43 | 6.812 | 3.804 | 49.786 |
| 44 | 6.659 | 3.503 | 49.786 |
| 45 | 6.472 | 3.221 | 49.786 |
| 46 | 6.258 | 2.961 | 49.786 |
| 47 | 6.021 | 2.721 | 49.786 |
| 48 | 5.765 | 2.502 | 49.786 |
| 49 | 5.493 | 2.302 | 49.786 |
| 50 | 5.209 | 2.121 | 49.786 |
| 51 | 4.915 | 1.957 | 49.786 |
| 52 | 4.439 | 1.727 | 49.786 |
| 53 | 3.948 | 1.527 | 49.786 |
| 54 | 3.449 | 1.351 | 49.786 |
| 55 | 2.944 | 1.191 | 49.786 |
| 56 | 2.080 | 0.946 | 49.786 |
| 57 | 1.212 | 0.721 | 49.786 |
| 58 | 0.340 | 0.505 | 49.786 |
| 59 | −0.812 | 0.228 | 49.786 |
| 60 | −0.993 | 0.185 | 49.786 |
| 61 | −1.174 | 0.142 | 49.786 |
| 62 | −1.355 | 0.099 | 49.786 |
| 63 | −1.536 | 0.057 | 49.786 |
| 64 | −1.720 | 0.026 | 49.786 |
| Section 16 | | | |
| Point 1 | −1.553 | 0.129 | 50.282 |
| 2 | −1.301 | 0.236 | 50.282 |
| 3 | −1.046 | 0.334 | 50.282 |
| 4 | −0.791 | 0.432 | 50.282 |
| 5 | −0.536 | 0.530 | 50.282 |
| 6 | −0.281 | 0.629 | 50.282 |
| 7 | −0.027 | 0.730 | 50.282 |
| 8 | 0.567 | 0.978 | 50.282 |
| 9 | 1.151 | 1.245 | 50.282 |
| 10 | 1.658 | 1.507 | 50.282 |
| 11 | 2.148 | 1.797 | 50.282 |
| 12 | 2.620 | 2.119 | 50.282 |
| 13 | 3.071 | 2.475 | 50.282 |
| 14 | 3.460 | 2.827 | 50.282 |
| 15 | 3.824 | 3.201 | 50.282 |
| 16 | 4.162 | 3.596 | 50.282 |
| 17 | 4.473 | 4.014 | 50.282 |
| 18 | 4.755 | 4.455 | 50.282 |
| 19 | 4.964 | 4.841 | 50.282 |
| 20 | 5.150 | 5.239 | 50.282 |
| 21 | 5.322 | 5.643 | 50.282 |
| 22 | 5.410 | 5.844 | 50.282 |
| 23 | 5.504 | 6.042 | 50.282 |
| 24 | 5.612 | 6.232 | 50.282 |
| 25 | 5.688 | 6.340 | 50.282 |
| 26 | 5.777 | 6.437 | 50.282 |
| 27 | 5.883 | 6.516 | 50.282 |
| 28 | 6.005 | 6.566 | 50.282 |
| 29 | 6.136 | 6.583 | 50.282 |
| 30 | 6.268 | 6.563 | 50.282 |
| 31 | 6.391 | 6.511 | 50.282 |
| 32 | 6.504 | 6.438 | 50.282 |
| 33 | 6.607 | 6.353 | 50.282 |
| 34 | 6.700 | 6.257 | 50.282 |
| 35 | 6.785 | 6.153 | 50.282 |
| 36 | 6.929 | 5.928 | 50.282 |
| 37 | 7.041 | 5.684 | 50.282 |
| 38 | 7.121 | 5.428 | 50.282 |
| 39 | 7.177 | 5.111 | 50.282 |
| 40 | 7.191 | 4.789 | 50.282 |
| 41 | 7.163 | 4.468 | 50.282 |
| 42 | 7.096 | 4.153 | 50.282 |
| 43 | 6.992 | 3.848 | 50.282 |
| 44 | 6.861 | 3.576 | 50.282 |
| 45 | 6.700 | 3.320 | 50.282 |
| 46 | 6.515 | 3.081 | 50.282 |
| 47 | 6.308 | 2.860 | 50.282 |

TABLE I-continued

Stage 1 Nozzle Airfoil Points (Cold)

| | Y (transv) | X (axial) | Z (ht) |
|---|---|---|---|
| 48 | 6.085 | 2.656 | 50.282 |
| 49 | 5.773 | 2.413 | 50.282 |
| 50 | 5.444 | 2.195 | 50.282 |
| 51 | 5.101 | 1.998 | 50.282 |
| 52 | 4.627 | 1.763 | 50.282 |
| 53 | 4.139 | 1.557 | 50.282 |
| 54 | 3.643 | 1.373 | 50.282 |
| 55 | 3.139 | 1.208 | 50.282 |
| 56 | 2.278 | 0.957 | 50.282 |
| 57 | 1.409 | 0.729 | 50.282 |
| 58 | 0.538 | 0.513 | 50.282 |
| 59 | −0.614 | 0.234 | 50.282 |
| 60 | −0.794 | 0.190 | 50.282 |
| 61 | −0.975 | 0.146 | 50.282 |
| 62 | −1.156 | 0.102 | 50.282 |
| 63 | −1.337 | 0.058 | 50.282 |
| 64 | −1.520 | 0.025 | 50.282 |
| Section 17 | | | |
| Point 1 | −1.353 | 0.126 | 50.778 |
| 2 | −1.102 | 0.236 | 50.778 |
| 3 | −0.848 | 0.336 | 50.778 |
| 4 | −0.593 | 0.435 | 50.778 |
| 5 | −0.338 | 0.535 | 50.778 |
| 6 | −0.083 | 0.634 | 50.778 |
| 7 | 0.172 | 0.735 | 50.778 |
| 8 | 0.768 | 0.979 | 50.778 |
| 9 | 1.354 | 1.242 | 50.778 |
| 10 | 1.864 | 1.501 | 50.778 |
| 11 | 2.358 | 1.788 | 50.778 |
| 12 | 2.832 | 2.111 | 50.778 |
| 13 | 3.282 | 2.473 | 50.778 |
| 14 | 3.664 | 2.831 | 50.778 |
| 15 | 4.015 | 3.214 | 50.778 |
| 16 | 4.338 | 3.621 | 50.778 |
| 17 | 4.632 | 4.051 | 50.778 |
| 18 | 4.901 | 4.502 | 50.778 |
| 19 | 5.105 | 4.890 | 50.778 |
| 20 | 5.293 | 5.286 | 50.778 |
| 21 | 5.469 | 5.687 | 50.778 |
| 22 | 5.558 | 5.887 | 50.778 |
| 23 | 5.652 | 6.086 | 50.778 |
| 24 | 5.758 | 6.277 | 50.778 |
| 25 | 5.854 | 6.410 | 50.778 |
| 26 | 5.972 | 6.524 | 50.778 |
| 27 | 6.066 | 6.580 | 50.778 |
| 28 | 6.169 | 6.615 | 50.778 |
| 29 | 6.278 | 6.627 | 50.778 |
| 30 | 6.410 | 6.605 | 50.778 |
| 31 | 6.532 | 6.552 | 50.778 |
| 32 | 6.645 | 6.479 | 50.778 |
| 33 | 6.747 | 6.393 | 50.778 |
| 34 | 6.841 | 6.297 | 50.778 |
| 35 | 6.926 | 6.194 | 50.778 |
| 36 | 7.072 | 5.969 | 50.778 |
| 37 | 7.190 | 5.729 | 50.778 |
| 38 | 7.280 | 5.476 | 50.778 |
| 39 | 7.348 | 5.161 | 50.778 |
| 40 | 7.373 | 4.839 | 50.778 |
| 41 | 7.354 | 4.516 | 50.778 |
| 42 | 7.291 | 4.200 | 50.778 |
| 43 | 7.186 | 3.895 | 50.778 |
| 44 | 7.053 | 3.623 | 50.778 |
| 45 | 6.890 | 3.369 | 50.778 |
| 46 | 6.702 | 3.131 | 50.778 |
| 47 | 6.494 | 2.912 | 50.778 |
| 48 | 6.270 | 2.708 | 50.778 |
| 49 | 5.958 | 2.465 | 50.778 |
| 50 | 5.631 | 2.243 | 50.778 |
| 51 | 5.290 | 2.042 | 50.778 |
| 52 | 4.820 | 1.799 | 50.778 |
| 53 | 4.336 | 1.584 | 50.778 |
| 54 | 3.841 | 1.393 | 50.778 |
| 55 | 3.340 | 1.221 | 50.778 |
| 56 | 2.479 | 0.964 | 50.778 |

TABLE I-continued

Stage 1 Nozzle Airfoil Points (Cold)

| | Y (transv) | X (axial) | Z (ht) |
|---|---|---|---|
| 57 | 1.611 | 0.735 | 50.778 |
| 58 | 0.738 | 0.521 | 50.778 |
| 59 | −0.414 | 0.241 | 50.778 |
| 60 | −0.595 | 0.196 | 50.778 |
| 61 | −0.776 | 0.150 | 50.778 |
| 62 | −0.956 | 0.105 | 50.778 |
| 63 | −1.137 | 0.060 | 50.778 |
| 64 | −1.320 | 0.025 | 50.778 |
| Section 18 | | | |
| Point 1 | −1.152 | 0.122 | 51.274 |
| 2 | −0.903 | 0.236 | 51.274 |
| 3 | −0.648 | 0.338 | 51.274 |
| 4 | −0.393 | 0.439 | 51.274 |
| 5 | −0.138 | 0.540 | 51.274 |
| 6 | 0.117 | 0.640 | 51.274 |
| 7 | 0.372 | 0.740 | 51.274 |
| 8 | 0.971 | 0.982 | 51.274 |
| 9 | 1.561 | 1.242 | 51.274 |
| 10 | 1.973 | 1.443 | 51.274 |
| 11 | 2.375 | 1.664 | 51.274 |
| 12 | 2.765 | 1.907 | 51.274 |
| 13 | 3.141 | 2.176 | 51.274 |
| 14 | 3.499 | 2.472 | 51.274 |
| 15 | 3.877 | 2.835 | 51.274 |
| 16 | 4.224 | 3.224 | 51.274 |
| 17 | 4.540 | 3.640 | 51.274 |
| 18 | 4.826 | 4.080 | 51.274 |
| 19 | 5.084 | 4.541 | 51.274 |
| 20 | 5.277 | 4.936 | 51.274 |
| 21 | 5.454 | 5.338 | 51.274 |
| 22 | 5.624 | 5.743 | 51.274 |
| 23 | 5.712 | 5.945 | 51.274 |
| 24 | 5.805 | 6.143 | 51.274 |
| 25 | 5.913 | 6.334 | 51.274 |
| 26 | 6.011 | 6.467 | 51.274 |
| 27 | 6.130 | 6.580 | 51.274 |
| 28 | 6.224 | 6.636 | 51.274 |
| 29 | 6.328 | 6.671 | 51.274 |
| 30 | 6.437 | 6.682 | 51.274 |
| 31 | 6.549 | 6.664 | 51.274 |
| 32 | 6.654 | 6.624 | 51.274 |
| 33 | 6.752 | 6.568 | 51.274 |
| 34 | 6.844 | 6.503 | 51.274 |
| 35 | 6.976 | 6.384 | 51.274 |
| 36 | 7.095 | 6.253 | 51.274 |
| 37 | 7.250 | 6.034 | 51.274 |
| 38 | 7.377 | 5.797 | 51.274 |
| 39 | 7.474 | 5.546 | 51.274 |
| 40 | 7.540 | 5.284 | 51.274 |
| 41 | 7.572 | 5.016 | 51.274 |
| 42 | 7.573 | 4.746 | 51.274 |
| 43 | 7.542 | 4.477 | 51.274 |
| 44 | 7.481 | 4.215 | 51.274 |
| 45 | 7.390 | 3.961 | 51.274 |
| 46 | 7.255 | 3.689 | 51.274 |
| 47 | 7.091 | 3.434 | 51.274 |
| 48 | 6.902 | 3.197 | 51.274 |
| 49 | 6.693 | 2.976 | 51.274 |
| 50 | 6.469 | 2.772 | 51.274 |
| 51 | 6.158 | 2.526 | 51.274 |
| 52 | 5.832 | 2.300 | 51.274 |
| 53 | 5.494 | 2.092 | 51.274 |
| 54 | 5.026 | 1.840 | 51.274 |
| 55 | 4.544 | 1.616 | 51.274 |
| 56 | 4.052 | 1.416 | 51.274 |
| 57 | 3.551 | 1.237 | 51.274 |
| 58 | 2.906 | 1.035 | 51.274 |
| 59 | 2.255 | 0.855 | 51.274 |
| 60 | 1.600 | 0.689 | 51.274 |
| 61 | 0.943 | 0.530 | 51.274 |
| 62 | −0.213 | 0.248 | 51.274 |
| 63 | −0.394 | 0.202 | 51.274 |
| 64 | −0.756 | 0.109 | 51.274 |
| 65 | −1.119 | 0.024 | 51.274 |

TABLE I-continued

| Stage 1 Nozzle Airfoil Points (Cold) | | | |
|---|---|---|---|
| | Y (transv) | X (axial) | Z (ht) |
| Section 19 | | | |
| Point 1 | −0.952 | 0.119 | 51.770 |
| 2 | −0.738 | 0.221 | 51.770 |
| 3 | −0.301 | 0.400 | 51.770 |
| 4 | 0.139 | 0.575 | 51.770 |
| 5 | 0.579 | 0.748 | 51.770 |
| 6 | 1.183 | 0.990 | 51.770 |
| 7 | 1.779 | 1.246 | 51.770 |
| 8 | 2.195 | 1.447 | 51.770 |
| 9 | 2.601 | 1.666 | 51.770 |
| 10 | 2.993 | 1.910 | 51.770 |
| 11 | 3.370 | 2.181 | 51.770 |
| 12 | 3.728 | 2.480 | 51.770 |
| 13 | 4.103 | 2.851 | 51.770 |
| 14 | 4.444 | 3.249 | 51.770 |
| 15 | 4.752 | 3.674 | 51.770 |
| 16 | 5.029 | 4.125 | 51.770 |
| 17 | 5.275 | 4.595 | 51.770 |
| 18 | 5.458 | 4.996 | 51.770 |
| 19 | 5.627 | 5.404 | 51.770 |
| 20 | 5.789 | 5.814 | 51.770 |
| 21 | 5.874 | 6.018 | 51.770 |
| 22 | 5.967 | 6.218 | 51.770 |
| 23 | 6.076 | 6.409 | 51.770 |
| 24 | 6.154 | 6.515 | 51.770 |
| 25 | 6.247 | 6.609 | 51.770 |
| 26 | 6.357 | 6.683 | 51.770 |
| 27 | 6.480 | 6.729 | 51.770 |
| 28 | 6.611 | 6.745 | 51.770 |
| 29 | 6.724 | 6.727 | 51.770 |
| 30 | 6.830 | 6.687 | 51.770 |
| 31 | 6.929 | 6.632 | 51.770 |
| 32 | 7.022 | 6.567 | 51.770 |
| 33 | 7.156 | 6.450 | 51.770 |
| 34 | 7.277 | 6.320 | 51.770 |
| 35 | 7.437 | 6.103 | 51.770 |
| 36 | 7.569 | 5.868 | 51.770 |
| 37 | 7.670 | 5.618 | 51.770 |
| 38 | 7.740 | 5.357 | 51.770 |
| 39 | 7.776 | 5.089 | 51.770 |
| 40 | 7.778 | 4.819 | 51.770 |
| 41 | 7.748 | 4.550 | 51.770 |
| 42 | 7.686 | 4.286 | 51.770 |
| 43 | 7.595 | 4.032 | 51.770 |
| 44 | 7.460 | 3.758 | 51.770 |
| 45 | 7.295 | 3.503 | 51.770 |
| 46 | 7.105 | 3.265 | 51.770 |
| 47 | 6.895 | 3.044 | 51.770 |
| 48 | 6.671 | 2.838 | 51.770 |
| 49 | 6.361 | 2.589 | 51.770 |
| 50 | 6.037 | 2.358 | 51.770 |
| 51 | 5.701 | 2.144 | 51.770 |
| 52 | 5.236 | 1.882 | 51.770 |
| 53 | 4.757 | 1.647 | 51.770 |
| 54 | 4.266 | 1.438 | 51.770 |
| 55 | 3.766 | 1.253 | 51.770 |

TABLE I-continued

| Stage 1 Nozzle Airfoil Points (Cold) | | | |
|---|---|---|---|
| | Y (transv) | X (axial) | Z (ht) |
| 56 | 3.120 | 1.046 | 51.770 |
| 57 | 2.466 | 0.863 | 51.770 |
| 58 | 1.809 | 0.698 | 51.770 |
| 59 | 1.149 | 0.539 | 51.770 |
| 60 | 0.631 | 0.415 | 51.770 |
| 61 | 0.114 | 0.286 | 51.770 |
| 62 | −0.402 | 0.152 | 51.770 |
| 63 | −0.919 | 0.023 | 51.770 |

wherein Z is a from a plane through a horizontal centerline of the turbine and X and Y are coordinate values defining the profile at each distance Z from the plane through the horizontal centerline of the turbine, said values being in inches and having a tolerance of +0.165 to −0.135.

7. A nozzle stage according to claim 6 having outer and inner walls defining an annulus through the nozzle stage.

8. A nozzle stage according to claim 7 wherein the inner diameter and the outer diameter of the inner and outer walls, respectively, have profiles at ambient temperature substantially in accordance with Cartesian coordinate values of X, Y and Z as set forth in Table II as follows:

TABLE II

| Radial Gaspath points (Cylindrical sweep) | | | |
|---|---|---|---|
| Annulus | | X (axial) | Z (ht) |
| OD 1 | 0.000 | +7.910 | 52.123 |
| OD 2 | 0.000 | +6.717 | 51.802 |
| OD 3 | 0.000 | +5.373 | 51.439 |
| OD 4 | 0.000 | +4.030 | 51.054 |
| OD 5 | 0.000 | +2.687 | 50.590 |
| OD 6 | 0.000 | +1.343 | 50.199 |
| OD 7 | 0.000 | 0.000 | 50.035 |
| OD 8 | 0.000 | −0.500 | 50.035 |
| ID 1 | 0.000 | +8.277 | 43.533 |
| ID 2 | 0.000 | 0.000 | 43.533 |
| ID 3 | 0.000 | −0.500 | 43.533 |

wherein Z is a height from a plane through the horizontal centerline of the turbine and X and Y are coordinate values defining radii along inner and outer walls of the annulus at each distance Z from the plane through the horizontal centerline of the turbine, said values being in inches and having a tolerance of +0.165 to −0.135.

* * * * *

UNITED STATES PATENT AND TRADEMARK OFFICE

CERTIFICATE OF CORRECTION

PATENT NO. : 6,398,489 B1
DATED : June 4, 2002
INVENTOR(S) : Burdgick et al.

It is certified that error appears in the above-identified patent and that said Letters Patent is hereby corrected as shown below:

Column 37,
Line 13, after "inner", insert -- and --.

Signed and Sealed this

Fifth Day of November, 2002

*Attest:*

*Attesting Officer*

JAMES E. ROGAN
*Director of the United States Patent and Trademark Office*